US006688517B1

(12) United States Patent
McClure et al.

(10) Patent No.: US 6,688,517 B1
(45) **Date of Patent: *Feb. 10, 2004**

(54) ELECTRONIC VOTING SYSTEM

(75) Inventors: Neil McClure, Lafayette, CO (US); Kermit Lohry, Boulder, CO (US)

(73) Assignee: Hart InterCivic, Inc., Austin, TX (US)

( * ) Notice: Subject to any disclaimer, the term of this patent is extended or adjusted under 35 U.S.C. 154(b) by 183 days.

This patent is subject to a terminal disclaimer.

(21) Appl. No.: 09/812,768

(22) Filed: Mar. 20, 2001

Related U.S. Application Data

(62) Division of application No. 08/953,003, filed on Oct. 16, 1997, now Pat. No. 6,250,548.

(51) Int. Cl.[7] ..... G07C 13/00
(52) U.S. Cl. ..... 235/51; 235/57; 235/386
(58) Field of Search ..... 705/12; 235/51, 235/51 R, 51 B, 50 A, 50, 57, 386

(56) References Cited

U.S. PATENT DOCUMENTS

| | | | |
|---|---|---|---|
| 3,620,587 A | 11/1971 | Ahmann | |
| 3,806,219 A | 4/1974 | Ahmann | |
| 4,015,106 A | 3/1977 | DePhillipo | |
| 4,451,728 A | 5/1984 | McKay et al. | |
| 4,569,564 A | 2/1986 | Ahamann | |
| 4,641,240 A | 2/1987 | Boram | |
| 4,641,241 A | 2/1987 | Boram | |
| 4,712,757 A | 12/1987 | Ahmann | |
| 4,774,665 A | 9/1988 | Webb | |
| 4,854,652 A | 8/1989 | Ahmann | |
| 5,189,288 A | 2/1993 | Anno et al. | |
| 5,278,753 A | 1/1994 | Graft, III | |
| 5,341,477 A | 8/1994 | Pitkin et al. | |
| 5,379,212 A | 1/1995 | Sarner et al. | |
| 5,758,325 A | 5/1998 | Lohry et al. | |
| 5,875,432 A | 2/1999 | Sehr | |
| 5,878,399 A | 3/1999 | Peralto | |
| 6,250,548 B1 * | 6/2001 | McClure et al. | 235/51 |
| 2001/0042005 A1 * | 11/2001 | McClure et al. | 705/12 |

OTHER PUBLICATIONS

"Newcomer U.S. Voting Machines Invades specialized marketplace" *Boulder County Business Report*, Nov. 1994.
"The Mark 1 Voting System", Firm Brochure (date unknown).

* cited by examiner

*Primary Examiner*—Karl D. Frech
(74) *Attorney, Agent, or Firm*—Dan Cleveland, Jr.; Lathrop & Gage L.C.

(57) ABSTRACT

An electronic voting system with a headquarters unit, a plurality of precinct units, a plurality of voting stations associated with each precinct unit, and a plurality of mobile memory units (MMUs) to contain data that can be transported back and forth between the headquarters unit and the precinct units. The MMUs include FLASH memory, wherein each memory location can be written to once and read many times. Each memory location can thus only be subsequently written to after all the data in the entire FLASH memory has been erased. The system includes the ability to store images of the cast ballots at multiple locations for verification and authentication. The system includes the ability to store a direct representation of the voter's selections as displayed to the voter as a redundant image of the ballot. The system also includes the ability for each voting station to automatically read the particular ballot overlay thereon to verify the proper ballot style is being used. The system also includes the ability to communicate between the various components of the system when the components are in a storage configuration. The various components of the system can be folded from a deployed configuration into the storage configuration so that the largest two-dimensional aspect in the storage configuration is a fraction of that in the deployed configuration. The system also includes a remote sensing terminal and a text-to-speech converter for use by disabled persons. An absentee ballot that can be read by the voting system is also provided as is the ability to vote over a computer network, such as the Internet.

10 Claims, 29 Drawing Sheets

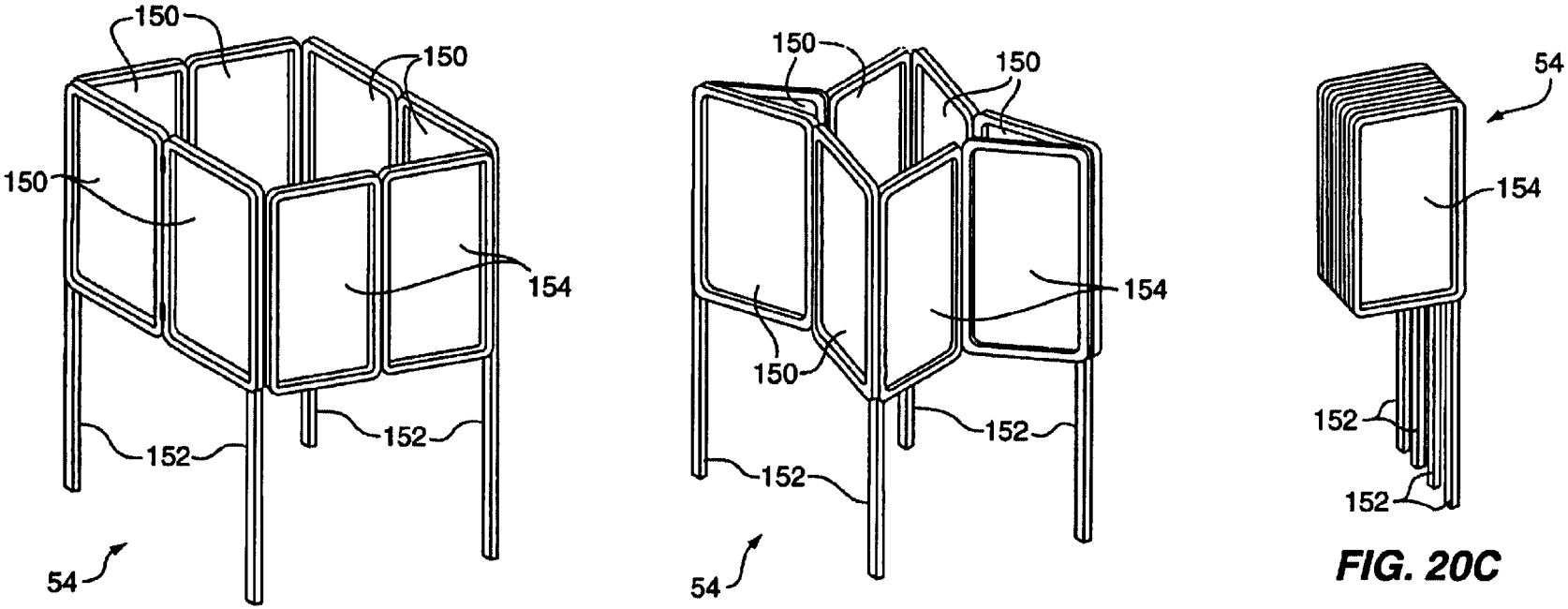
FIG. 20C
FIG. 20B
FIG. 20A
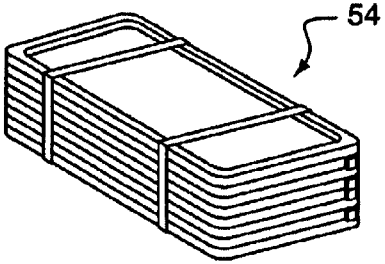
FIG. 20E
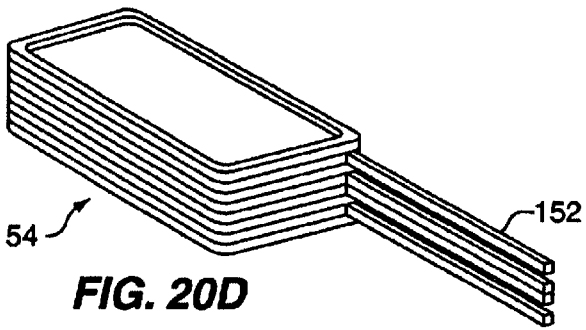
FIG. 20D

ELECTRONIC VOTING SYSTEM

Related Applications

This is a divisional of application Ser. No. 08/953,003 filed Oct. 16, 1997 now U.S. Pat. No. 6,250,548.

The present invention relates to an integrated voting system which is electronic at all stages in the system and, more particularly, to a voting system with a reusable, non-volatile memory module transportable between different levels of the election system to pass data therebetween, and relates further to improved features for determining and verifying that the appropriate ballot form is being used at a particular voting station. The present invention also relates to verifying that the voter's ballot selection displayed to the voter is identical to the ballot image recorded electronically, to improved storage for between election equipment management and testing, and to an improved absentee voting system.

BACKGROUND OF THE INVENTION

Voting systems in place around the world typically involve either paper ballots or mechanical counters. The paper ballots used in some areas may be as simple as a form onto which the selected candidate's name is written or on which an X is placed to indicate the candidate selected by the voter. Alternatively, the paper ballot may have holes punched therein adjacent to the desired candidate or ballot issue. With such ballots, the only time the voter is required to write on the ballot is if a write-in candidate is selected. There are many disadvantages to such paper ballot systems. One is the fact that paper ballots can become physically damaged, or altered, between the time the voter makes the selection and the time a ballot-counting machine eventually reads the voter's selection on the ballot. Another disadvantage is that voters can inadvertently punch the hole or place the X next to a different candidate than was intended by the voter. When this goes unnoticed by the voter, the voter ends up casting a vote which was not intended. In addition, write-in votes must be manually read by an election official, which is time consuming and may be very difficult, depending upon the legibility of the voter's handwriting. In many cases, the name written in cannot be read and the vote does not count. Also, paper ballots must be custom printed for each election, with at least one ballot printed for each potential voter. Since these ballots are specific to a particular election, the costs are significant for each election.

Many other election systems include a system of mechanical switches and levers which are actuated by the voter to increment one of a plurality of mechanical counters. At the end of the election, the counters for each of the candidates at each of the voting booths is tallied and the results are reported to the jurisdictional headquarters. While this system solves some of the problems of the paper ballots, the machines required at each of the voting booths are fairly expensive and have many mechanical parts which require routine maintenance and repair. In addition, these machines are heavy and cumbersome to move and set up. Another disadvantage is the manual tallying of the counters required at the precinct level and the manual reporting of the results to the jurisdictional headquarters.

There are a variety of other non-electronic methods for conducting an election. Unfortunately, each suffer from many of the problems discussed above: illegible ballots which must be discarded, votes inadvertently cast for unintended candidates, excessive costs for election consumables, and the ease with which the election results may be altered by tampering.

While some electronic voting systems have been developed to solve some of these problems, none of these proposed electronic voting systems has been successful enough to result in widespread use. In the areas where non-mechanical means for conducting elections are used, the electronic components typically make up only a portion of the overall system so that it is not an integrated system. Thus, some of the steps in the election process are still performed manually.

Some of the proposed electronic systems include a form of transportable memory, which is used to transport data between the jurisdictional headquarters and the precinct. It is believed that all of the transportable memory methods proposed to date require either internal batteries to maintain the data contained therein, or else the memories are physically altered to maintain the stored data. One drawback of the internal battery technique is the risk of power interruption when the batteries lose their charge. In addition, the batteries must be recharged or replaced on a regular basis, adding to the cost of the system. An example of a physically altered memory is an optical disk which can be written to only once for each memory location. Thus, the optical disk must be replaced for subsequent elections, or else the optical disk must have sufficient capacity to store data for multiple elections, at the end of which the optical disk must be replaced. Of course, the cost of these disks is another election consumable cost.

In addition, the transportable memory devices disclosed in the prior art are intended to be transported to a specific precinct as they each contain data relevant only to that specific precinct. Such a system will not operate properly if the wrong transportable memory device is transported to a particular precinct. This would mean, at a minimum, at least two precincts would have their voting terminals incorrectly configured and would, at a minimum, delay opening of the polls at those precincts which were affected. Worse yet, the error might not be discovered and the entire election conducted with the incorrect configuration for some number of precincts. One known system requires two memory modules to complete the voting process at the precinct, further raising the potential for error.

A variety of methods for securing the data in these proposed electronic systems has been disclosed. Most take the form of either redundantly storing the data or disabling the device so that no further data can be written to that device. While redundantly storing data may at first blush appear to add some level of security, it does not protect against writing the wrong data redundantly. In order to be sure that the wrong data is not written, it must be verified as correct prior to writing it redundantly.

Other electronic-based systems include video display screens similar to computer monitors which present the required information to the voter. Such systems require the voter to scroll through the available options to make their selection. This may be confusing to some voters who may become lost and frustrated in the hierarchy of screen formats, so as not to complete their ballot or to erroneously do so. Further, many voters are intimidated by operating computer-based technology and may choose not to vote.

Another electronic-based system includes voting tablets with printed ballot overlays laid on top of the voting tablet. The voter can actuate selected switches from a matrix of switches to make their selections. Unfortunately, as with many of the other systems, the feedback provided to the voter that the desired candidate was selected is disconnected from the data electronically stored regarding the cast ballot in the electronic system. In other words, it is possible that a voter would receive an indication or feedback that one candidate had been selected when actually the system recorded a vote for a competing candidate.

Another problem with most electronic-based systems is the inability to deal with differing ballot styles even within a precinct, wherein certain voters may be eligible to vote on certain races and other voters eligible to vote on other races. Most electronic-based systems must be manually controlled to provide the proper ballot styles to each voter or the proper combinations selected from among many to provide the correct eligibility for the voter. This places undue burden on the operator and presents significant opportunity for error.

Other proposed electronic-based systems include a machine readable card given to each voter. The voter must be given the appropriate card for that voter, and then properly place the card in a voting terminal before they can vote. Because of the possibility of errors in each of these steps, such systems have their drawbacks as well.

It is against this background and the desire to solve the problems of the prior art that the present invention has been developed.

SUMMARY OF THE INVENTION

Accordingly, it is an object of the present invention to provide an improved voting system which is electronic and integrated at all levels.

It is also an object of the present invention to provide an improved voting system which has a relatively low number of consumables for each election conducted.

It is further an object of the present invention to provide an improved election system which is highly accurate, both in terms of maximizing the ability of the voter to accurately select their intended candidate and in the ability of the election system to accurately convert the voter's selection into the final cumulative tally of votes at the jurisdictional headquarters.

It is still further an object of the present invention to provide an improved election system which instills confidence in the voting public as to the accuracy and relative difficulty of tampering with the system.

It is still further an object of the present invention to provide an improved election system which is easy to use both for the voters and for election officials having little training.

It is still further an object of the present invention to provide an improved election system which operates in a variety of environmental conditions, including varieties of ambient lighting, and available connections for power and telecommunications.

It is yet further an object of the present invention to provide an improved election system which is easy to store, easy to set up, and easy to take down.

Additional objects, advantages and novel features of this invention shall be set forth in part in the description that follows, and in part will become apparent to those skilled in the art upon examination of the following specification or may be learned by the practice of the invention. The objects and advantages of the invention may be realized and attained by means of the instrumentalities, combinations, and methods particularly pointed out in the appended claims.

To achieve the foregoing and other objects and in accordance with the purposes of the present invention, as embodied and broadly described therein, the present invention is directed to an electronic voting system including a headquarters unit with a central computer and a plurality of precinct units, each precinct unit including a network controller. The system also includes a plurality of mobile memory units, each of the mobile memory units connectable to the central computer to provide data to and receive data from the central computer and connectable to any of the precinct units to provide data to and receive data from the network controller, wherein the data is stored in the mobile memory unit in at least one memory device that can be written to once and read from many times. The system also includes a plurality of voting stations, each station being in data communication with one of the plurality of precinct units, each voting station including a voting tablet on which a voter can select the candidates and sides of issues to vote on and can cast a ballot by actuating a cast ballot actuator on the voting tablet to cause an electronic ballot image of the voter's cast ballot to be communicated to the network controller. The network controller provides data representative of the ballot image to the mobile memory unit for storage therein and wherein the mobile memory units are transportable between the precinct units and the central computer to transport data therebetween including representations of the ballot images to the central computer.

The memory device may include flash memory. The memory device may store data magnetically. The data provided to the network controller from the central computer via the mobile memory unit may include a plurality of different ballot styles that may be appropriate for different precincts within the jurisdiction. The electronic ballot image of the voter's cast ballot may also be stored in the network controller. The electronic ballot image of the voter's cast ballot may also be stored at each voting station. The voting tablet may include a plurality of display indicators to provide a visible indication to the voter of the ballot selections made by the voter, and the voting tablet further includes a plurality of sensors providing signals representative of the state of the display indicators, the signals providing a redundant indication to authenticate the ballot cast by the voter, the redundant indication of the cast ballot being stored at the voting station. The plurality of voting stations may be connectable to each other with only one of the voting stations directly connected to the network controller to allow the remaining voting stations to be connected indirectly to the network controller through the interconnection of the voting stations. The plurality of voting stations may be daisy-chained together.

The present invention is also directed to an electronic voting system including a central computer for collecting ballots cast by voters and a plurality of voting stations communicating with the central computer, the voting stations each including a base with a plurality of voting switches, a plurality of display indicators, and a plurality of sensors, the voting switches providing an indication to the central computer of the ballot cast by the voter, the display indicators providing a visible indication to the voter of the ballot selections made by the voter, the sensors providing signals representative of the state of the display indicators, the signals providing a redundant indication to authenticate the ballot cast by the voter.

The present invention is also directed to an electronic voting system including a central computer for collecting ballots cast by voters and a plurality of voting stations communicating with the central computer, the voting stations each including a base with voting switches, the base being receptive of a ballot overlay, the ballot overlay including text or other symbology providing information to the voter relating to the various races and issues to be decided in the election, the ballot overlay further including a coded region thereon with a code representative of a ballot style encoded therein, the base including a code reader proximate to the coded region of the ballot overlay when the ballot overlay is placed in position on the base, the code reader being operational to read the code encoded in the coded region of the ballot overlay and to supply the code to the voting station for configuring the voting system for the ballot style indicated by the code.

The present invention is also directed to an electronic voting system having an operational configuration and a storage configuration. The system includes a plurality of precinct units, each precinct unit including a network controller and a plurality of voting stations, each station being in data communication with one of the plurality of precinct units when said voting system is in the operational configuration, and each station being capable of being placed in data communication with one of the precinct units when said voting system is in the storage configuration.

Each voting station may include an external connector for connection to the network controller that is accessible when the voting station is in the storage configuration.

The present invention is also directed to an electronic voting system including a central computer for collecting ballots cast by voters and a plurality of voting stations, each station being capable of eventually communicating data to the central computer, each voting station having a deployed configuration in which the voting station can receive selections from voters and each voting station having a storage configuration in which the voting station folds to a fraction of the largest two-dimensional aspect of the voting station in the deployed configuration when placed in the storage configuration.

Each voting station may include both a voting tablet that can communicate data and a privacy enclosure that at least partially encloses the voting tablet and the voter using the voting tablet. Each of the voting tablet and the privacy enclosure may have a deployed and a storage configuration, and each fold to a fraction of the largest two-dimensional aspect of the voting station in the deployed configuration when placed in the storage configuration.

The present invention is also directed to an electronic voting system including a central computer for collecting ballots cast by voters and a plurality of voting stations, each station being capable of eventually communicating data to the central computer, at least one of the voting stations having a remote sensing terminal to receive inputs from a device adapted for use by disabled persons.

The present invention is also directed to an electronic voting system including a central computer for collecting ballots cast by voters and a plurality of voting stations, each station being capable of eventually communicating data to the central computer, at least one of the voting stations having a text-to-speech converter to provide an audio output to voters unable to read a ballot appearing on the voting tablet.

The present invention is also directed to a ballot system including a printed top sheet with symbolic representations of races and contests for a particular election, the top sheet having fields in which a voter can make marks indicating selections for any of the races and contests. The ballot system also includes a corresponding bottom sheet removably attached to the top sheet, the bottom sheet having printed data processing graphical marks and having fields corresponding to the fields on the top sheet. The top sheet and bottom sheet cooperate together to allow the voter marks on the top sheet to be copied onto the corresponding fields on the bottom sheet.

The present invention is also directed to a method for conducting an election, at least in part over a computer network including a central election computer and a plurality of other computers accessible by a voter, the other computers being connected to the election computer through the network. The method includes the steps of receiving identifying information from the voter to authenticate the voter's identity, verifying the voter's eligibility to vote in the election and verifying that the voter has not yet voted in the election, serving voter-specific election information to the one of the other computers accessed by the voter, and receiving information from the voter indicative of the voter's selections for the various races and contests in the election.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings:

FIGS. 11*a*, 11*b*, 11*c*, and 1*d* are sequential perspective views of the voting tablet of FIG. 10 showing how the voting tablet is folded and stored in a storage container.

FIGS. 20*a* through 20*e* are perspective views of the folding sequence of the privacy enclosure.

DETAILED DESCRIPTION OF THE PREFERRED EMBODIMENTS

Figure 1:
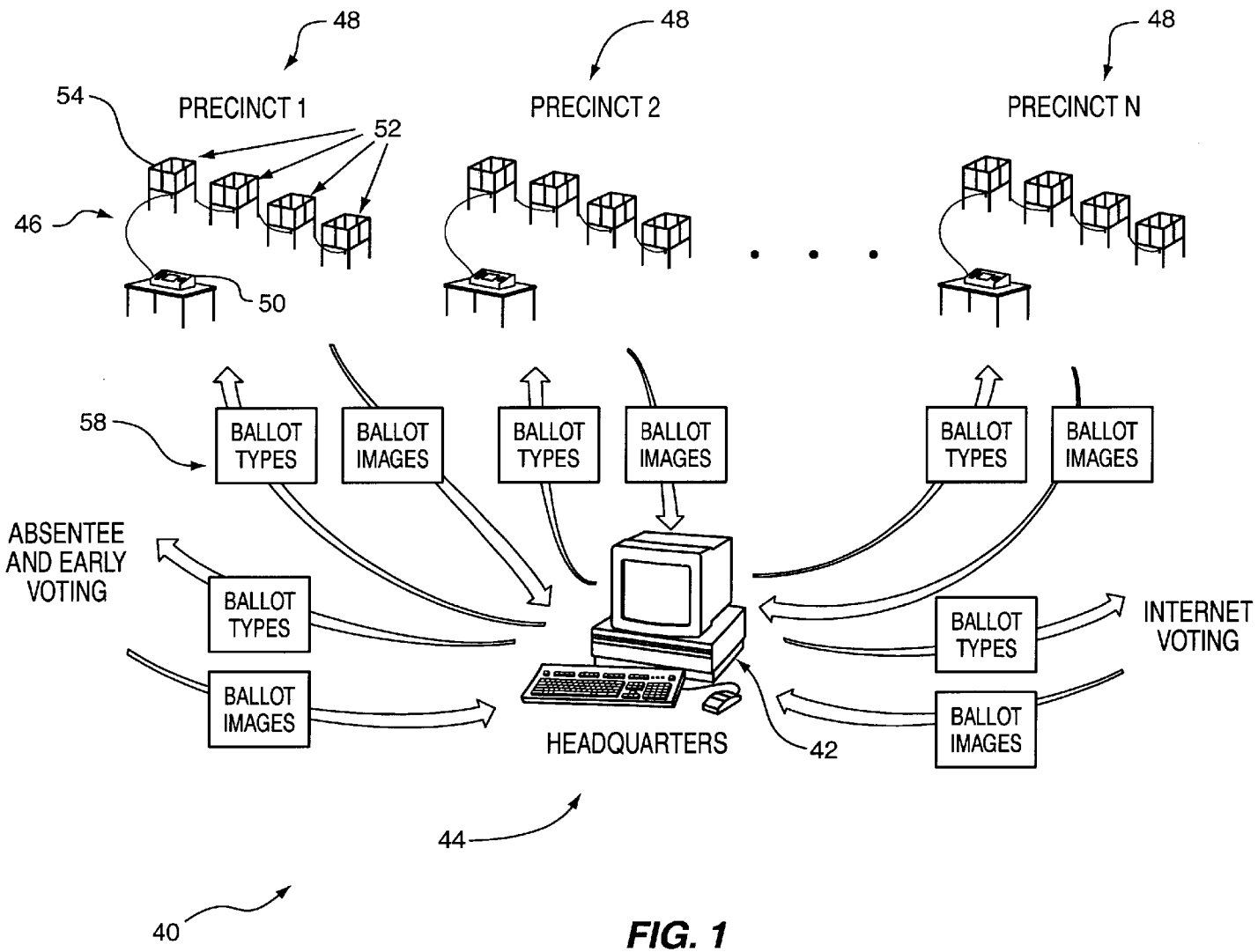
FIG. 1 is a block diagram of the improved electronic election system of the present invention.

The improved electronic voting system 40 the present invention includes a central computer 42 located at an election or jurisdictional headquarters 44 and subsystems 46 located at a multiplicity of precincts 48 associated with the election headquarters 44 (FIG. 1). The subsystem 46 at each of the precincts 48 includes a controller 50 connected to a network of voting stations 52, also known as a tablet network controller (TNC) 50. Each voting station 52 has a privacy enclosure 54 in which a voter may cast his or her ballot. The privacy enclosure 54 encloses a voting tablet 56 which is in communication with the tablet network controller 50. A mobile memory unit 58 is transportable between the jurisdictional headquarters 44 and the precinct/subsystem to facilitate data communication therebetween. The mobile memory unit 58 is selectively connectable to either the central computer 42 at,election headquarters 44 or the network controller 50 of the subsystem 46 at the precinct 48.

The central computer 42 at election headquarters 44 can be functional throughout the election year to assist with a variety of tasks related to the election. These tasks include ongoing tasks such as election and ballot preparation, absentee voting, early voting, and management control, as well as tasks relating to election day itself such as election tally, election preferences, reports/statistics, and functions relating to the poll workers. In addition, the central computer 42 provides security functions to the overall election system.

Election Headquarters

Figure 2:
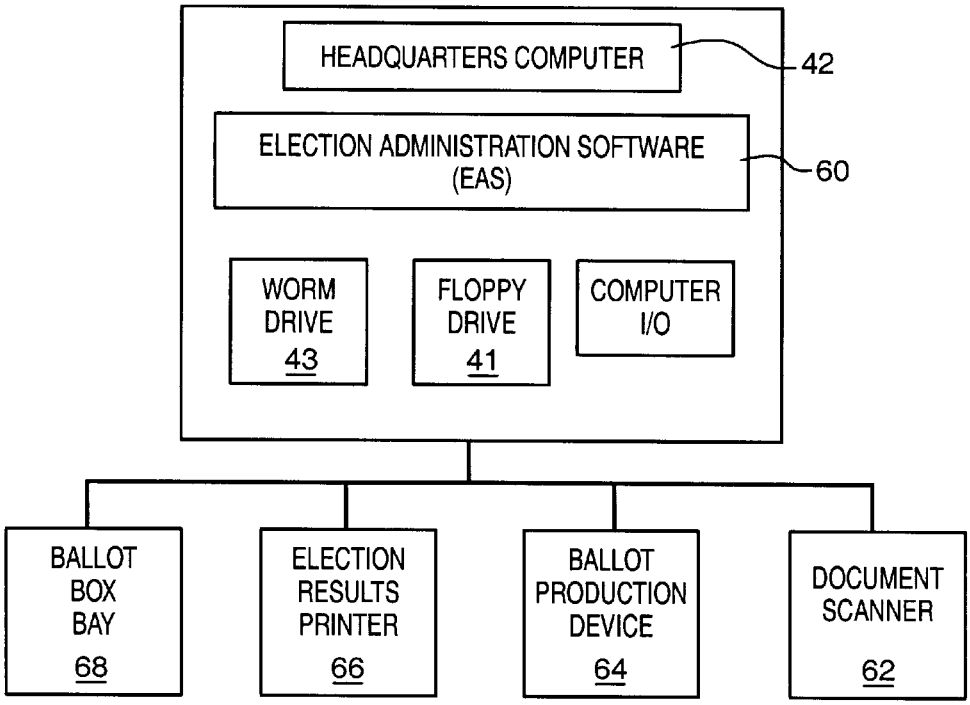
FIG. 2 is a block diagram of the components at election headquarters shown in FIG. 1.

As shown in FIG. 2, the equipment at election headquarters 44 includes the hardware necessary to run an Election Administration Software (EAS) 60 and support the other required functions to manage and conduct elections. The central component is the central computer 42, such as a Windows®-based Personal Computer (PC) with sufficient memory and storage capacity to efficiently operate graphics-based software. Preferably, the central computer 42 has a standard 3.5-inch floppy drive 41 and Compact Disc (CD) drive 43 that has data write capability. The CD drive 43 functions as a Write Once Read Many (WORM) and is used as a permanent archive of all activities performed on the central computer 42. The central computer 42 has input/output capacity to be able to connect at least five external peripherals.

The external peripherals support data input/output to the central computer 42 and include an absentee ballot document scanner 62, a ballot production device 64, an election results printer 66, and a ballot box bay 68. The document scanner 62 may be one such as manufactured by Hewlett Packard, model number ScanJet Spse. The scanner 62 produces images that are managed by the absentee ballot module under EAS control. The ballot production device 64 produces ballot overlays 65 and can be either a large format laser printer or a plotter commonly used for engineering drawings. Examples are the Xante Accel-aWriter-8200 and the NovaJet PRO 42*e*, respectively. The selection of which printer is used is made by the jurisdiction and is based on average ballot size, desired speed of printing, and cost. The EAS 60 can support either type of ballot production device. The election results printer is a standard laser printer 66 found in any computer hardware store. A separate printer is provided for printing election results because reports are generated in regular 8.5"×11" paper format and do not require any specialized printing. Using this type of printer is more cost effective. The ballot box bay 68 is used to read and write to the mobile memory units (MMU) 58.

Ballot Box Bay

The ballot box bay 68 is a stand-alone unit that supports reading and writing of the MMUs 58. The ballot box bay 68 provides the option to download election specific information prior to the election but its primary function is reading the post-election results. Once the polls close, the MMU 58 is removed from the TNC 50 at each precinct 48 and physically transported to headquarters 44. The MMU 58 is inserted into an open slot in the ballot box bay 68. The EAS 60, in election tally mode, polls the ballot box bay 68 slots, detects that an MMU 58 has been inserted and uploads the data contained therein. The ballot box bay 68 has indicator lights that tell the user when the uploading is in progress and when it is complete. The MMU 58 still contains a copy of the data it contained but a copy has been made by the EAS 60 through the ballot box bay 68.

The ballot box bay 68 is controlled by the central computer 42 and the EAS 60. The ballot box bay 68 is handled as an external computer peripheral and is linked to the computer 42 through a computer cable. The ballot box bay 68 is a standard computer card expansion bay with its own power supply. The expansion bay can hold up to eight "cards" in slots provided at the front of enclosure. Depending on the number of MMU reader slots that a jurisdiction wants, a PC card is installed in the expansion bay to satisfy those requirements. The PC card has a PCMCIA connector (a standard defined by the Personal Computer Memory Card International Association) and mechanical support to accommodate the MMU 58. An electronic circuit to facilitate communication between the central computer 42 and the MMU 58 are also part of the PC card.

Election Management Software (EAS)

The EAS 60 is a custom developed software program that runs on the central computer 42. The EAS 60 is created based upon a commercial database program, such as Microsoft Access, with a custom interface specific to this application. All user interface screens are customized and the interrelation of the data is custom mapped and managed. The commercial database program is used for file structure and data manipulation. Alternatively, it would be possible to obtain rights in a third party's software such as "Ballot Right" produced by United States Election Corporation of West Chester, Pa., and customize it to this application.

To accomplish this versatility, the EAS 60 includes several different databases operated under a common user interface. The user interface has a title screen that offers the user several different functions that are selected depending on the task at hand. Each of these functions, when selected, will take the user to a new screen specific to the selected function and guide him through the required task. These functions include, but are not limited to voter registration, precinct geographic boundary definition, absentee and early vote, election data entry, ballot creation, results tallying, report printing, user preferences and on-line help. Beneath this user interface, the system is accessing the different databases required to manage all the election data.

The separate, independent databases have the ability to transfer and share data back and forth as required, as the sum of the databases is required for election management. The databases include voter registration, geographic districting, campaign finance, absentee and early vote data, election design, election tally and reports. The voter registration database is used for entering, purging, maintaining, and keeping up-to-date voter registration data and has the ability to generate the jurisdiction's required mailings to registered voters. The geographic districting database is used to develop, manage, and alter geographical boundary definitions of precincts and voter eligibility information and produces material necessary for the logistical support of staging elections. The campaign finance segment maintains records of campaign finance disclosures, candidate information, and other information required by statute. The absentee vote database maintains and manages absentee voter lists and produces absentee ballot material and maintains images of returned ballots. The early vote database is for ballot styles, equipment lists and schedules, voter turnout lists, and early voted ballot images. The election design database is used for election preparation and includes ballot layout and production, equipment lists, and electronic and graphic version of the many different ballot styles. The tallying and reports databases count election results and produce certified reports, respectively. The above description of the database functions and contents is not intended to be all inclusive, but merely to provide one skilled in the art a sampling to demonstrate the interconnectivity and range of information contained therein.

The EAS 60 continuously participates in updating the requirements of managing non-election day information that is integral to the election process. The wealth of information is stored in the computer 42 on an internal hard drive and on the complementary Write Once Read Many (WORM) optical disk 43. The WORM drive 43 provides the greatest reliability available in computer data storage, offers a large data storage capacity in a compact footprint and has a very long data retention capability. The WORM drive 43 is the central means for archiving all election information including, but not limited to all databases, ballot images, and the election history, commonly referred to as the "audit trail". Alternatively, this data could be stored on a high-density, solid-state storage device.

The audit trail provides means to reproduce, to a reasonable degree, all events leading up to an election, the election day events, and post-election activities up until the election is completed and certified as closed. Therefore, the WORM drive 43 also stores a record of all "sessions" on the EAS 60. When a user performs any operation on the EAS 60, it will impact the stored election data and, in the interest of security and data integrity, any changes or alterations would be traceable to prevent unauthorized activity or tampering. This is part of the audit trail that must exist for all elections so that the election process and procedures can withstand public scrutiny. The audit trail is incorporated throughout the system, beginning with the EAS 60 and continuing through to the precinct equipment. Every event where there is a change in the state of the information stored for the election must be recorded, and is subsequently stored on the WORM drive 43 at the end of the election. Each component of the system 40 participates in collecting and maintaining audit trail information and is described at the appropriate time within this description.

In preparation of an election, election data is entered, processed, and output in several formats. The electronic version of the ballot configuration produced by the EAS 60 is used to set up the voting tablet electronically for the ballot that is assigned to a particular precinct through the equipment list. The voting tablet 56 provides a large matrix of membrane switches that are selectively enabled for a particular election which provides the greatest efficiency and flexibility when the EAS 60 lays out the ballot. The electronic ballot is one packet of data that is contained in the mobile memory unit (MMU) 58 when it is mated with a tablet network controller (TNC) 50 at a particular precinct 48. Other information in the MMU 58 includes voter registration information that is used for voter authorization during the election, a list of ballot styles and their assigned precinct, a valid equipment list, and security data. The information in the MMU 58 establishes the complete requirements for conducting an election at any precinct 48, not just at a specific precinct.

The ballot overlay 65 has a single-sided laminate applied as part of the ballot production process that serves to protect the ballot overlay 65 when placed in the voting tablet 56 at the precinct 48. Alternatively, the overlay 65 could include reverse printing on a transparent or translucent material.

Mobile Memory Unit

Figure 3:
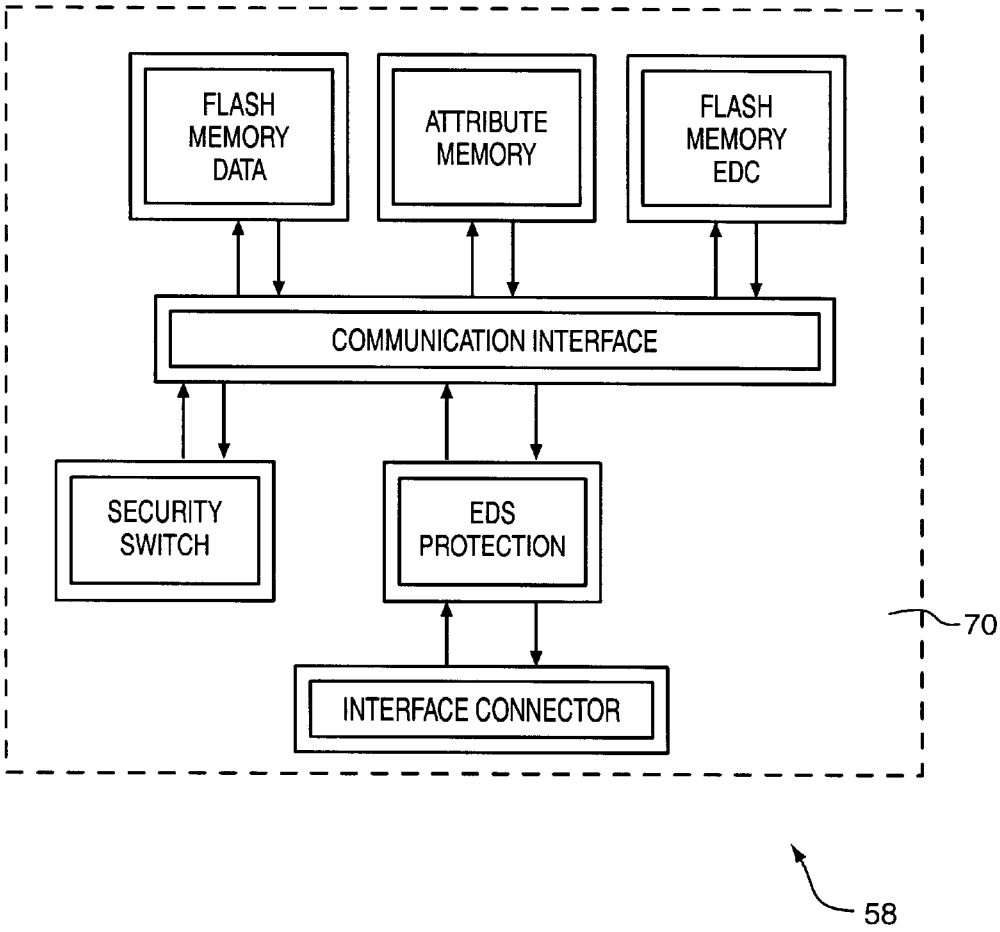
FIG. 3 is a block diagram of the mobile memory unit shown in FIG. 1.

The MMU 58 (FIG. 3) is a reusable data storage device that can permanently maintain stored information in the absence of power. The technology employed can be electronic memory that maintains its stored information when power is removed, or it can be rewriteable optical media. For example, the MMU 58 could be a card of FLASH memory. The MMU 58 is preferably not magnetic or write-once media. Magnetic media present a reliability and security risk while write-once media impacts one of the major advantages of an electronic voting machine—cost. Write-once media would have to be replaced for every precinct for each election, thus driving up the expense for "election consumables" and hence, the cost of producing an election.

The physical design of the MMU 58 is dependent on the technology used but will typically include a protective enclosure 70 and a means for locking the MMU 58 into the TNC 50. The enclosure 70 is sealed so that it cannot be opened without damage. This prevents unauthorized tampering. The present invention utilizes the PCMCIA standard, Type I, that was developed for the portable computer market. As mentioned above, once the MMU 58 is inserted into the TNC 50, it is completely enclosed and the removal mechanism is disabled by the TNC software to lock the MMU 58 in place. This prevents the MMU 58 from sticking out of the TNC 50 to minimize possible damage when being transported or handled. Adopting the PCMCIA standard dictates the form factor of the device with minor modification. The receiving bay of the TNC 50 and the enclosure 70 of the MMU 58 deviate from the exact PCMCIA standard in that the MMU .58 will be completely swallowed into the receiving bay like a diskette in a personal computer. While the MMU 58 is very similar to the PCMCIA standard mechanically, it is not similar electrically. In addition, the connector pin configuration is altered to further prevent unauthorized insertion. Even the mechanical differences will be such that an off-the-shelf device employing the PCMCIA standard cannot be inserted into the TNC 50.

The MMU 70 enclosure contains a single printed circuit board (PCB) that has the MMU electronics assembled to it. The PCB is mounted within the enclosure with the interface connector accessible from one end. The PCB has integrated circuits (ICs) mounted to it using Surface Mount Technology (SMT) or other high density electronic interconnect methods, and the PCB provides electrical connection between the ICs. The functions designed into the MMU 58 include non-volatile memory, communication interface, security switch, and electro-static discharge (ESD) protection.

The MMU 58 uses FLASH memory to provide a physically separate memory location for all election sensitive information. There are two memory ICs of identical size. One IC is used for storing election information and the other is used for error detection and correction (EDC) codes. The size of the memory can vary and the present invention incorporates 4-megabyte ICs which are more than adequate to handle the data requirements. The attribute memory is contained within the memory ICs but is separately addressable. The attribute memory stores information about the MMU 58, including electronic serial number, MMU configuration data, security data, jurisdiction and election identification, number of times the MMU 58 has been used, and other data as may be required. The communication interface provides control logic for addressing the memory ICs, management of the data and address bus on the MMU 58 and necessary buffers used for communication timing and control. As additional levels of protection, data encryption and password protection for the MMU 58 could be provided.

The ESD protection provided by the MMU 58 utilizes commercially available ICs that typically use a Zener diode array to dissipate any incident energy. ESD can cause loss of stored information and can even permanently damage ICs. The techniques employed by the present invention are well known in the industry. The interface connector is the modified PCMCIA standard that supports hot insertion of the MMU 58. The ESD protection can either be incorporated into the connector or be a separate IC.

Tablet Network Controller

Figure 4:
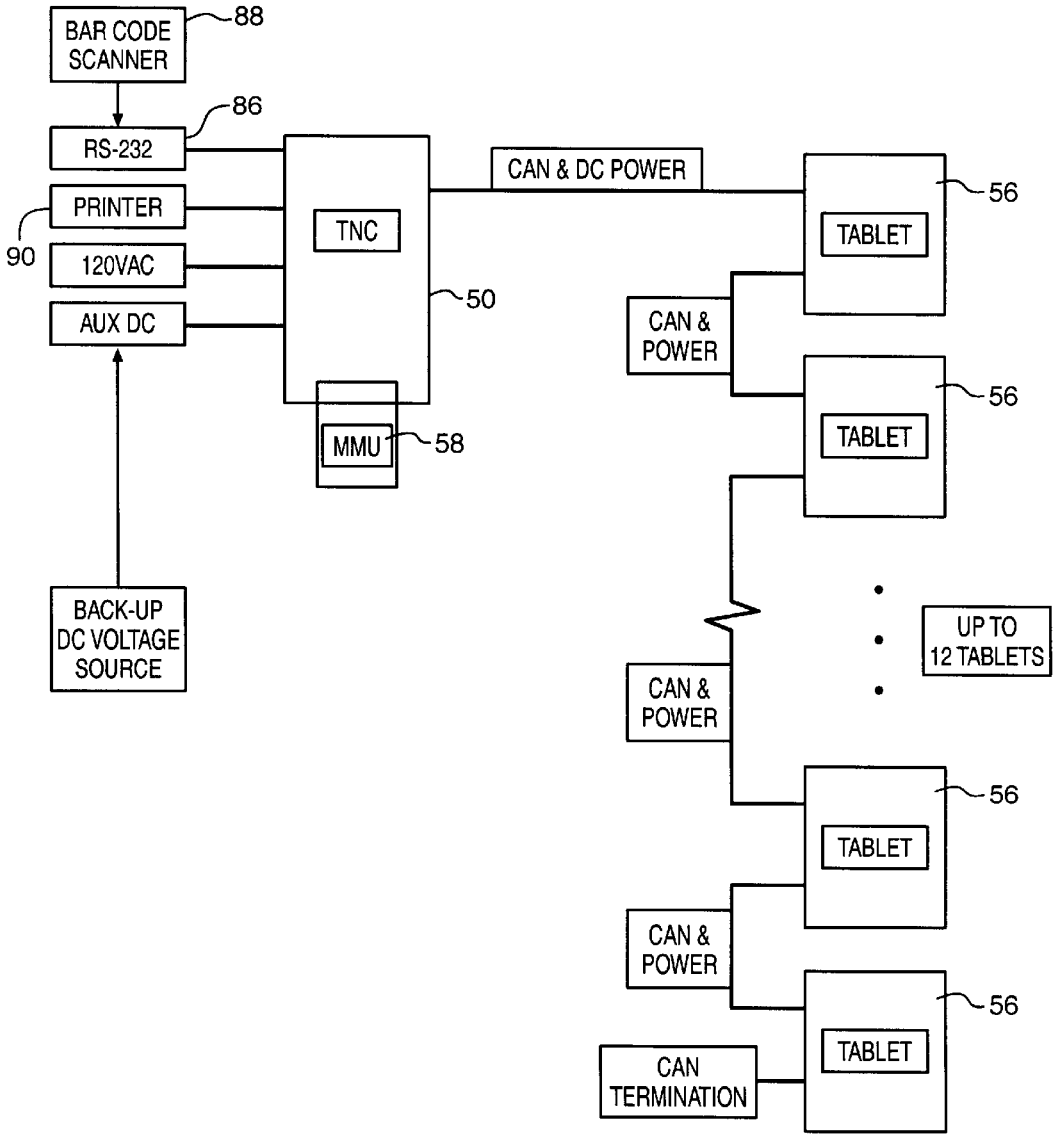
FIG. 4 is a block diagram of the components at the precinct shown in FIG. 1.
Figure 5:
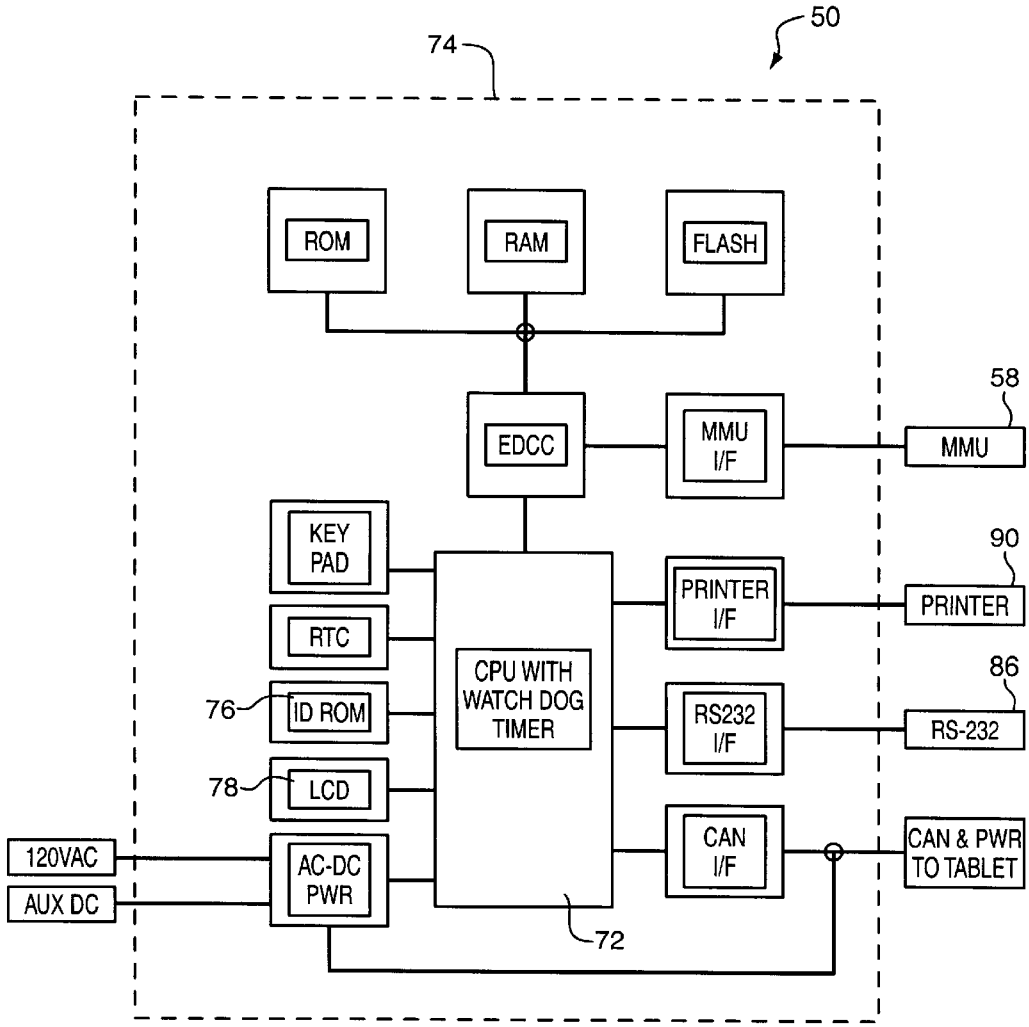
FIG. 5 is a block diagram of the tablet network controller shown in FIG. 4.

As shown in FIGS. 4 and 5, the tablet network controller (TNC) 50 manages the election at the individual precincts 48 through the use of resident firmware, data supplied from the mobile memory unit (MMU) 58 and the voting tablet 56. The TNC 50 is a stand alone computing unit with standard computer functions that support a variety of interfaces specific to the present invention. The TNC 50 includes a CPU or microprocessor 72 that controls the operation of the TNC 50 as programmed by resident firmware. For this reason, election specific data information is delivered to the TNC 50, via the MMU 58. The TNC 50 supports a number of peripheral interfaces that, together, define the operational capability of the unit. These interfaces are described below with an explanation of their functions within the election process.

The microprocessor 72, along with the majority of the interface electronics, is assembled and interconnected on the main printed circuit board (PCB) which is mounted within a TNC enclosure or housing 74. Several interfaces are used as found in most microprocessor-based systems and can be categorized into three general areas: direct microprocessor support, memory, and input/output (I/O).

Direct microprocessor support includes a data/address bus, address decoding, a watchdog timer, and interconnect logic functions. The present invention operates on a 16-bit wide bus where information is transferred and operated on 16 bits at a time. Bus width determines the speed with which information can be moved around, the depth of the addressing capability, and the cost of the components. The 16-bit architecture is adequate for the present invention and provides more than enough performance while maintaining cost objectives.

Address decoding is a function of bus width and is designed such that each of the interfaces can be individually identified and controlled by the microprocessor 72. Typically, the interfaces to the microprocessor 72 are address mapped, along with the memory, to provide an orderly structure. The watchdog timer is the guard dog of the microprocessor system and operates almost independently of the microprocessor 72. The watchdog timer essentially is required to be updated by the microprocessor at regular, fixed intervals of time. If the update occurs, that implies that the system is functioning normally and the watchdog remains dormant. Should an update be late or missed, the watchdog initiates a error routine that signals the system that operation is not normal. The error routine can vary in its function, from running a background diagnostic to shutting down the system. The interconnect logic is used to make address, data and control signals of the various integrated circuits (ICs) compatible with one another. Typically, different manufacturers of ICs are used within a circuit design and the interconnect logic accounts for the subtle differences in connectivity of the ICs. Also included in direct microprocessor support is a real time clock (RTC). The RTC is provided by an IC that has its own independent battery power and maintains the time regardless of whether the TNC is powered. The RTC is used for time-stamping events of an election such as polls open, polls closed, vote counts and other auditable events.

TNC Memory

The TNC provides temporary and permanent memory for use by the voting tablet and three different technologies are used in the present invention: 1) read only memory (ROM); 2) random access memory (RAM); and 3) electrically erasable programmable read only memory (FLASH $E^2$PROM). The permanent ROM memory stores machine code for operation of the TNC. The temporary memory, RAM, is used to store accumulated voter selections prior to casting the ballots and also provides for other microprocessor support requirements. The FLASH $E^2$PROM, or FLASH memory, is used to permanently store data that will be secure when power is removed. All information that is critical to conducting and report an election is stored in FLASH memory. This includes voting tablet configuration data; ballot images from cast ballots, audit information concerning various events during polling periods and other data as may be required.

All operations which require information to be written to any memory location are "backed up" by the incorporation of error detection and correction (EDC) methodologies. EDC methodologies can exist in either a hardware or software implementation and are widely used in the public domain for applications that require high data reliability. The basic concept of EDC is to add extra or redundant bits to a data word that characterize that data word. These extra bits, when properly mathematically coded, have the ability to completely reconstruct the data word that they represent. Therefore, by incorporating EDC in every data word storage, and storing the extra bits in a separate memory device, two levels of confidence are created. If the initial data word is either corrupted when stored or corrupted when read, the extra bits can recreate an exact duplicate of that word. The second level occurs if the primary memory storage device fails. In that instance, the failure can at least be detected. These are well known techniques but not previously applied to electronic voting systems where assurances of data integrity are critical. There are many sources of both hardware and software solutions publicly available. The present invention utilizes a hardware solution such as that available from ECC Technologies that utilizes a byte-parallel Reed-Solomon error correcting system.

Also a part of the memory system of the TNC 50, is an identification ROM (ID ROM) 76. The ID ROM 76 is a factory programmed serial memory device that contains an electronic serial number of the TNC 50. Each device in the present invention contains a unique electronic serial number that is used to identify every event that the particular unit is involved in. For example, at the closing of the polls, the electronic serial number is included in the results of the elections. In this manner, all data related to an election is traceable to the responsible device.

TNC I/O

The TNC 50 controls the tablet operation through a communication link that is a serial network which can accommodate a very large number of compatible devices. The preferred communication protocol is the Controller Area Network (CAN) or similar serial networking protocols. CAN uses 11-bit or 29-bit unique identifiers to identify each device, or node, on the bus. These identifiers carry identification information and encrypted security data that must be verified by the receiving device prior to the initiation of each data transfer on the bus. This maintains communication security in each direction of data flow between the TNC 50 and the voting tablet 56 to prevent unauthorized devices from being connected to the bus. Built into the CAN protocol are error detection and error signaling functions along with automatic re-transmission of corrupted messages. If a device on the bus fails, the CAN protocol is able to differentiate between temporary errors and a failed device which allows the other devices to continue to function normally. The CAN protocol offers a robust link that allows for secure communication between the TNC 50 and voting tablet(s) 56 and can be implemented either with electronic cables or wireless connections. The wireless link may be a low power, ultra high frequency (UHF), spread spectrum type that is extremely difficult to receive and decode except by an authorized transmitter or receiver. The TNC 50 and voting tablet 56 are able to support either interface link with no modification so that a jurisdiction may select the method.

Coded connection to the TNC 50 is through interface connectors located on the side of the unit. There are two connectors, one female and one male. The female connector is used during the voting process and connects to the first voting tablet 56 to initiate the serial CAN network. In this configuration, the TNC 50 controls the voting tablets 56. The male connector is used for storage of the TNC 50 at the warehouse between election. The storage configuration causes the TNC 50 to become controlled, with other TNCs 50, and is connected in a serial network with other TNCs 50 to facilitate warehouse testing. The interface connectors are wired to the internal bus of the TNC 50 and are controlled by the microprocessor 72.

The TNC 50 can operate one or more voting tablets 56 simultaneously so that a single election official could run the election. The limit to the number of tablets 56 operating simultaneously is governed only by the operational capability of the precinct workers. The network bus technology utilized by the present invention has a theoretical limit of 500 nodes, far greater than any precinct should require.

Figure 6:
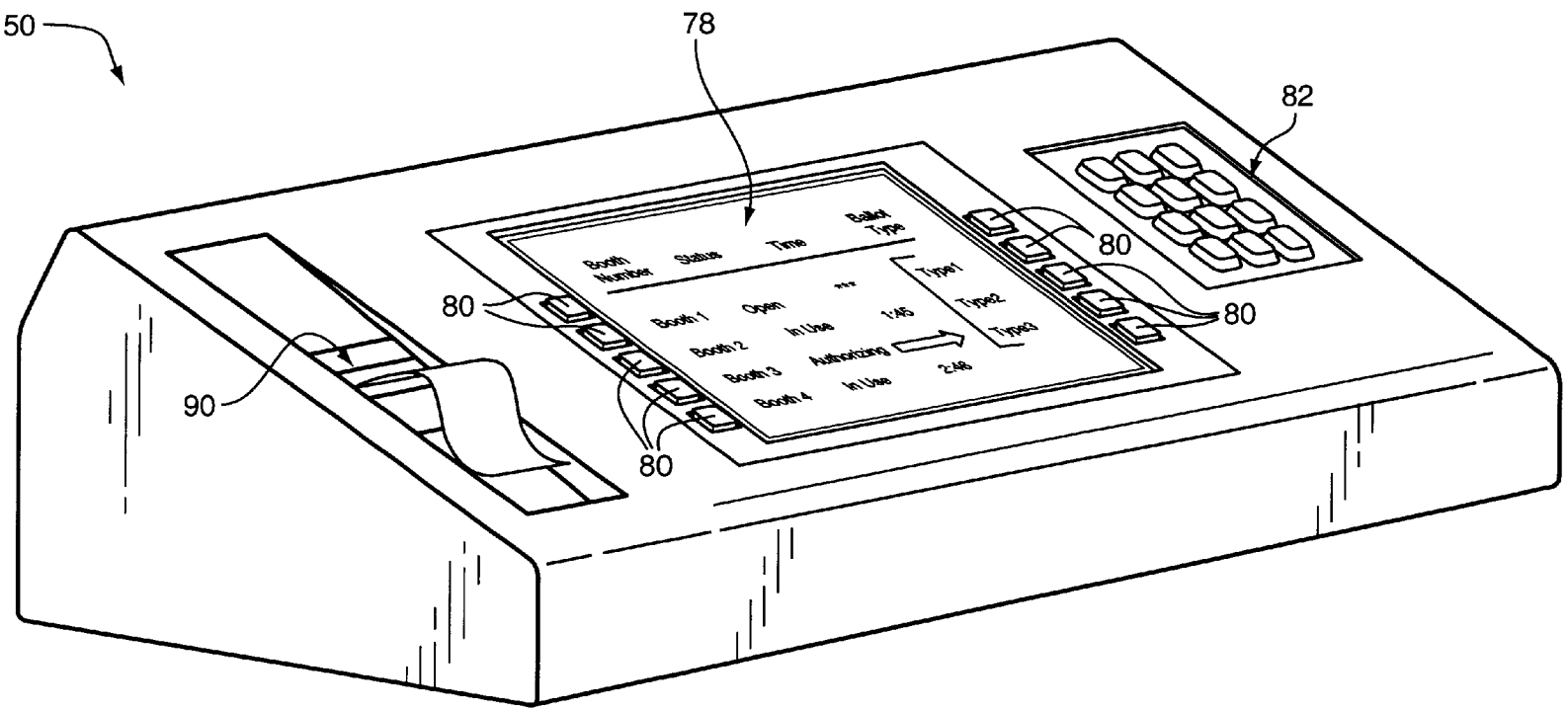
FIG. 6 is a perspective view of the tablet network controller shown in FIG. 5.
Figure 7:
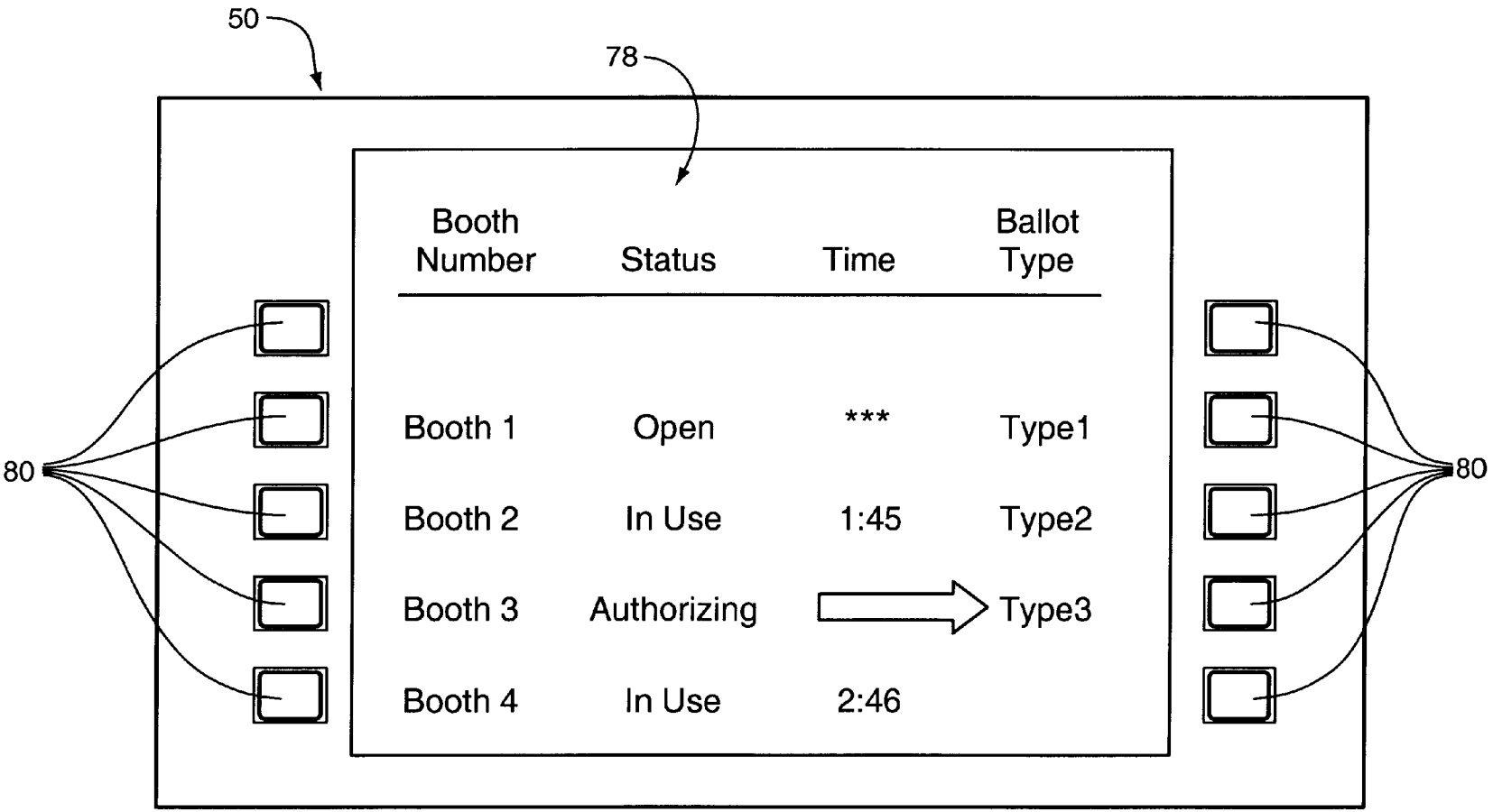
FIG. 7 is a sample display screen displayed by the tablet network controller of FIG. 6.

The TNC 50 includes a display 78 (FIGS. 6 and 7) employing liquid crystal display (LCD) or flat panel display technology. These types of displays have a high relative contrast level and when presented to the operator at the optimized viewing angle, substantially prevent unauthorized viewing. The display 78 is the central area of the TNC 50 and is the primary communication tool for the user interface. The display 78 is controlled by the microprocessor 72 and is connected, via an internal cable, to the microprocessor bus. Various instructions are displayed on the screen and the operator responds to the instruction by selecting choices that are offered on the screen.

Response to instructions given on the display or events initiated by the operator is received through switch actuation selected by the operator. The TNC 50 has a set of switches 80 located along each side of the TNC display 78. The switches 80 can be a tricolor type whose function is defined on the display, known as soft-key function switches (soft-keys). As the status of the election changes through the process of conducting the election at the precinct, the definition of what action the soft-key performs when selected changes also. For example, during preelection testing, the soft-keys are defined to relate to preelection testing and for displaying test results. During the time the polls are open, the soft-keys are defined in terms of tablet authorization and displays tablet(s) status. The flexibility is extensive and is well suited to assist the average poll worker in conducting the election. The soft-keys are connected to the microprocessor bus and are controlled, in conjunction with the display 78, by the microprocessor 72.

In addition to the soft-keys, a numeric keypad 82 is employed that accepts input numerical sequences. The numerical sequences may include operator authorization codes, voter codes taken from the registration log (if not using a bar code), and other official acts that may require confidential codes as determined by a jurisdiction. The actual codes for the various uses is set by the EAS 60 at the time the election is prepared so that the codes can be changed between elections.

In compliance with many jurisdictional requirements across the country, the TNC 50 provides a private counter, displaying total number of votes cast at any particular time during the election. The private count can be given on the TNC display 78 for operator reference only or can be maintained internally only, without display. The requirements vary with jurisdiction on what statistics are to be maintained concerning the election equipment. Number of votes, hours of operation, or any other way to breakdown usage may be specified by the election officials at the time the election is being prepared.

The TNC 50, through its control of the election at the precinct, also maintains the voting tablet status, voter eligibility, and authorizes voters. The TNC 50 will initiate functional tests prior to the opening of the polls and will monitor and record the results of the tests. The voting tablet status has four possible states which the TNC 50 monitors and controls. Once the polls are open, the voting tablet 56 can be in one of the following possible states: Available; In Use; Help Requested; or Error Condition. An optional state, selected by a particular jurisdiction, is Time Out, where a voter is taking too much time to complete his vote, a time which is set by the election official at the election headquarters 44. Transition into each of these states is controlled by the TNC 50, with two exceptions. The change from In Use to Available is triggered by the voter pressing a "Cast Ballot" button 84 on the voting tablet 56 and the Error Condition is triggered either by the voting tablet 56 sending a message to the TNC 50 or by the TNC 50 detecting an error. In all other transitions, the election official operating the TNC 50 is required to make a button selection on the TNC control panel to transition a particular voting tablet 56 to another state.

Determination of voter eligibility is accomplished in a couple of ways. Traditional methods include the election officials checking printed voter registration logs provided by the election headquarters, verifying that a particular voter is in the proper precinct and on which choices he is allowed to vote. The TNC display 78 provides the operator with a choice between the various ballot styles that are authorized for that precinct. The election official selects the style which corresponds to a voter's eligibility. Selection of a particular ballot style will enable only those choices on the ballot on which the voter is allowed to vote. The operator selects the ballot style as determined from the voter registration log and then selects the next available voting tablet.

The present invention also offers an automated alternative. The TNC 50 has a RS-232 serial port 86 located on the side of the unit which allows a bar code scanner 88 to be connected. The serial port 86 is part of the microprocessor bus and can service a number of peripheral devices. In this case, the bar code scanner 88 is used to scan a voter registration log which has an associated bar code designation for each voter. The voter bar code indicates the voter's eligibility and the TNC 50 automatically selects the proper ballot style. The election official then assigns an available voting station or booth 52. Furthermore, the scanned information can be compared with internally stored data provided by the MMU 58 to ensure the voter is in the proper location and is eligible to vote. The TNC 50 makes a permanent record of the fact that the voter has voted so that he cannot vote again in that election.

The TNC 50 has an integrated printer 90 that is enclosed by the TNC housing 74 at one end of the device. The printer interface is electrically connected to the TNC data bus controlled by the microprocessor 72. The printer 90 provides printed records for specific events during an election and operates on dual-roll, narrow, carbonless paper. As information is printed on the printer 90, paper from both rolls dispenses simultaneously, one on top of the other. The top copy is white paper and is printed and released through the print mechanism and removed by the election official. The second copy, carbon copy, is rolled onto a take up reel internal to the TNC housing 74. This carbon copy serves as a secure record of what information was delivered to the official and is part of the audit trail of the election. Typical information printed includes precinct results totals, pre-election test results, and zero counts and error messages. User preferences are able to be specified to handle whatever information a jurisdiction may require, hence the ever important flexibility. The printer 90, while enclosed as part of the TNC 50, is actually in a separate compartment at one end of the TNC housing 74. There exists an electrical connector for connecting the printer 90 to the TNC 50 in the separation wall that separates the printer 90 from the main TNC processing section. The back of the TNC housing 74 where the printer 90 is housed has a hinged access panel with locking means that provides for servicing the printer 90. Thus, retrieval and re-stocking of paper rolls and maintenance of printer failures can be accomplished, without providing access to the main processing section.

TNC Power

Power to the TNC 50 is provided either through a conventional AC wall outlet or auxiliary DC input. The wall outlet provides an AC voltage ranging from 90 to 240 VAC. This range covers the standards as they exist around the world, including the United States which has standard 120 VAC. AC power is delivered through an acceptable power cord that is removable from the side of the TNC 50. The power input module includes a male pinned connector using the universal pin configuration for AC power and is also fused. The fuse ratings are set for the TNC power handling capability of 5 amperes. The fuse helps protect the TNC 50 from power spikes and short circuits. The TNC 50 has an internal step down transformer and power regulation and uses an open frame switching power supply commonly available in the electronics industry. The auxiliary DC input can handle DC voltage ranging from 7 to 24 volts, including 12 volts DC from an automotive battery. The auxiliary DC power is received through its own separate input connector and is appropriately connected internal to the TNC 50 as one skilled in the art will recognize.

The TNC 50 provides power distribution to the various functions of the TNC 50 and to the voting tablet. The power to TNC functions is distributed via internal cabling while power to the voting tablet is provided through integration with the CAN communication cable. Incorporating power and data communication onto the same lines is well known as illustrated by an article located on the Internet entitled "A Data Acquisition Node Using CAN with Integrated Power Transmission," by Dr. Lutz Rauchhaupt, Dr. Thomas Schlinder, and Henri Schultze, Otto-von-Guericke-Universit ät Magdeburg Institut für Prozeβmeβtechnik und Elektronik (IPE). Incorporating the data and power transmission together provides for a minimum of cabling and promotes simplicity in set up. The power delivered to the voting tablet need not be regulated power, as the voting tablet has its own power regulation capability. This eliminates the possibility of the delivery of "dirty power" to the components of the voting tablet 56 and accounts for any variation in voltage drop found in the interconnect cable.

The MMU 58 is used to transport data to and from the precinct 48 and acts as a physically separate record of the election on a precinct-by-precinct basis. The TNC microprocessor 72 controls the MMU 58 at the precinct 48 and performs the following operations on it: accepting the MMU 58; locking it in place during the election; providing a read/write capability for downloading information immediately prior to the election; uploading data during the election; closing the election with precinct level results; recording audit data; and executing public encryption algorithms to protect the data contained therein.

Once the MMU 58 is fully inserted into the receiving bay of the TNC 50 it is completely enclosed, similar to a common computer disk. The preferred mechanical connection type is the PCMCIA standard, developed for portable computers. The MMU must be "hot insertable", meaning that it is required to be installed when the mating receptacle has power present on respective connector pins. The requirement arises from the fact the TNC 50 needs to have power applied and operational in order to receive the MMU 58. The TNC 50 physically prevents a dead (no power) insertion for security purposes.

Voting Tablet

Figure 8:
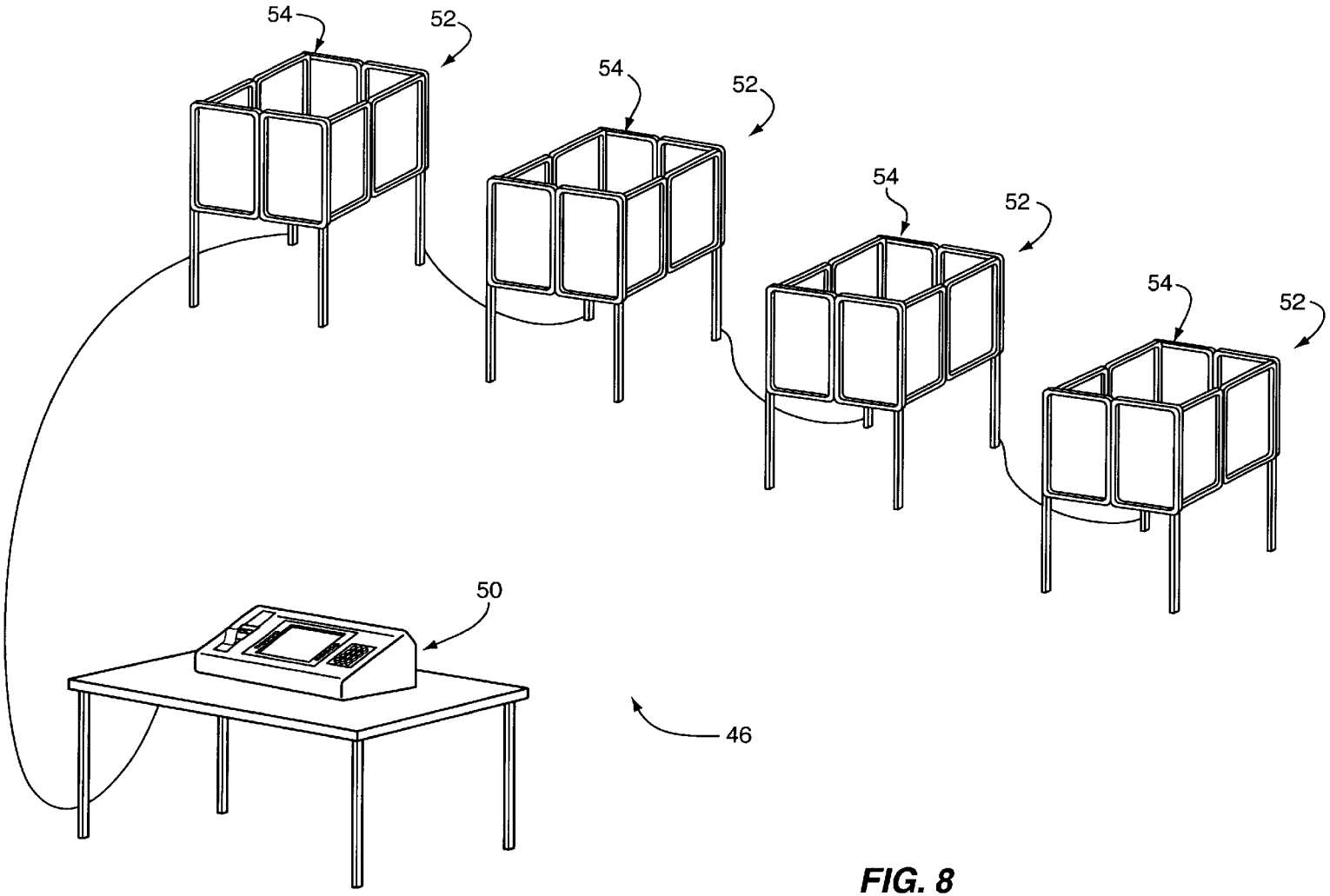
FIG. 8 is a perspective view of some of the components at the precinct as shown in FIG. 4.
Figure 9:
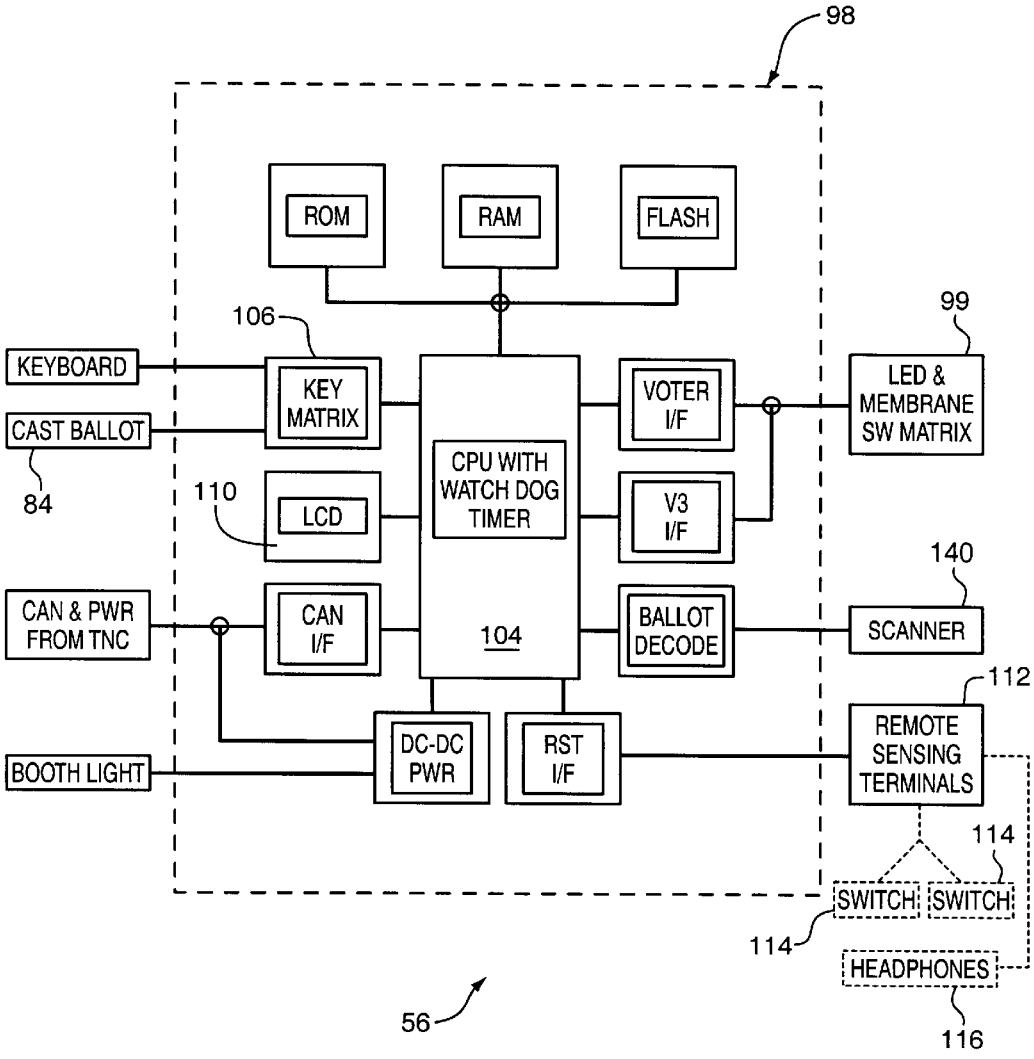
FIG. 9 is a block diagram of the components of the voting tablet of FIG. 4.
Figure 10:
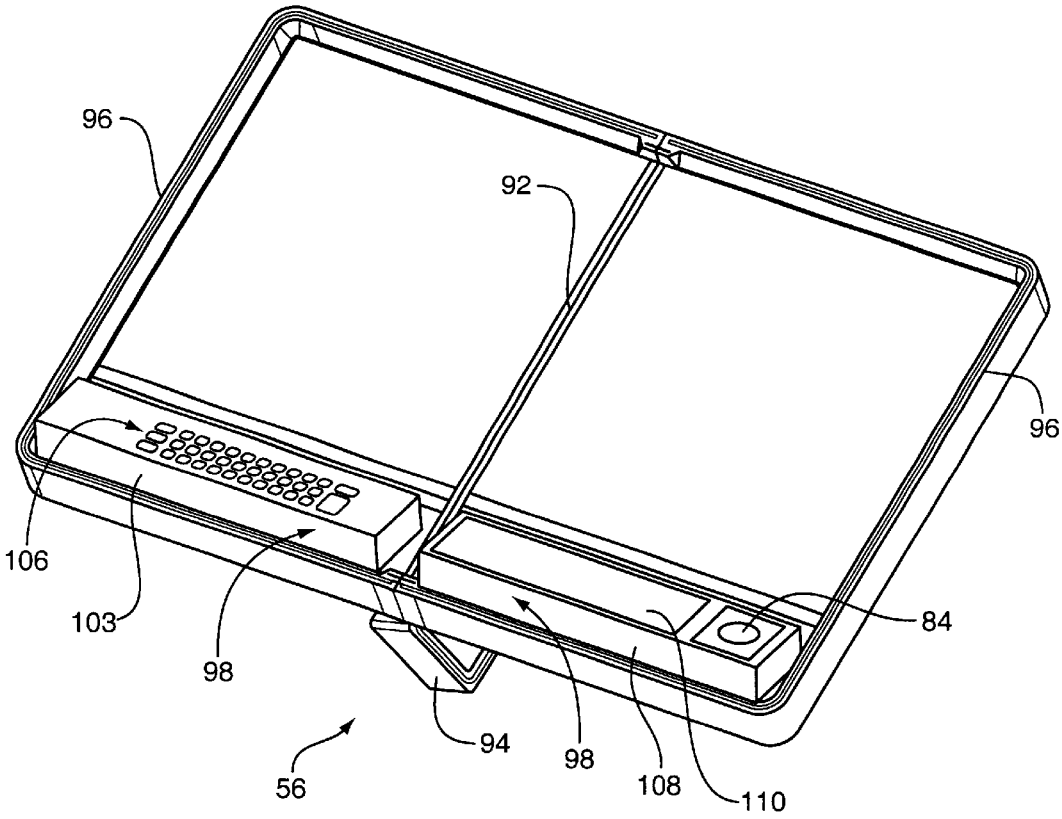
FIG. 10 is a perspective view of the voting tablet of FIG. 9.
Figure 11B:
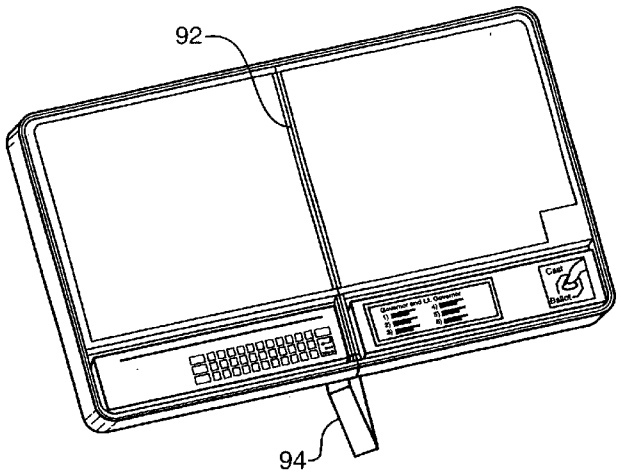
Figure 11D:
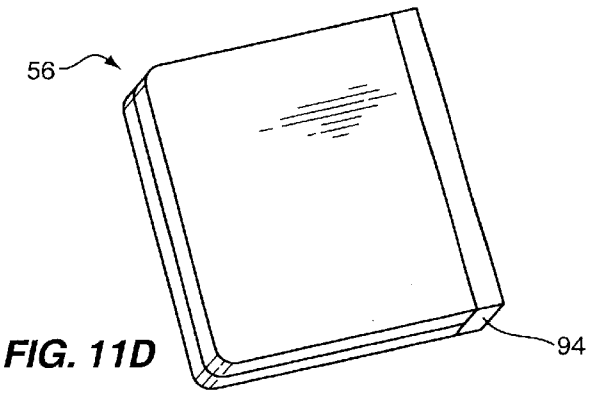
Figure 11A:
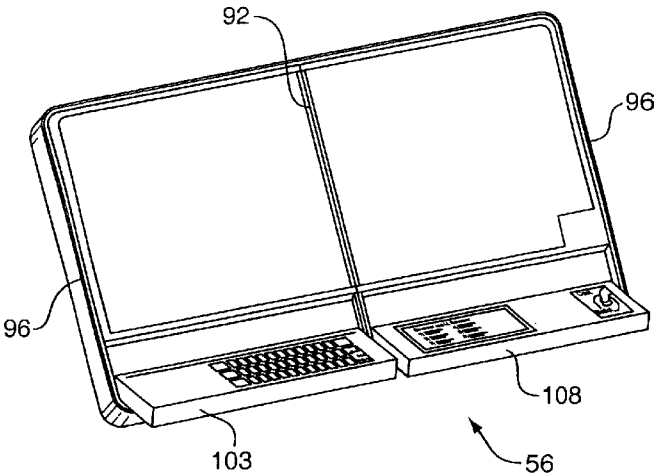
Figure 11C:
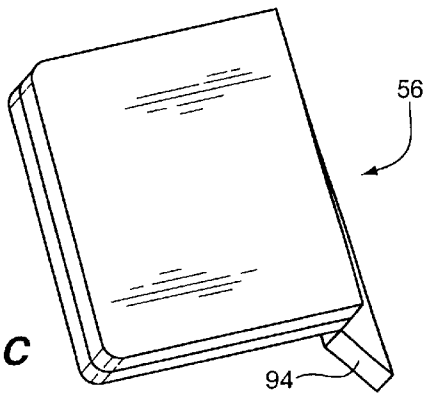
Figure 12:
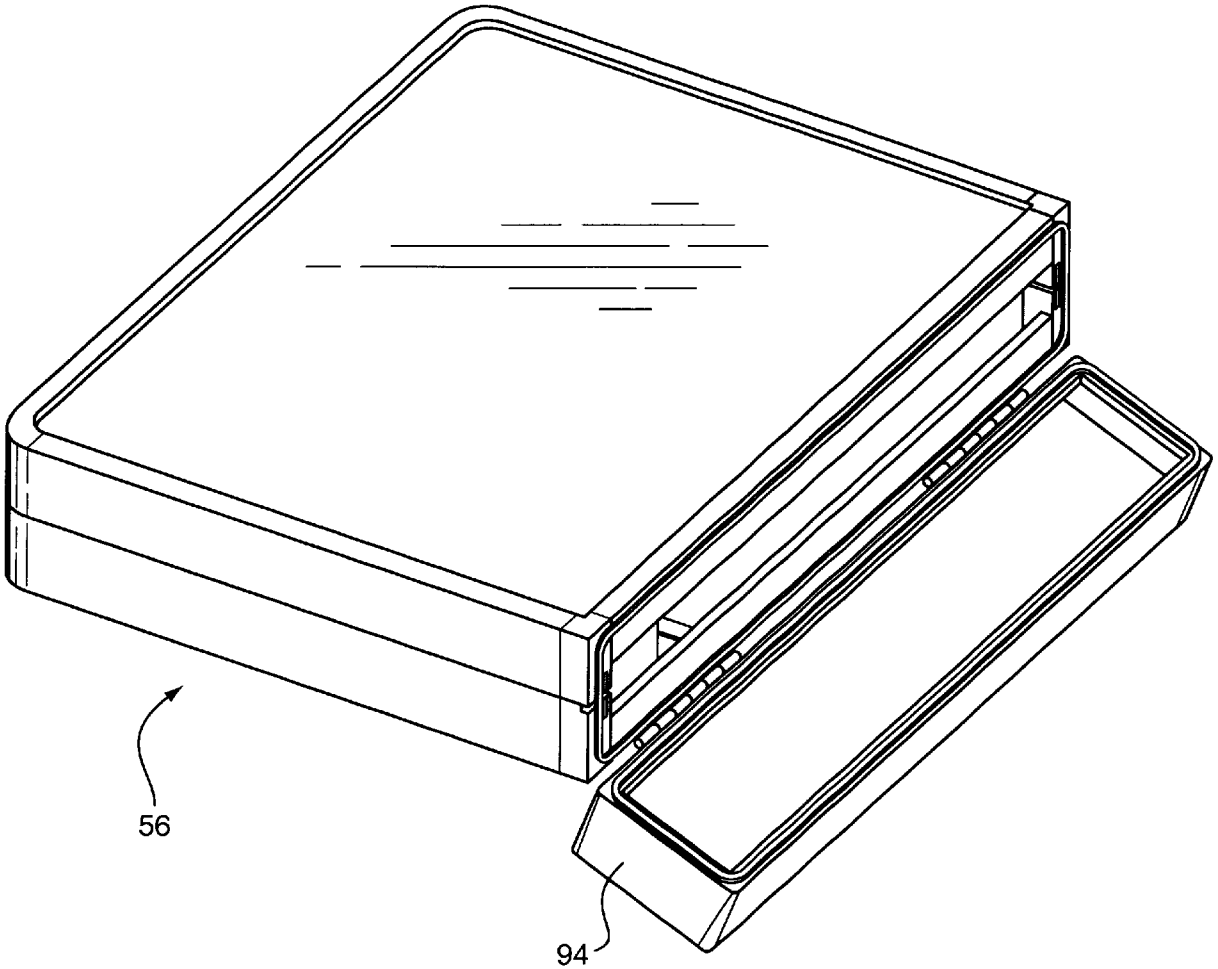
FIG. 12 is a different perspective view of the voting tablet of FIG. 11*c*.

The TNC 50 communicates with a plurality of voting tablets 56 at voting stations 52, as shown in FIGS. 4 and 8. The voting tablet 56 (FIGS. 9–15) is a portable, lightweight unit that when deployed provides an input means for each voter to cast his/her vote. The full text of the ballot is presented on printed material in the form of the ballot overlay 65 which is overlaid on the voting tablet 56.

The voting tablet 56 has a hinge point 92 vertically down the center of the voting tablet 56 so that the voting tablet 56 may be folded into the transportation and storage configuration. Offset from the center hinge area, hinged on the back panel, is a rectangular box or center storage area 94 that runs the length of the voting tablet hinge area. This center storage area 94 is twice as wide as the thickness of the voting tablet 56 and an equal dimension in depth. When in the transportation and storage configuration, the back panels, the edges, and the center storage area 94 of the voting tablet 56 form a protective enclosure. The center storage area 94 serves to seal the center tablet hinge area and provides access for electrical connections to the voting tablet 56 and storage area for cables and the light fixture. There are appropriately placed latches to prevent tampering and a handle for carrying, with the resulting size of the folded tablet 56 ranging from a large briefcase to a small suitcase. Integrated in the voting tablet edge frame is a tongue-and-groove valence 96, or any other popular technique for sealing protective enclosures to prevent damage to the voting tablet 56 by dust contamination, moisture, or other environmental exposure.

When deployed at the precinct 48, the voting tablet 56 is unlocked and opened up so the two halves are coplanar and a locking device is provided to secure the voting tablet 56 in the open configuration. Integrated mounting hardware is provided that mates the privacy enclosure 54 with the voting tablet 56 to secure and lock it in place. The two halves of the voting tablet 56 are electrically connected at the hinge point 92 using flex or conventional cabling. The center storage area 94 hangs from the underside of the voting tablet 56 with the interface cables and light fixture stowed therein. There are two interface connections used to connect the voting tablet 56 to the network of voting tablets 56 and to the TNC 50. Each interface connection can be used to connect to either a TNC 50 or to another voting tablet 56 so that a plurality of tablets 56 can be daisy-chained together and connected at one end to the TNC 50. One connection is a flush-mounted, circular, female connector and the other interface is a twelve to twenty-four foot cable with a circular, male connector, the mating version of the other interface connector. The circular connectors are of the type that have a rotatable collar such that when the connector halves are mated together, rotating the collar locks the two halves in place. The interface connectors and cabling are mounted on a panel in the center storage area 94 that houses a light fixture (not shown). Once-the cables are connected and the light fixture deployed, the center storage area 94 is locked into place so that it is secured against the back panel of the voting tablet 56 to prevent tampering.

Deploying the voting tablet 56 and preparing it for conducting an election includes the following tasks: a voting tablet control bank 98 is unfolded or slid out and locked into position; the voting tablet light fixture is removed and hung on the back panel of the privacy enclosure 54; the interface cable is removed from the center storage area 94 and connected either to another voting tablet 56 or to the TNC 50; the voting tablet 56 is secured to the privacy enclosure 54 using integrated hardware; and the center storage area 94 is locked against the back panel of the voting tablet 56.

An alternative embodiment of the voting tablet (not shown) may include a touch screen, including display technology such as LCD, flat panel, CRT, or any large format group display. These types of displays can be easily incorporated in the same network methods as with the first embodiment described, the difference being in the electronic version of the ballot. To use these display types, instead of the EAS 60 producing a graphical ballot overlay (GBO) 65, ASCII text would be created for the display with switch positions associated with the touch screen switch matrix.

Another alternative embodiment would include a voting tablet that is non-folding with a ridge panel and has a separate storage case. This variation would primarily only impact transportation and storage.

The voting tablet 56 includes of a matrix 99 of LED illuminated membrane switches. 100 (tablet switches). When the ballot overlay 65 is placed on top of the voting tablet 56, graphical marks on the ballot overlay 65 are aligned with a particular set of tablet switches 100. To make a selection, the voter presses the graphical mark corresponding to the selection and the underlying switch 100 is activated. This activates an LED 102 associated with that particular switch 100 which, in turn, back lights the graphical mark selected.

The tablet switches 100 are not regularly spaced, but have gaps in the matrix with some columns and rows completely omitted. An analysis of the probable layout of the ballot types indicate that there are certain columns, rows, and individual switches in the matrix that have a high probability of never being active for an election. Removal of these switches reduces the cost of producing the voting tablet 56 while increasing the mean-time-between-failure (MTBF) of the tablet 56 and maintaining a high degree of flexibility.

The electrical configuration of the voting tablet 56 houses the majority of the electronics in the voting tablet control bank (VTCB) 98. The control bank 98 is electrically connected to the main voting tablet 56 through flex or conventional cabling.

The voting tablet control bank (VTCB) 98 includes two slide-out sections along the bottom part of the voting tablet 56 and the two sections are coincident with their respective halves of the voting tablet 56. The VTCB 98 is hinged along the bottom edge of the voting tablet 56 so that it swings outwardly from the inclined tablet and comes to rest on the bottom of the tablet sidewall. The width of the VTCB 98 can range from two to ten inches depending on the desired control and communication methods therein. The VTCB 98 is split in two pieces to facilitate the folding tablet 56. A first half 103 houses a microprocessor 104, memory, and related circuitry and the interface to the TNC 50 while the upper surface of the first half 103 presented to the voter supports a keyboard 106 for write-in entry. The other half 108 is used for the "Cast Ballot" button 84 and a display 110.

In the present invention, the width of the VTCB 98 is approximately four inches and presents the "Cast Ballot" button 84, the display 110, and the full alphanumeric keyboard 106. The "Cast Ballot" button 84 is well marked and set off by itself and is used by the voter to finalize his vote and have it recorded by the voting system. In addition to the voting tablet 56 going blank when the voter presses the "Cast Ballot" button 84, an audible tone is emitted by the tablet 56 further indicating that the vote has been cast. Prior to pressing the "Cast Ballot" button 84, as the voter makes selections within a contest, the large-format, electronic, flat-panel display 110, or LCD screen, displays the contest in one of a plurality of alternate languages as selected by the TNC 50. The voting tablet display 110 can accommodate an average size initiative or referendum. This allows those measures to be displayed in a language other than that which is printed on the ballot overlay 65. If no foreign language is required or requested, the current active contest is displayed in English. The voting tablet display 110 is also used for the public counters that are tablet specific and appear in the voting tablet display 110. Public counters are required by some jurisdictions and if so, a number is displayed that is identified as the number of voters that have voted on that voting tablet 56 during the present election. Another use for the voting tablet display 110 is to echo voter write-in selections and to provide guidance and help messages should the voter request them.

Many jurisdictions require that write-in selections be offered for all candidate races. To enter a write-in vote, the voter selects the write-in option within a particular race. The display 110 flashes a message that may read "enter write-in vote" or the like and the voter can use the keyboard 106 to enter the name of the write-in candidate. When the voter selects the first character, the display 110 is updated to read "Press enter when done or resume voting" and the first selected character is also displayed. With each keystroke, the display 110 is updated until the voter is finished and either presses the enter key on the keyboard 106 or makes another selection on the ballot. In each case, the candidate written in for that race is stored in temporary memory with the other selections the voter has made. The voter is still free to change his/her selection even though a write-in has been entered for that race. Should the voter re-activate the write-in switch in a race where a candidate has been entered, the display 110 will show the name of the written-in candidate. The voter can erase the current name and enter a new one or select a registered candidate for that race that will erase the previously written-in candidate.

The VTCB 98 has an electronic connector located at the front corner that allows an external device to be connected, upon request or as a standard feature, to provide input access for disabled voters, through a remote selection terminal (RST) 112. When the RST 112 is plugged in, activation of contest switches can be accomplished remotely through various means that will enable persons with disabilities to vote unassisted. When the RST 112 is connected to the voting tablet control bank, contest lights start automatically sequencing through each race on the ballot and when a light is active and the voter desires that selection, the RST 112 receives a stimulus from the voter and the selection is made. The sequencing would continue until all selections have been made with a second input from the RST 112 casting the ballot. The RST 112 can employ any of several means for sensing a stimulus from the disabled voter including a finger-operated switch, a foot-operated switch, a head-operated switch, or a breath-operated switch, or other known means for receiving inputs from disabled persons.

While other switch types as mentioned above can be used in the RST 112, a popular switch known as a "jelly switch" 114 is the preferred switch type. Jelly switches 114 are typically round, three to six inches in diameter and one-half to two inches thick. By pressing anywhere on the large target top surface, the switch 114 is activated. Electrically, the switch 114 is a simple momentary contact ideally suited for the scanning routine of the voting tablet 56. The jelly switch 114 comes standard with a ⅛" monaural phono jack which presents two contacts on the phono jack.

The-preferred embodiment of the present invention uses two jelly switches 114in the RST 112, one for making selections and the other for casting the ballot. The two switches 114 are plugged into an adapter cable that accepts two ⅛" monaural phono jacks at one end and converts the four contacts into three with the other end of the cable terminating at a ⅛" male stereo phono jack. The cable combines two contacts into a common ground for the two switches 114. The ⅛" male stereo phono jack of the adapter cable is then plugged into the VTCB 98 which has the female mating half. The contacts of the VTCB ⅛" female stereo phono jack serve two purposes. The first, is to sense that a switch set has been inserted in to the female stereo phono jack and the second is to sense switch activations by the jelly switches 114. A simple grounding technique accomplishes the insert sense whereby when the jack is inserted, the jack completes a circuit path to ground which can be digital sensed by interface electronics. This technique does not interfere with sense activation and the switches then perform normally by completing a current path when activated.

Jelly switches 114, such as one manufactured by TASH Inc., of Ajax, Ontario, Canada, under model name "Button Buddy" and the adapter cables, model number 4342, also manufactured by TASH Inc., are readily available on the commercial market.

To further support access to persons with disabilities, the present invention accommodates blind persons. Next to the jelly switch jack is a headphone jack where common monaural headphones 116 are plugged into the VTCB 98 through the RST 112. A text-to-speech converter transforms the text echo on the LCD screen 10 of the voting tablet 56 to speech for the headphones 116, with a D/A converter or a pulse width modulator. The audio output operates on the same scanning algorithm as previously described and simply adds the text-to-speech converter output. The conversion from text-to-speech is a well developed technology with several commercial sources for such products, such as the one manufactured by Dialogic Corporation, of Parsippany, N.J., under product name "TextTalk"™. The software routine has access to the text that is displayed on the Voting Tablet LCD and uses this information to convert the text into comprehensible speech. The converted signal is delivered to the headphone jack, and then on to the ear piece(s) of the headphones. Plugging the headphones 116 into the female stereo phono jack activates the text-to-speech function and the jelly switches 114 activate the scanning routine. The jelly switches 114 have Braille labels applied to the top surface that identify the function of the switches. As the scanning routine illuminates a selection within a race, the text-to-speech converter supplies the audio equivalent through the headphones 116. Selections are made by activating the proper jelly switch 114 until all selections have been made. Casting the ballot can occur any time by activating the cast ballot jelly switch.

Figure 30:
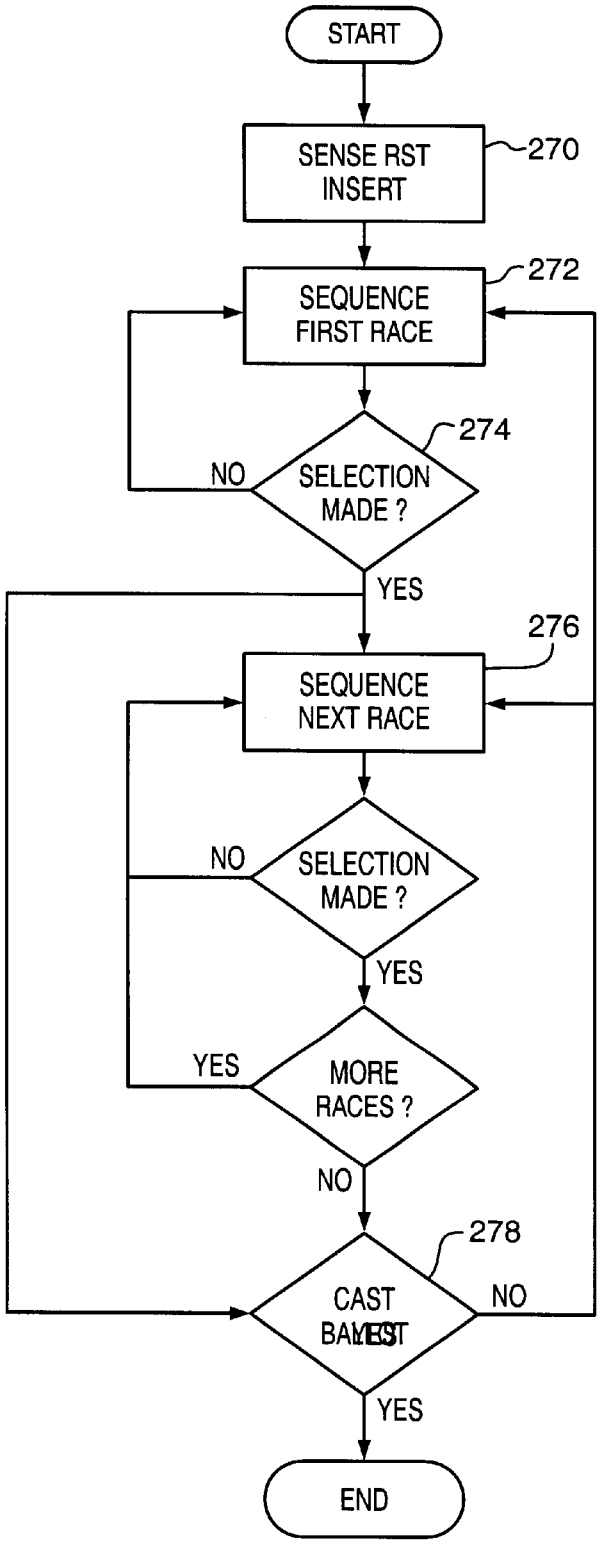
FIG. 30 is a flow chart of the process flow performed when a voter utilizes a Remote Sensing Terminal of the system of FIG. 1.

The process by which the RST 112 works together with the voting tablet 56 to scan through the ballot will now be described, with reference to FIG. 30 (with reference numbers for the process steps in parentheses). The RST scanning routine starts with the microprocessor 104 polling the RST sense logic circuit as part of its polling of the voting tablet switch matrix 99, after the voting tablet 56 is armed for voting. It continues polling until either it senses (270) the insertion of the switch 114 into the RST 112 or a switch actuation on the voting tablet 56. If a voting tablet switch actuation is detected first, then the RST sense circuit is no longer polled and voting continues from the voting tablet 56. If the microprocessor 104 detects a switch insertion into the RST 112, the scanning routine begins sequencing (272) the first race on the voting tablet 56. Sequencing a race involves illuminating the first selection within the race, and momentarily pausing long enough for the voter to actuate the jelly switch 114. After the pause, if no jelly switch actuation is sensed (274), the next selection within the race is illuminated (272) followed by a pause. This continues until all selections have been illuminated. If all selections have been illuminated and no selection sensed, the sequencing starts back with the first selection. This pattern repeats for three to five cycles and if no selection is made during that time, the routine moves the sequencing to the next race.(276). This is a "time-out" condition which allows the voter to exit that particular race without making a selection.

If at any time during the sequencing of a race a jelly switch actuation is detected, the sequencing routine lights the currently illuminated selection solidly and moves to the next race and begins the selection sequencing (276). As the next race is sequencing, the voter is able to visually verify their selection in the previous race. This process continues until all races have been sequenced, or the cast ballot, switch is actuated (278). Once the cast ballot switch is actuated, the selections made up to that point become the voter's ballot image and any races where no selection has been made become a "no vote".

Once all races have been sequenced and the cast ballot switch has not been actuated, the scanning routine returns to the first race and continues sequencing (272). If a selection had been previously made for a race, as visually indicated by the solidly-lit LED, that LED remains illuminated indicating its selection but the other selections continue to be sequenced giving the voter an opportunity to change their vote.

The voter is able to scroll through the races by actuating the jelly switch 114 and holding it down. The sense circuit acknowledges the difference been a momentary actuation and a continuous actuation and sequences at a similar pace through the races, illuminating the race lights indicating the active race.

This same sequencing process is used if the sense circuit detects headphones 116. When a selection within a race is illuminated, the text-to-speech converter output the audio equivalent of the selection.

Visual Vote Verification ($V^3$)™

The present invention provides for an independent means of producing and recording the ballot image. A proposed means for producing the independent ballot image is accomplished by monitoring the current or voltage to the LED 102 associated with each switch 100 on the voting tablet membrane switch matrix 99. The voting tablet 56 acknowledges the switch activation by issuing a command that turns on the corresponding switch LED 102, indicating to the voter that the selection has been made. Monitoring the current or voltage supplied to the LED 102 can be accomplished through several different approaches, three of which are described below.

Figure 16:
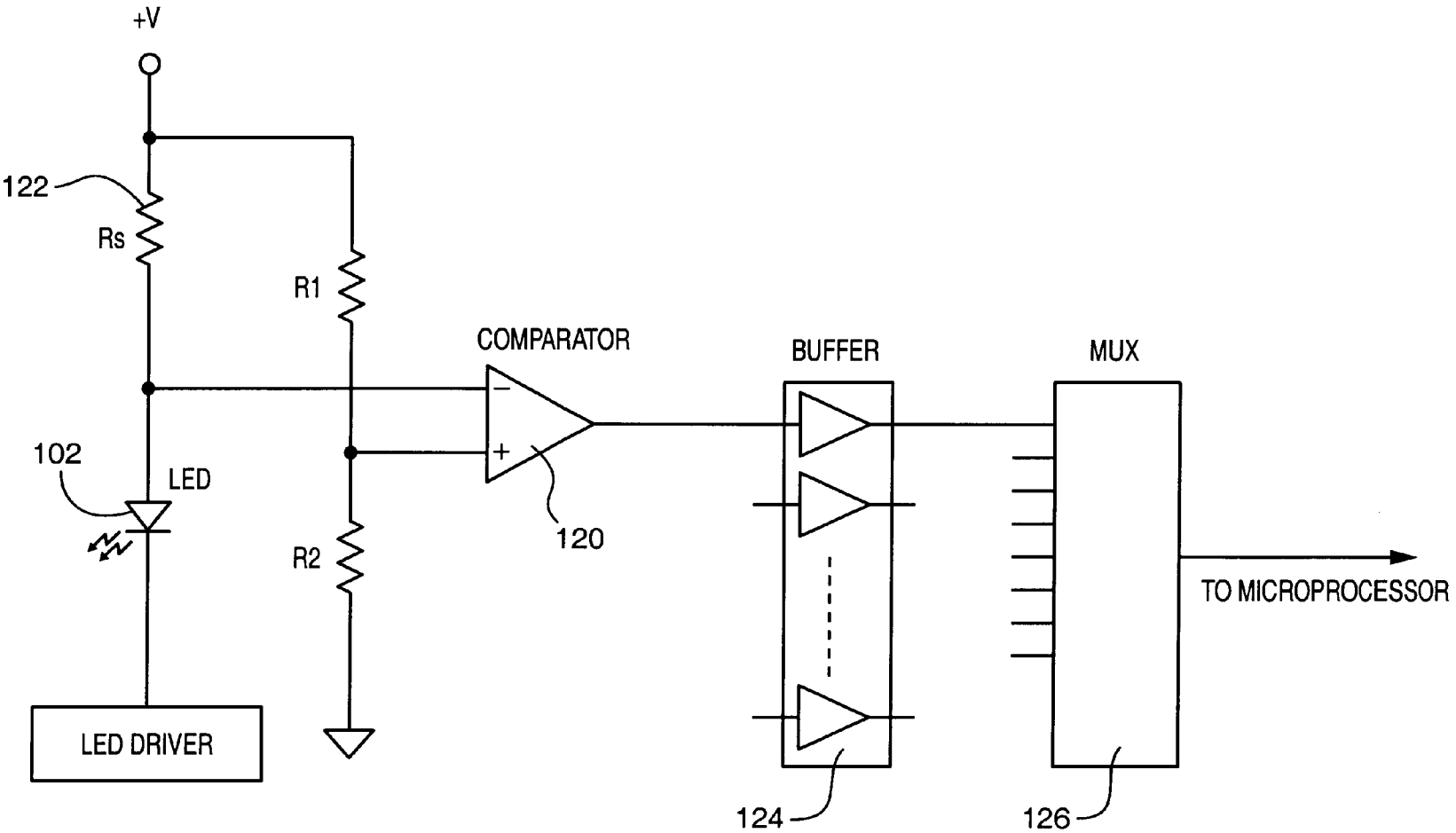
FIG. 16 is a schematic of a visual vote verification circuit contained in the voting tablet.

The first approach, shown in FIG. 16, uses a common integrated circuit (IC), known as a comparator 120. The comparator 120 determines if the LED 102 is off or on by measuring the voltage on one side of a current sense resistor 122 and comparing it to a fixed reference voltage. The sense resistor 122 is connected in series between the LED driver and the LED 102. One side of the sense resistor 122 is also connected to the negative input of the comparator 120. The positive input of the comparator 120 is connected to the mid-point of a voltage divider network made with two resistors connected in series. The voltage at the mid-point of the divider network is determined by the value of the two resistors. In a possible embodiment, the positive input of the comparator 120 is set to 0.9 of the supply voltage.

In operation, if the LED 102 is off, no current flows through the sense resistor 122 and the negative input of the comparator 120 is equal to the supply voltage and the output of the comparator 120 is a logic zero. When the LED 102 is turned on, current flows through the sense resistor 122. The sense resistor 122 is selected so that the amount of current that flows through it when the LED 102 is on multiplied by its resistance is less than 0.9 of the supply voltage. For example, if the current through the LED 102 is 10 mA and the supply voltage is 5 Volts, the sense resistor 122 could be selected to be 400 ohms. In this example, the negative input of the comparator 120 would be 4 Volts when the LED 102 is on. The output of the comparator 120 would then be a logic one. This circuit can thus detect an open circuit LED 102 or LED driver. If either of these conditions exist, no current will flow through the LED 102 when the microprocessor 104 has commanded it to be on. The comparator 120 will be logic zero and thus the microprocessor 104 could sense this failure. This circuit will also detect a shorted LED driver. If the driver is shorted, current will always flow through the LED 102. If the microprocessor 104 commands the LED 102 to be off, current would be flowing through the LED 102. The output of the comparator 120 will be a logic one and thus the microprocessor 104 could sense this failure.

The logic state of the comparator 120 is then communicated to the microprocessor 104 through a series of multiplexors and buffers to be analyzed. The output of the comparator 120 is wired to a buffer IC 124 with output control. The outputs of the buffer 124 are then fed to a multiplexor IC 126 with output select. The output of the multiplexor(s) 126 is then connected to an appropriate input of the microprocessor 104. The output control and output select lines of the buffers 124 and multiplexors 126, respectively, are under microprocessor control so that any one of the LEDs 102 can be monitored at any given time.

The output control of the buffer 124, plus the output select of the multiplexors 126, allows each LED 102 in the membrane switch matrix 99 to have its own specific address with an associated LED position in the matrix 99. Therefore, the microprocessor 104 loads the address bus with the address of a specific LED 102, which in turn, configures the buffers 124 and multiplexors 126 to pass the results of the corresponding LED comparator 120 to the microprocessor 104. A simple software routine that utilizes the list of LED addresses can quickly accumulate the state of the comparators 120. Once the state of the comparators 120 is known, the ballot image can be constructed using the LED position information.

Figure 17:
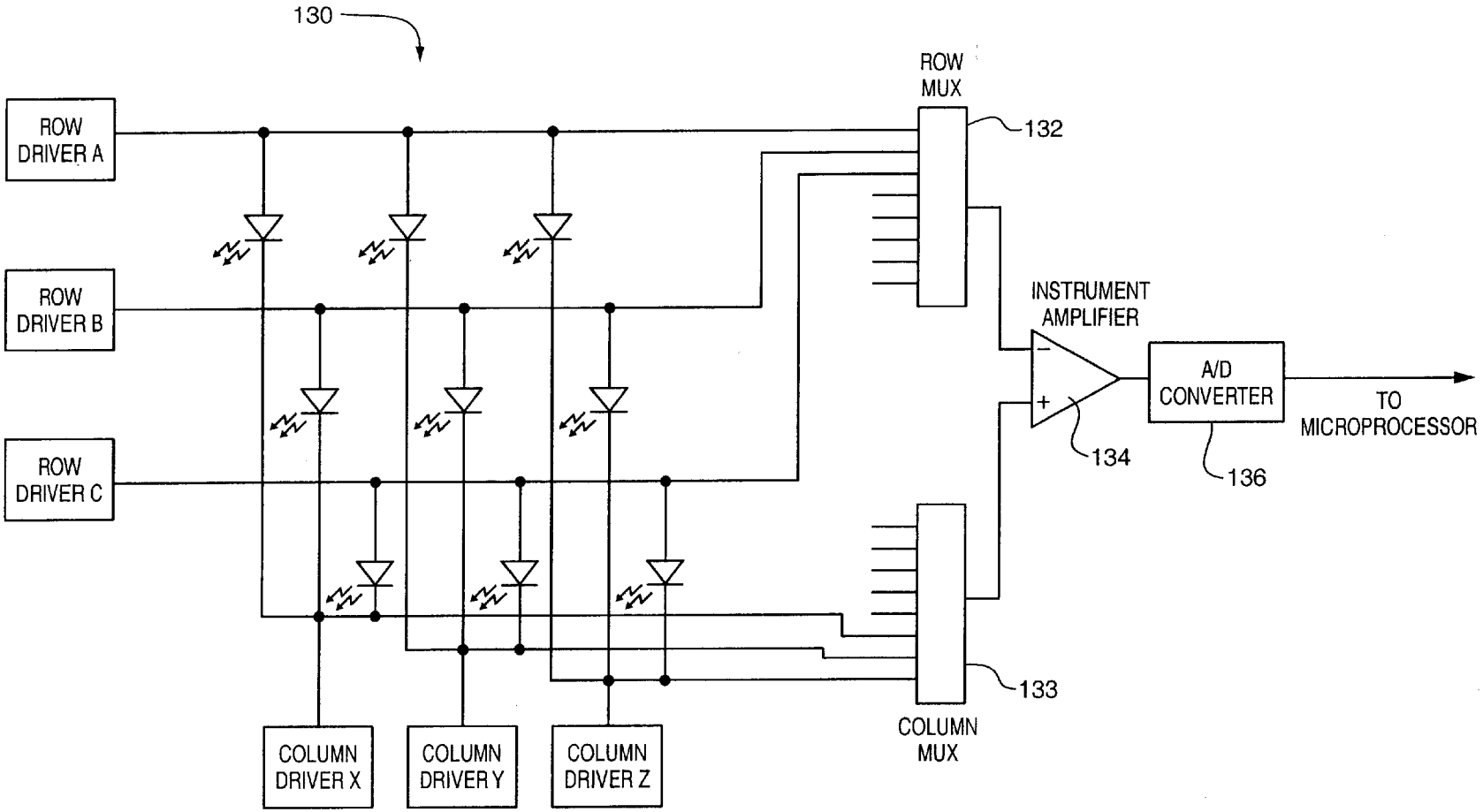
FIG. 17 is a schematic of an alternative visual vote verification circuit contained in the voting tablet.

A second method for providing a separate recording of the cast ballot is implemented using a multiplexed LED array, as shown in FIG. 17. A multiplexed LED array or matrix 130 includes a matrix of LEDs that have their anodes wired together, forming a "row," and the LED cathodes wired together, forming "columns." Connected to each row and column are driver ICs. Row and column drivers are on at different points in time and determine which LEDs are illuminated. When an LED is commanded to be on, the row driver and column driver are activated that are connected to the anode and cathode respectively, of the LED that is to be turned on. The LED does not have to be driven 100% of the time for it to appear to be on, for the human eye. This allows the driver ICs to share time when they are driving so that the whole matrix 130 of LEDs may be serviced. A service cycle is determined by the clock rate supplied to the driver ICs and during one time period, each row and column driver pair is activated once so that the LEDs that are supposed to be on are pulsed. This is a common technique used for 7-segment LCD displays, commercially available from a variety of sources.

With the LEDs connected in this manner for turning them on and off, each row and column are further connected to analog row and column multiplexors 132 and 133. The outputs of the row and column multiplexors 132 and 133 are connected to the input of a common instrumentation amplifier IC 134. The row signal is connected to the positive input of the amplifier 134 and the column signal is connected to the negative input. The output of the amplifier 134 is the difference in voltage of input column and row signals. The output of the amplifier is then digitized by an analog to digital converter (AID) 136 and the results can be read by the microprocessor 104.

As the LED array 130 goes through a service cycle, the analog multiplexors 132 and 133 are set to pass through the desired column and row signals. The microprocessor 104 is interrupted at the appropriate time to sample a selected LED voltage using the A/D 136. The voltage is read into the microprocessor 104 and analyzed. Microprocessor code sets a predetermined range for the LED voltage and analyzes the voltage with respect to the range. If the voltage falls within the predetermined range, the LED drivers are on. An example range would be 1.5V to 3.2V. If the voltage is outside this range, the microprocessor 104 could determine that a failure exists.

The failures this circuit can detect include: an open LED; a shorted LED; and a shorted row or column driver. A resistor can be added across the inputs of the instrumentation amplifier to reduce errors from leakage currents in the drivers. This configuration would also allow the microprocessor 104 to determine if a column or row driver failed in an open condition.

A third method (not shown) for providing a separate recording of the cast ballot is to use an emitter/detector pair instead of an LED. In this instance, when the emitter (synonymous with the LED above) is activated, the detector portion of the emitter/detector pair senses the emitter is active by detecting radiated light reflecting off the back of the ballot overlay surface. Emitter/detector pair technology is advanced enough to the point at which, given the geometry of the placement of emitter/detector pairs, adjacent pairs will not erroneously detect the wrong emitter of the voting tablet 56. To overcome ambient light conditions, the emitter is pulsed and the ambient light signal is electronically filtered out. This monitoring method requires processing of analog signals into a digital format and adds a great deal of microprocessor overhead.

Employing one of these three methods in the voting tablet 56 further provides a means to functionally test each voting tablet 56 while it remains stored in a warehouse between elections. Voting systems to date are required to be set up to have their functionality tested. The present invention can be left in its transport configuration and the electronics tested with verification that all the vote selection lights (LEDs or emitter/detector pairs) illuminate. This eliminates the logistical requirement of setting up the system for testing, saving jurisdictions considerable time and money when performing quarterly or pre-election tests of the type used to verify equipment performance.

The Intelligent Ballot

The voting tablet 56 has means to read a machine readable code printed on the ballot overlay 65 when the ballot is installed in the tablet 56. The machine readable code can be either a conventional bar-code or a two-dimensional (2-D) symbology that has one hundred times more information carrying capability. Bar codes and 2-D symbologies provide information through the use of coded symbols that contain light and dark areas (typically black and white). When code scanners "read" the symbols, they are able to distinguish the light and dark areas and transmit this to decoder circuitry that extracts the information contained in the symbol. There are many published bar-code standards and the codes vary in the manner which the light and dark areas are printed. Symbol "readers", or scanners, are typically laser-based or utilize charge-coupled devices (CCDs) to read the symbol. The 2-D code is called a portable data file (PDF) and functions as a high-density, high-capacity printed data file that is accurately read by compact CCD imagers. One standard symbology protocol is PDF417 which is supported as an industry standard. The current data capacity of a PDF417 symbol is approximately 1.1 kilobytes and is expected to increase. PDF symbology is essentially a paper-based computer memory that can be written once and read many times (a paper-based WORM). The printed symbols are encrypted so that security is maintained. Data can be retrieved even with fifty percent of the symbol damaged and uses self-verifying algorithms to maintain data integrity.

Figure 13:
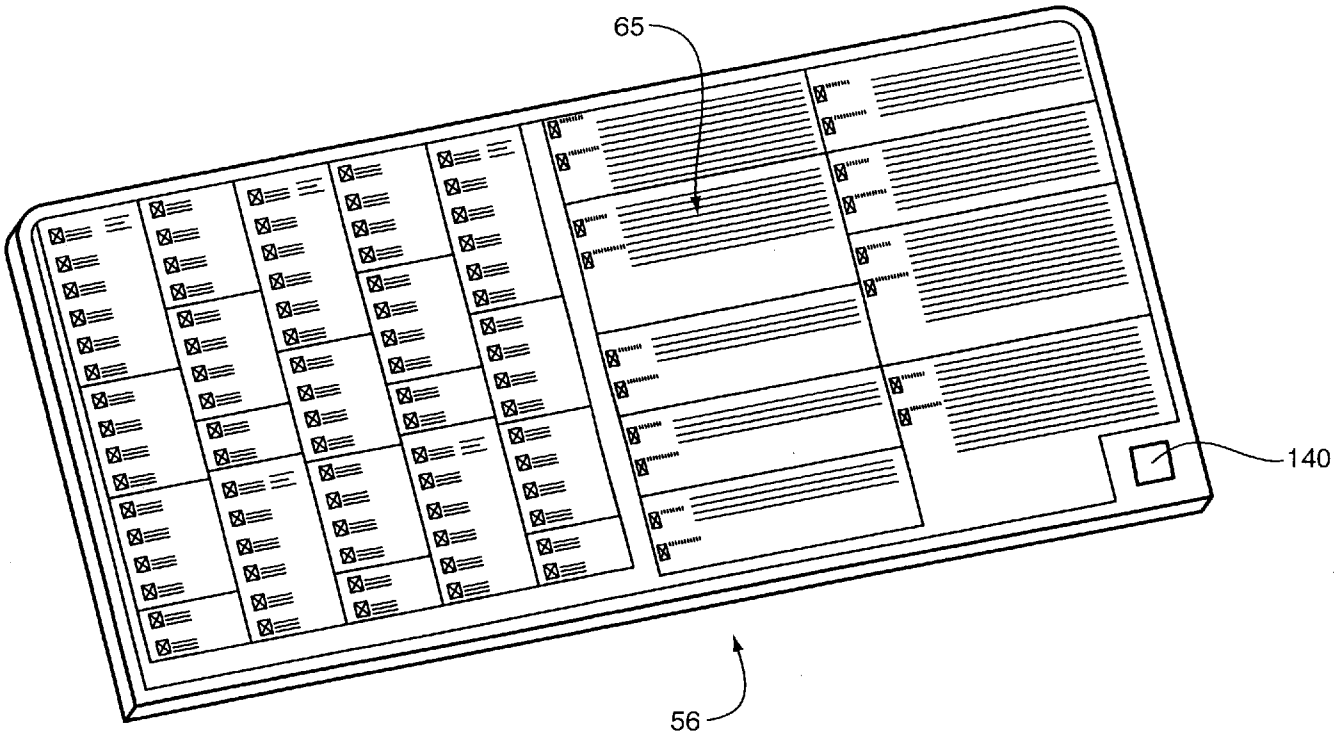
FIG. 13 is a perspective view of the underside of the voting tablet showing the positioning of a scanner module.
Figure 14:
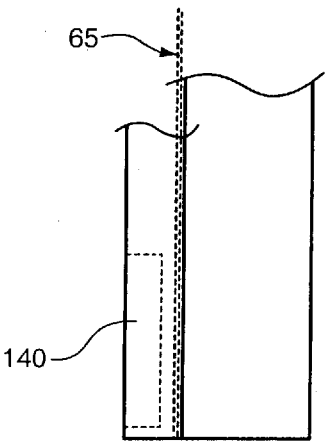
FIG. 14 is a side view of the voting tablet of FIG. 13 showing the positioning of the scanner module.
Figure 15:
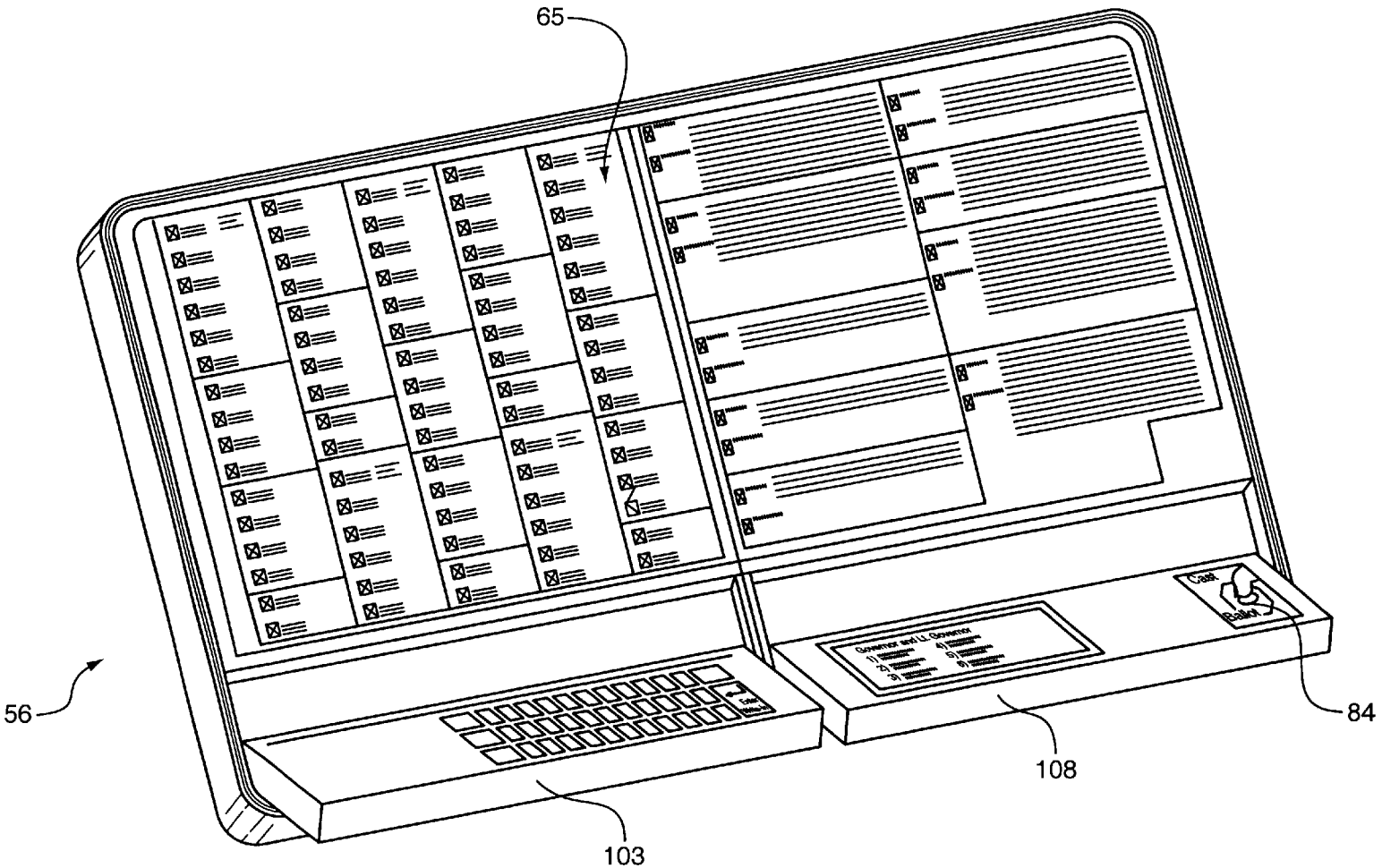
FIG. 15 is a perspective view of the voting tablet of FIG. 10 with a graphical ballot overlay in place.

The present invention utilizes a machine readable code that is printed on the graphical ballot overlay 65 and is read by the voting tablet 56. The preferred embodiment employs a CCD 140 (or a bar code scanner) that is integrated in the frame of the voting tablet 56 and is located in the lower right corner thereof, as shown in FIGS. 13 and 14. The CCD or scanner 140 extends from the lower right corner approximately 2½" up the side and ½" along the base. The height of the CCD 140 is the same height of the voting tablet frame so that the CCD 140 does not protrude above the edge of the frame. The CCD housing is raised a maximum of ¼" off the surface of the voting tablet 56 providing clearance so that the graphical ballot overlay (GBO) 65 can slide underneath the CCD 140. The machine readable code is printed on the ballot overlay 65 so that when the ballot overlay 65 is slid under the CCD 140, the ballot butts up against the sides of the voting tablet to position the code properly under the CCD 140.

In the preferred embodiment, the CCD 140 integrated in the voting tablet 56 uses a CCD scan module, such as manufactured by ID Technologies, as model number WCR7400-401 (or a bar code module as manufactured by PSC Inc., as model number DI-1000GP). The CCD module is mounted in the housing provided by the voting tablet frame and the scanning element faces downward toward the surface of the tablet 56. Electronic cabling routes into the body of the voting tablet 56 and combines with other cabling and continues to the voting tablet control bank (VTCB) 98. The CCD module cable connects to the circuit board in the VTCB 98 where the signals transmitted from the CCD module are routed to a decoder IC. The decoder IC transforms the signals from the CCD module or bar code scanner into digital information (if not already) which are made available to the data bus in the VTCB 98. Since the scanning and decoding rates are relatively low for the technology, decoding of the scanned images can be performed in software rather than by a dedicated IC. At this point, the symbol information is just a data word and remains to decrypted or interpreted which occurs under TNC control.

Implementing this aspect in the present invention begins during the ballot preparation stage of the election when the graphic output files are produced. Along with the electronic version, the EAS 60 generates an encrypted PDF or a proprietary bar code symbol. The symbol is created simultaneous to the electronic version and is imbedded in the graphic output file. When the graphic output file is printed on the ballot overlay 65, the symbol is also printed, located in position to be read by the voting tablet CCD 140 (or bar code scanner). The symbol can be printed back of the ballot overlay 65 which would require the CCD 140 to be mounted in the body of the tablet 56 rather than suspended over it. The preferred method is for the code to appear on the same side as the ballot graphics to avoid double-sided printing. When the GBO 65 is installed in the voting tablet 56, the symbol is aligned with the read window of the scanner 140. Scanner technology is such that with the symbol stationary, the scanning mechanism optically reads the symbol when triggered by the TNC firmware, reading the data contained therein. Once the symbol is decoded, the voting tablet 56 then transmits the data word to the TINC 50.

When using the 2-D symbology, the TNC 50 decodes the encrypted data word using data from the symbol data word and a pre-programmed algorithm contained in the TNC 50. Once the GBO 65 is verified as authentic from the decoded data, the TNC 50 loads the electronic version of the ballot extracted from the 2-D symbol data. The 2-D symbol contains all information necessary to electronically configure the voting tablet 56. Use of the 2-D code eliminates the need to pre-program the MMU 58 prior to the election, greatly simplifying pre-election preparation. However, the imaging electronics required for 2-D codes are much more expensive and may not be cost effective given current voting system economics. With bar code imaging instead of 2-D codes, the information stored in the MMU 58 contains a record of all possible ballot types, one of which is pointed to by the particular bar code.

Bar code imaging is currently more cost effective and also provides significant advantage in voting systems. When using a bar code printed on the GBO 65, the data is transmitted to the TNC 50 where it interprets the proprietary code. The proprietary code is a non-standard symbology which can not be read by off-the-shelf bar code readers commonly available in the market. The proprietary code requires a custom algorithm that is embedded in the decode IC, or software algorithm, that converts the scanner element information into digital data. Without the algorithm, the scanner element information can not be converted. Given proper conversion and transmission to the TNC 50, the data is interpreted and becomes a "pointer" to data contained in the MMU 58. The MMU 58 contains the electronic version of all the possible graphical ballot overlays (ballot types) that are allowed in the election. Each ballot type is identified by valid bar code data. The valid bar code as generated by reading the code from the ballot then points to the valid ballot type stored in the MMU 58. If no match occurs, the code is read from the voting tablet 56 again and if still no match occurs, an error message is displayed on the TNC display 78 and the operation ceases until the problem is corrected. When the bar code read from the voting tablet matches a ballot type stored in the MMU 58, the TNC 50 loads the electronic version of the ballot into the TNC FLASH. One advantage of using the bar coded graphical ballot overlay 65 is that it eliminates the requirement to pre-program a specific MMU 58 for a specific ballot, making all equipment used in conducting an election generic.

Precinct Network

The communication interface between the voting tablet 56 and the TNC 50 uses either a cable or wireless link. The power is either supplied by a permanently attached cable, or may be supplied locally in a distributed fashion. The CAN protocol supports integrated power transmission with data. Power to the voting tablet 56 is delivered unregulated and is then regulated by the voting tablet and distributed throughout the device.

This allows the cable from one voting tablet 56 to be connected to the next voting tablet 56 in the precinct with the end voting tablet 56 either connected to the TNC 50 or, fitted with a power conversion adapter and connected to a wall socket for power, Further, the voting tablets 56 may receive power from a portable power source, such as a battery or portable generator. When the communication interface is by direct electrical connection to the TNC 50, the wireless communication means is disabled by the TNC 50. Should the voting tablet 56 not receive a voting tablet cable connection, but receives power, the voting tablet 56 expects to receive a wireless communication. The TNC 50 transmits a coded wireless message to the voting tablet 56 to set it up for the wireless mode. All subsequent communications occur via wireless transmission.

The voting tablets 56 remain networked to receive power, at a minimum, except in the case of certain distributed portable power sources. The advantage of providing wireless means for data communication is found in the fact that when the equipment is set up in the precinct, the TNC 50 and administration functions of the election are physically separated from the voting area. The wireless configuration may eliminate the requirement of routing a cable on the floor through high traffic areas which can create a hazard to both the voters and to the electrical interface between the TNC 50 and voting tablet 56.

Privacy Enclosure

Figure 18:
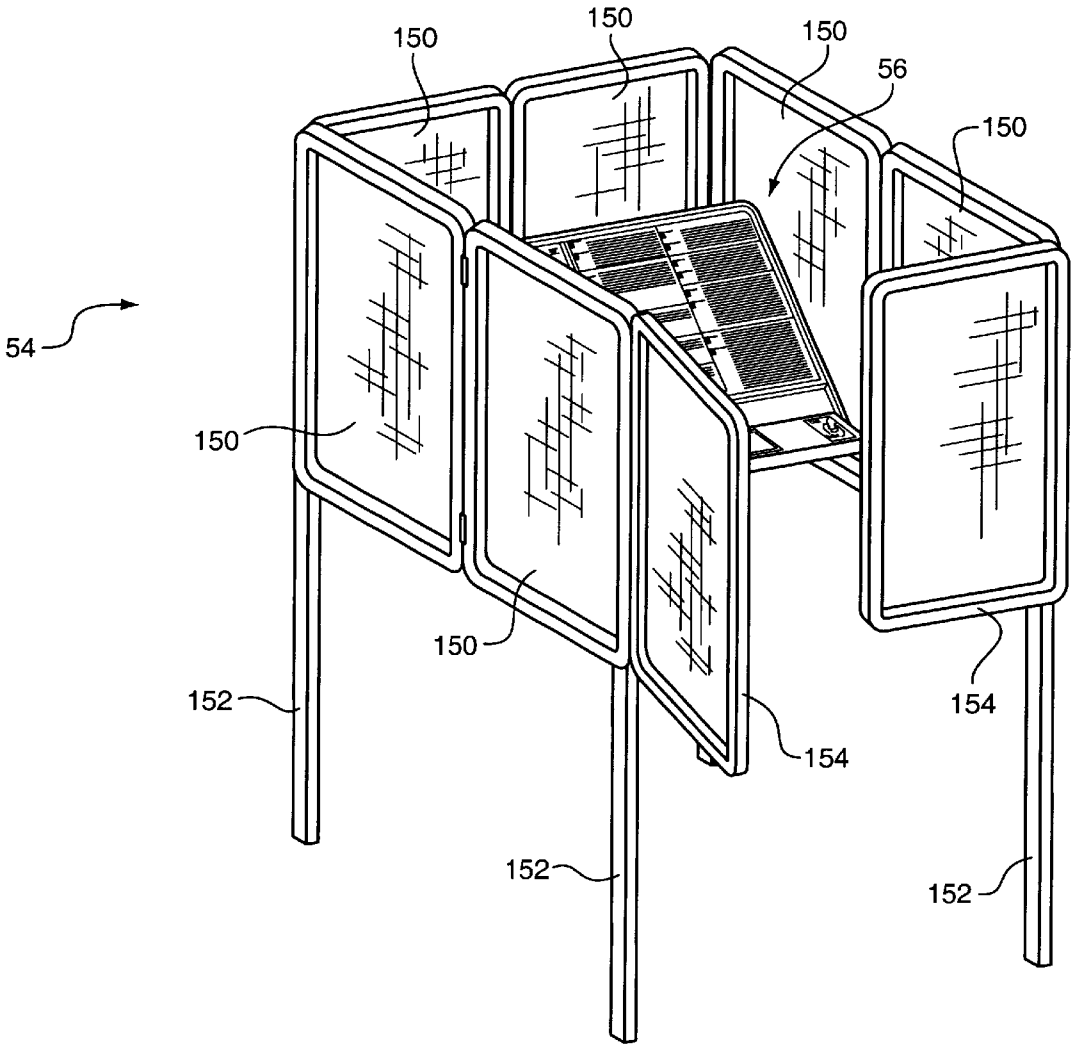
FIG. 18 is a perspective view of a privacy enclosure of the precinct equipment shown in FIG. 8.
Figure 19B:
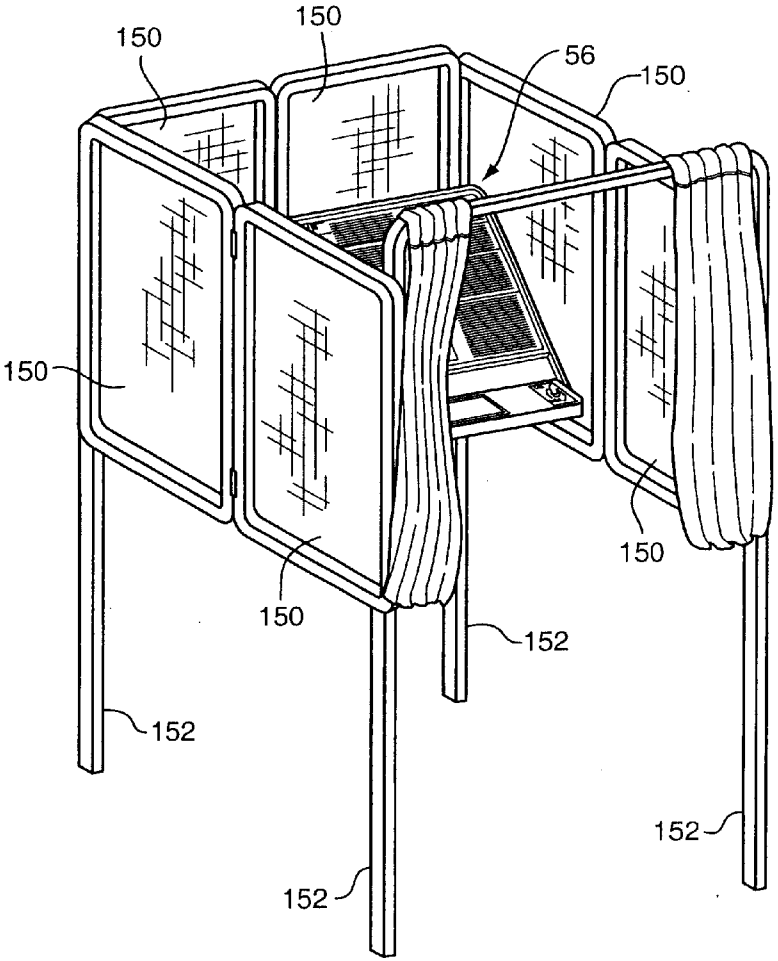
FIGS. 19*a* and 19*b* are perspective views of a privacy enclosure of the precinct equipment shown in FIG. 8, showing curtains in a closed position and an open position.
Figure 19A:
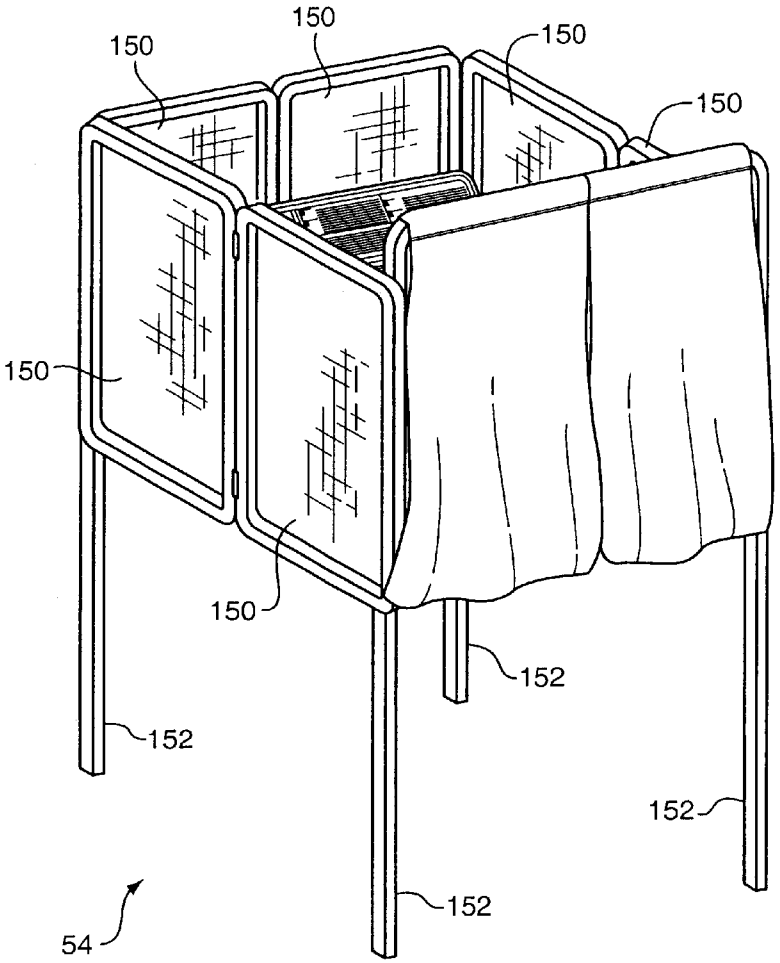
Figure 21A:
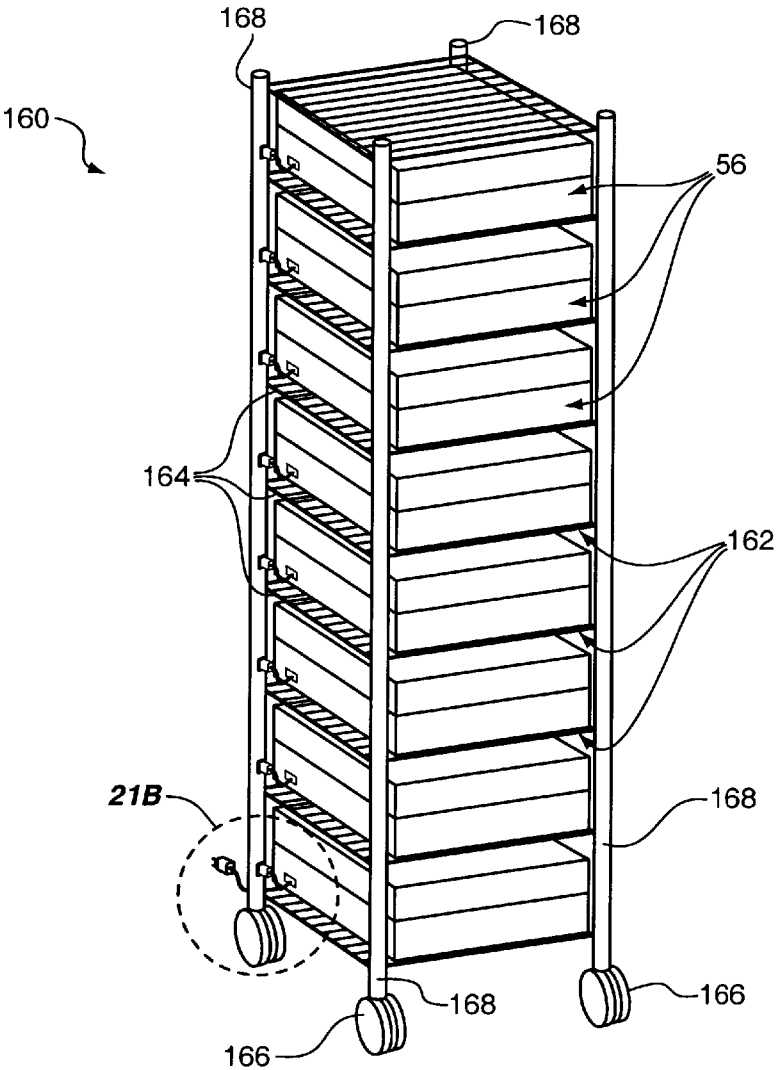
FIG. 21 is a perspective view of a plurality of the storage containers shown in FIG. 11*d*, each containing voting tablets, shown on a storage rack and interconnected for testing thereof.
Figure 21B:
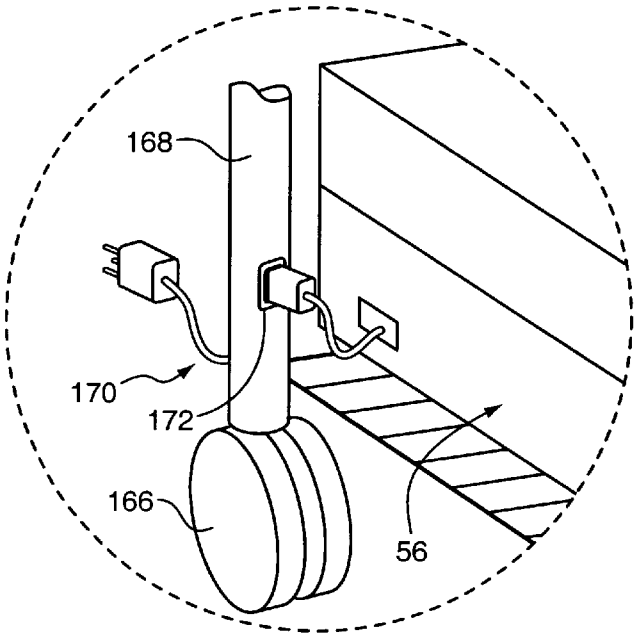
Figure 23:
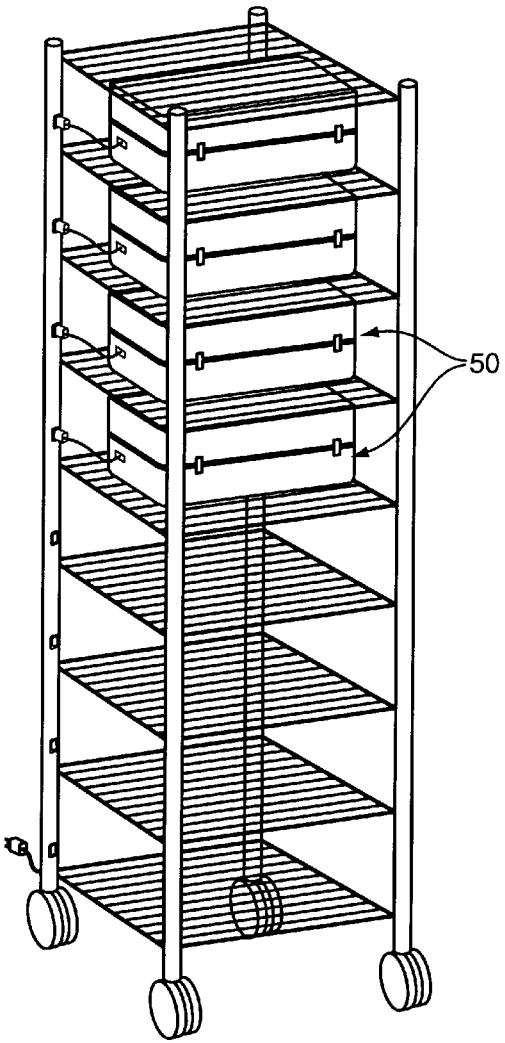
FIG. 23 is a perspective view of a plurality of the storage boxes shown in FIG. 22, each containing one of the tablet network controllers, shown on a storage rack and interconnected for testing thereof.
Figure 22:
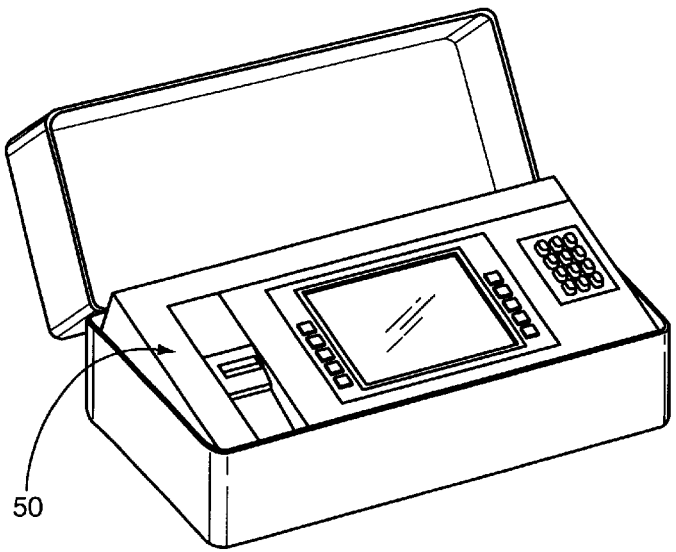
FIG. 22 is a perspective view of a storage box into which one of the tablet network controllers shown in FIG. 6 is shown partially inserted.
Figure 24:
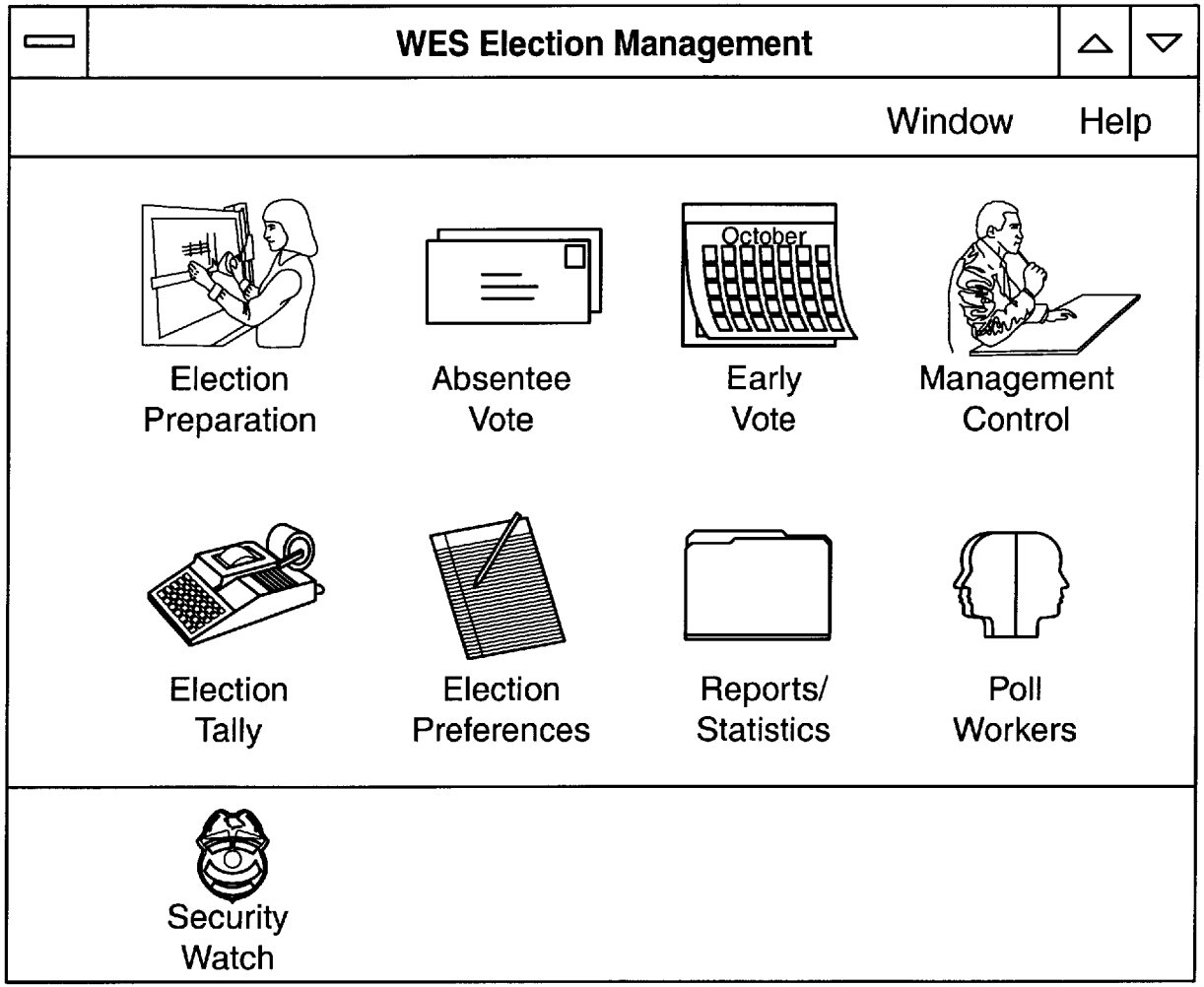
FIG. 24 is a typical display screen which may be viewable on the computer at election headquarters as shown in FIG. 2.
Figure 25:
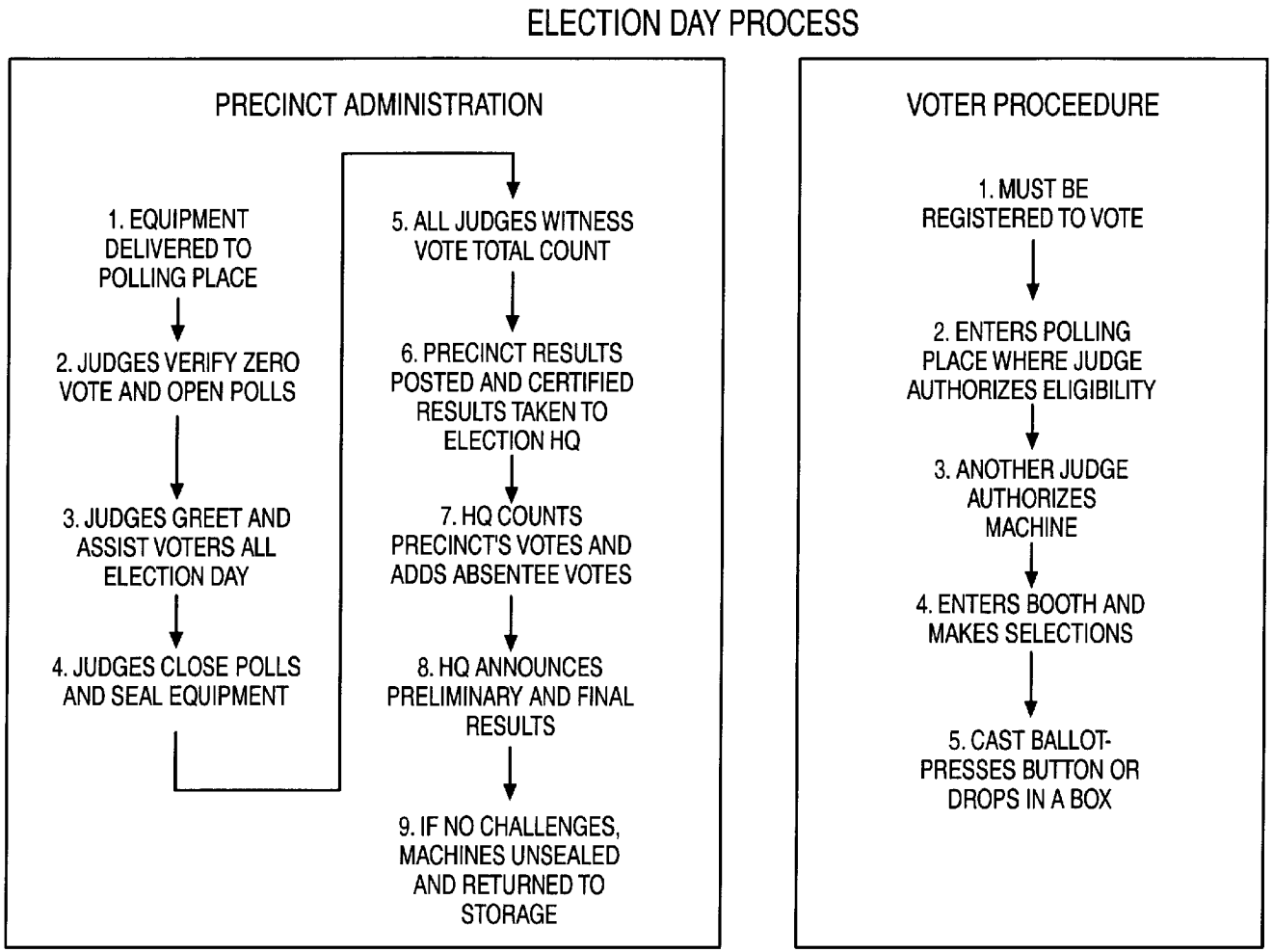
FIG. 25 is a process flow chart of the process on election day using the electronic voting system of FIG. 1.

The privacy enclosure 54 is used in conjunction with a voting tablet to form a voting booth station, as shown in FIGS. 18–20. The privacy enclosure 54 includes hinged panels 150 supported by four legs 152. The legs 152 support the panels 150 at approximately waist height and the panels 150 extend to approximately shoulder height. The exact dimensions are determined by using a combination of human factors engineering data, commonly found in reference books (such as *Bodyspace—Anthropometry, Ergonomics, and the Design of Work*, Stephan Pleasant, Taylor & Francis, 2dedition 1996, and *Human Engineering*

*Guide to Equipment Design*, Joint Army-Navy-Air Force Steering Committee, McGraw-Hill Book Company, 1954), and actual line of sight to the voting tablet. Privacy provided by the privacy enclosure 54 is sufficient so that a male of height in the 95th percentile standing at a distance of two feet from the privacy enclosure 54 cannot see the voting tablet. The lower dimension of the privacy enclosure 54 is derived from the height of the keyboard 106 which is set at the optimal height for a standing female of height in the 50th percentile. While this keyboard height may be optimal for a 50th percentile female, it will adequately accommodate voters of other heights. This means that the top edge of the voting tablet 56 is fifty-five inches off the ground. Placing the keyboard 106 at this height means that even a female of height in the 5th percentile cannot see the voting tablet 56 under the privacy enclosure 54. An angle of sixty-five degrees from horizontal was found to be preferable for the angle of the voting tablet 56. The panels 150 are constructed of metallic frame, typically aluminum, with the panel 150 typically being thin plastic sheet material or upholstered with fabric. The advantage of the plastic sheet material is found in the durability and ease of maintenance and has the capability to cost effectively include custom printed indicia on the panels 150 for a particular jurisdiction.

A key advantage of the present invention is the portability of the system components. To support this advantage, the privacy enclosure 54 collapses into a lightweight, manageable, form factor such that the average poll worker can easily lift, transport, and set it up. The panels 150 of the enclosure 54, at a minimum, are hinged at each of the four corners. The hinge pattern is such that the panels fold on like surfaces (inside to inside, outside to outside) in an accordion fashion. The resulting form factor of the folded panels 150 is that of a thin suitcase with the outermost panels and the metallic frame comprising the exterior of the transportable configuration. This allows the panels 150 to function as the outer shell, or container, of the privacy enclosure 54 when in the transportable configuration. The legs of the privacy enclosure 54 retract into the vertical portion of its associated panel frame and lock into the retracted position when placed in the transportable configuration. When folded, a handle and latching mechanism are provided in the appropriate position for carrying the collapsed enclosure 54 and are unobtrusive when the enclosure 54 is in the deployed configuration (back side of the enclosure).

To deploy the privacy enclosure 54, the legs 152 are extended from their locked, retracted position within the panel frame and are locked in the extended position. The legs 152 are located at each of the four corners of the rectangular privacy enclosure 54 and are set so that a minimum of hinge points exists between the legs 152 as viewed from the side of the enclosure 54. The enclosure 54 is able to maintain upright stability prior to the hinges being fully extended, which aids in the ease of set up. As the corners of the enclosure 54 are positioned into ninety-degree angles, locking struts, or pins, located at the bottom portion of the rear panel frame insert diagonally across the back two corners of the enclosure 54. The angle of the strut is determined by the length of the strut and the pin location on the back and side panels 150. These two attributes are a function of the enclosure dimensions and the restrictions of the transportation configuration. When locked into position, the struts firmly secure the back and two sides of the enclosure 54 at ninety-degree angles. The front panel of the enclosure 54 provides access to the interior of the enclosure 54, employing a hinge method such that an access panel 154 is closed when in the rest position and requiring application of force to open. Preferably, the access panel 154 is a single panel that opens outwardly and is compliant with the requirements of the ADA. However, the access panel 154 may be made up of two sections that operate similarly to cafe-style doors.

The interior of the enclosure 54 provides means for mounting the voting tablet 56 to the three interior panels 150 (two sides and the back). Positioning studs coupled with locking means comprise the mounting method. The positioning studs support the voting tablet 56 at points on bottom-frame members on each side panel 150, extended from the back two corners of the enclosure 54. The top of the voting tablet 56 rests against the vertical frame members of the back panel 150. The privacy enclosure 54 includes means at these four locations to secure and lock the voting tablet 56 in this position such that the securing and locking means prevents tampering and provides additional structural stability to the privacy enclosure 54. The angle of the voting tablet 56, as established by the mounting and locking means is that which is optimal for the presentation of a large group display and observer arrangements according to human factors engineering data. The leg end that contacts the floor provides an automatic leveling means to account for irregular floor surfaces to further increase the privacy enclosure 54 stability.

The positioning studs in the bottom side panels 150 of the enclosure further fix the position of the voting tablet 56 such that when the voting tablet control bank (VTCB) 98 is folded out and placed in the deployed position, bottom-frame members provide means for locking the VTCB 98 in place. In the area of the voting tablet 56 where the VTCB 98 unfolds or slides, the tablet 56 has a suspended center storage area that stores the light fixture. The light fixture is permanently cabled to the voting tablet 56 and is removed from its storage pocket and hung from the top of the back panel 150. The cable is routed over the side then up the back of the voting tablet 56, through the opening between the tablet 56 and back panel 150 of the enclosure 54. The light fixture is then hung in the center of the back panel 150, shining down on the voting tablet 56. The lights are positioned in the frame such that the angle of incidence on the voting tablet 56 is optimized for viewing according to human factors engineering data, including minimizing glare. The privacy enclosure 54 is designed to provide privacy and highlight the voting tablet 56.

An alternative version of the privacy enclosure 54 would include a table top version with side panels and door(s). Such a privacy enclosure would sit on a table in the polling place. Another alternative would be to mount or hang the voting tablet from a wall with privacy panels extending from the wall also to form a privacy enclosure.

Operation (Throughout the Year)

The system 40 manages elections and election data year round and the EAS 60 functions as the central data repository of all of the information required to conduct an election. While in currently available voting systems, the various aspects of elections are separate and distributed, the system of the present invention brings these pieces together to provide greater efficiency, accuracy and cost savings for operation. Election day is the major event but election preparation is year round.

Conducting an Election

To prepare for an election, information is input to the EAS 60 that is specific to an upcoming election. The integrated EAS program uses this and the other supporting information that has been maintained year round in the other databases in order to disseminate the election specific information in the correct manner through the jurisdiction. Election officials input the data for the upcoming election in the form of political parties, candidate races, referendums, contests, and judicial issues. This information, coupled with the other necessary election-related data previously stored by the EAS 60, produces the plethora of information required to stage an election. Output from the EAS 60 in preparing for an election includes but is not limited to: registered voter eligibility logs with bar code designation; equipment lists that assign the number of each type of voting equipment to precincts 48; and a variety of ballot types that correspond to correct contests for each precinct 48. Each ballot type is output by the EAS 60 in three forms: electronic data; graphical ballot overlay (GBO) files; and portable data files (PDF) or bar code designation.

An MMU 58 is installed in each TNC 50 at election headquarters 44 or at the precinct 48 and the TNC 50 uploads the information stored in the MMU 58 into the TNC's FLASH memory so that the TNC 50 contains the necessary information to conduct an election at a particular precinct 48. The present invention uses FLASH memory in each of three precinct electronic components. FLASH memory technology has the ability to reliably store data in a permanent fashion, similar to read only memory (ROM), where no power is required to maintain the data stored therein. The use of FLASH memory specifically eliminates the need for the MMU 58 to rely on batteries to maintain the stored data when the election is completed. This is particularly important when the MMU 58 is transporting ballot images from the precinct 48 to the election headquarters 44. The MMU 58 is not disposed of, nor requires servicing between elections, as in prior art.

The graphical ballot overlay (GBO) files from the EAS 60 are used to drive the ballot production device 65, such as a large format pen plotter, an electro-static plotter, a laser printers, or other suitable equipment and produces the graphical ballot overlay (GBO) 65. The GBO 65 contains printed representations of the subject matter of the election. It represents the ballot as laid out by the EAS 60 and presents the election subject matter in an organized, readable fashion while adhering to the jurisdiction's legal requirements. The GBO 65 can be printed in one of any number of languages and segmented as appropriate for the type of election being conducted. The overlay 65 is installed on the voting tablets 56 in the voting stations 52 prior to the election by election officials at the precinct 48 and the GBO 65 is what the voter sees to direct him/her to the possible selections in the voting station 52. The GBO 65 also has a machine readable code printed on it that is read by the voting tablet 56.

The GBO 65 is divided by contests and races with each highlighted by a contest light. The contest light indicates whether a voter has voted for that contest. Once a voter makes a selection within the contest, the race light is extinguished. The race lights are intended to aid the voter in making sure they vote for all eligible contests.

The machine readable code is either a bar code that identifies the ballot type, serial number and security data or a portable data files (PDF) that, when decoded, contains the electronic version of the ballot. The capability to incorporate the electronic configuration data as a printed code on the ballot eliminates a great deal of logistical requirements of previous voting systems. Eliminated is the risk of assigned equipment and data files going to the wrong precinct 48. Election officials no longer have to assign, manage and monitor delivery of specific equipment to a specific precinct 48. All equipment and transported data files are generic to the election with the configuration key incorporated with the ballot, the variable of the election;

Absentee Voting

Absentee ballots are widely used in elections across the country to allow registered voters to cast their ballots away from the precinct polling place. Many different circumstances can cause a certain percentage of voters to be away from their precinct polling place on election day.

An absentee ballot 180 (FIG. 26) is delivered to the voter either by mail or by the voter picking it up from the jurisdiction headquarters. The ballot is typically returned by mail at some time prior to the close of the election, depending on local rules. Procedures vary with jurisdiction on how absentee ballots are processed once the ballot is returned. At some point the ballots are counted and added to the totals from election day. Some jurisdictions require that the absentee ballots be counted at the precinct polling place that the absentee voter is affiliated with, then added to the precinct polling place totals, while others simply add them at headquarters 44 regardless of precinct affiliation.

The absentee ballot system should provide all of the secrecy, privacy, and security afforded a ballot cast at the precinct polling place. This may require certain standardized procedures at the headquarters 44 since the ballots have to be handled by election officials when absentee ballots are returned by mail.

There are a variety of absentee ballot systems used currently. The majority of the systems use punch cards or optical scan ballots. The jurisdictions that use such equipment include those that also use punch cards and optical scan equipment in their precinct polling places. But there are also jurisdictions that use other equipment in their precincts 48. There have been several proposed absentee systems that include removing a bar coded sticker representing the voter's selection and placing it on the return portion of the absentee ballot.

The present invention utilizes a variation in optical scanning that possesses several advantages over previous absentee systems which will become apparent as described below. The absentee system described herein is an integral part of the total system and, when used in conjunction with other aspects of the system, it provides additional advantages over other absentee systems When conducting an election.

The Absentee Ballot

Figure 26:
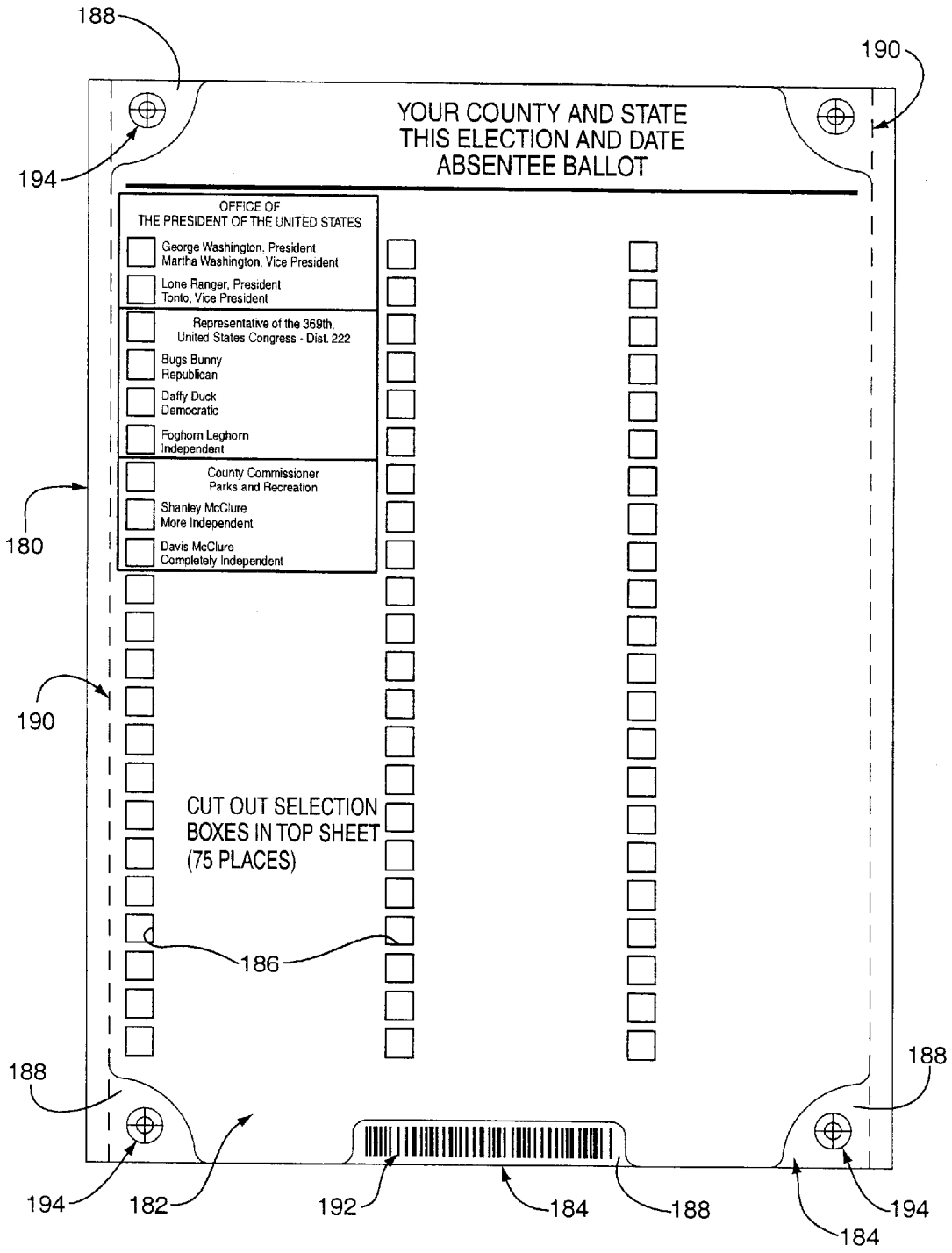
FIG. 26 is a top view of an absentee ballot of the present invention

The absentee ballot 180 includes two sheets of paper, including a top sheet 182 and a bottom sheet 184, as shown in FIG. 26. The top sheet 182 has a matrix of square, cut-out holes 186 in it similar to the voting tablet switch matrix 99 to match the selection boxes as shown on the graphical ballot overlay (GBO) 65. There are some relief areas 188 around the perimeter of the top sheet 182 that exposes the bottom sheet. There are two types of top sheets, one with the holes spaced horizontally on approximately 2¾-inch centers and one with holes spaced on 5-inch centers. The 2¾-inch center holes are used for political and judicial races and the 5-inch centers are used for initiatives and referendums which contain a great deal of text. The bottom sheet 184 has no holes in it. The two sheets of paper 182 and 184 are held together on the vertical sides by perforated edges 190 such that when the edges 190 are removed, the two sheets 182 and 184 are separated. When the absentee ballot 180 is printed, the graphical ballot overlay (GBO) 65 that is used for the voting tablet 56 is printed on the top sheet 182 such that the selections are aligned with the holes 186 in the top sheet 182 of paper. The printed matter on the top sheet 182 of paper further includes printed graphics which indicate that the hole 186 aligned with a particular selection is to be used to choose that selection. The appearance of the printed absentee ballot 180 is identical to the printed GBO 65 used in the precinct polling places during the election day but is scaled down. Ballot rotation methods are supported as may be required by a jurisdiction and handled in an identical manner as with the precinct polling places.

The bottom sheet 184 of the absentee ballot 180 is printed with a bar code 192 that has three data elements. The first data element includes the same information provided by the bar code on the GBO 65 for a precinct polling place voting tablet 56 but gives the ballot style instead of the ballot type. A ballot type is equivalent to what is printed on the GBO 65, while a ballot style is any possible subset thereof. In other words, each precinct 48 should have a single ballot type, but it may support any of a variety of ballot styles including only those races and issues for which the various voters in the precinct may be eligible to vote on. A second data element includes an encrypted numerical code for proving authenticity of the absentee ballot. A third data element includes a unique absentee ballot issue number.

Absentee Ballot Targets

Also printed on the bottom sheet are three graphical marks, called "targets" 194. Two of the targets 194 are positioned along the left, vertical edge of the ballot with one of those and one additional target 194 being positioned along the lower edge. The targets 194 can include any of a variety of shapes with the most typical including a solid center circular area and bounded by two concentric circles. Through the center point of this are a set of perpendicular lines that extended just beyond the outer concentric circle. This collection of graphics forms the target 194.

Printing of the top and bottom sheets 182 and 184 of paper occurs simultaneously because the two sheets 182 and 184 are attached together by the perforated edge 190. There are relief areas 188 cutout on the top sheet 182 where the bar code 192 and targets 194 are printed on the bottom sheet 184.

An alternate ballot design includes a carbonless top sheet and a blank bottom sheet. By using a printing method that does not make an impression when printing, such as a laser printer, the top sheet may be printed with the GBO 65. The voter would then mark their selections on the top sheet and the carbon treated backside of the top side would transfer the voter's selections to the bottom sheet. The voter would then remove the perforated edges to separate the two sheets and return the bottom sheet to headquarters 44. This is a more cost-effective ballot style and is commonly used for billing statements for customers. To prevent spurious marks from being made on the bottom sheet from accidental impressions, the carbon applied to the backside of the top sheet would be applied in the same matrix as the cut out boxes as described above. This will limit the possibility, for example, of making accidental marks by handling of the ballot.

Absentee Write-In Votes

In jurisdictions that permit or require write-in votes, the absentee ballot 180 has a selection in the appropriate races labeled as "write-in." The write-in selection on the absentee ballot 180 has an associated box just like a registered candidate and should a voter chose the write-in option, they mark this box. This is the same method used for the GBO 65 in the polling place. The difference resides in how the write-in candidate is recorded. At the precinct polling place, entry of the write-in candidate is accomplished through the use of the keyboard 106 provided by the voting tablet 56. The write-in candidates on the absentee ballot 180 are hand written by the voter.

After the voter has completed marking all the boxes on the absentee ballot 180 with the top sheet 182 in place, including one or more write-in boxes, they remove the top sheet 182. By referencing the top sheet 182, the voter then locates the marked box on the bottom sheet 184 which indicates a write-in selection. The voter then prints, by hand, the name of the write-in candidate next to the marked write-in box on the bottom sheet 184. This is repeated for each write-in selection the voter wishes to cast.

Absentee Voting Procedure

The absentee ballot 180 is either given to the voter or is sent through the mail. Instructions provided outline the voting procedure and are as follows;

1. Using a pen or a pencil, fill in the boxes corresponding to your selections.
2. When finished, remove the perforated edges 190.
3. Enter any write-ins using the top sheet for reference.
4. Discard the top sheet 182 of paper.
5. Place the bottom sheet 184 in the provided envelope and return to headquarters 44.

At this point, the bottom sheet 184 has the voter's selections marked on it and the preprinted bar code 192 and targets 194, but with none of the text associated with the ballot. The bottom sheet 184 is returned by hand or by mail to headquarters 44. Essentially, after completing the ballot 180, the voter has manually created a two-dimensional code on the ballot 180 which can be read by the scanner 62.

Absentee Ballot Counting

Figure 27:
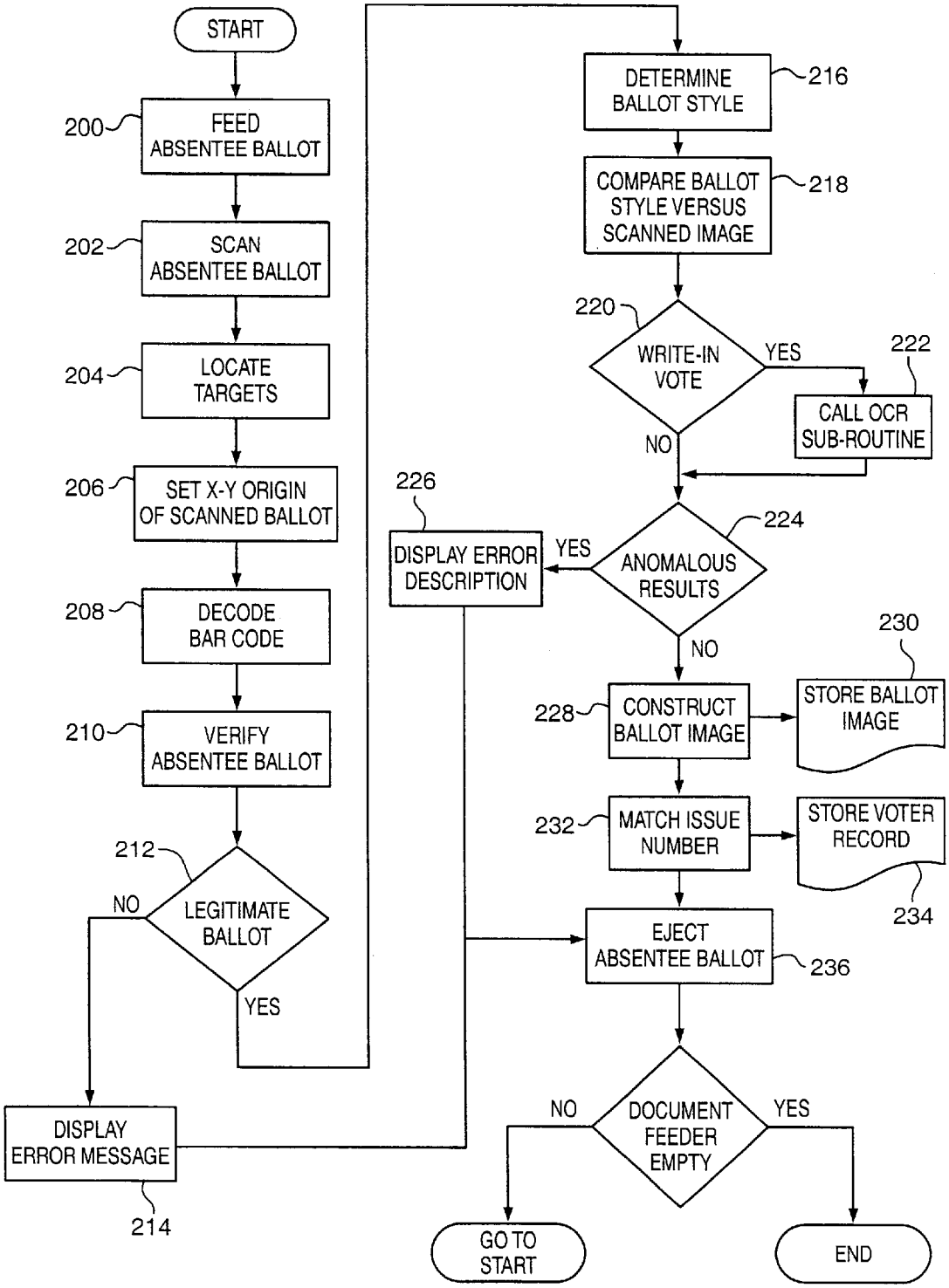
FIG. 27 is a flow chart of the process flow in scanning and counting the absentee ballots of FIG. 26 by the system of FIG. 1.

Once returned to headquarters 44 and after accumulating a certain amount of absentee ballots or just, prior to the close of the election, the jurisdiction administrators load the ballots into an automatic document feeder that feeds (200) the ballots into the document scanner 62. The flow chart of FIG. 27 illustrates the process flow with each process step designated with a reference number in parentheses. The ballots are fed into the previously-described scanner 62, where an image is made (202) of the marks on the bottom sheet 184 of the absentee ballot 180. The scanning software used to process the image breaks up the scanned ballot into three divisions. The first division is the targets 194, which the scanning software looks for first (204). Once located, the software uses the positional data supplied by the targets 194 to set (206) the origin of the X-Y coordinates for the scanned ballot. Once the origin of the ballot is set, the software knows the exact location of the bar code 192 and voter marks made by the voter on the top sheet 182 that were transferred and recorded by ink or carbonless transfer. The image of the encoded bar code is then analyzed and decoded (208) to verify (210) that the ballot is legitimate. If not (212), an error message is displayed (214). The software then reads the issue number and the ballot style (216). The ballot style information tells the scanning software which ballot (218) it is currently imaging. Given the ballot style, the scanning software has access to the ballot creation information from the EAS 60 that gives a listing of positional information of the ballot selections for all the ballot styles. The scanning software reads the positional information for the current image and compares the possible selections contained in the ballot style with the image of the marks made by the voter on the bottom sheet 184 of the absentee ballot 180. From this analysis, the scanning software produces (228) a ballot image, identical to the ones produced in the precinct polling place when voting on a voting tablet 56. The positional information fetched from the ballot creation equates to a button pressed on a voting tablet 56 in the precinct polling place on election day. A ballot image is constructed by the scanning software and stores (230) it in a designated memory location.

The present absentee system is ideally suited to handle any hand printed write-in votes cast by a voter. The document scanner is designed to handle optical character recognition (OCR) and there is a variety of commercial software available for converting handwriting into an electronic image. If an absentee ballot 180 has a write-in vote (220), the scanning software call the OCR routine (222) that interprets the handwritten entry. Depending on a jurisdiction's procedural requirements, the interpreted write-in is either compared to a list of approved write-in options (224), in which case an error message may be displayed (226), or just accepted. In either case, the interpreted write-in is stored as part of the ballot image given the variability in handwriting, the preferred embodiment simply stores the image of the write-in vote for an election official to evaluate its legitimacy. This evaluation is performed with no knowledge of which ballot image is associated with the write-in, to maintain the secrecy and anonymity of the cast ballot.

The automatic document feeder ejects (236) the current ballot and loads the next ballot and the process is repeated until all the ballots are read.

This process happens very fast, with each ballot remaining in the scanner from ten to fifteen seconds. While the scanning software is going through its paces, the computer only displays status information. No information specific to the scanning process or about the current ballot image is available to be displayed. All analysis occurs internal to the computer which maintains the privacy of the voter. The absentee ballot reading process is performed according to jurisdiction procedure which contains provisions to prevent fraud or tampering. These procedures can be as simple as requiring two people to be present at all times.

Built into the scanning software are provisions for handling an unreadable or anomalous ballot. Too many marks for a single race, misalignment, an un-recognizable write-in vote, or some other damage are some examples of potentially anomalous ballots. The absentee system will kick ballots with these types of problems out of the scanner and report the anomalous condition for evaluation by jurisdiction administrators. The scanning software has a high degree of capability in discriminating between which mark is valid. For example, if a voter were to erase a selection and chose another within a particular race without completely erasing the previous one, the scanning software can discriminate between which mark has a higher degree darkness. The level of darkness in both gray scale and coverage area is used to determine a valid selection.

Issue Number

The issue number printed on the ballot and subsequently read by the document scanner is used to manage the eligibility of voters. The confidential issue number is fed into the administrative module of the EAS 60 and is matched (232), then marked as returned within the absentee module of the EAS 60. This information can further be used in the precinct polling place to prohibit a voter who has voted absentee from voting on election day. When the absentee ballot 180 is produced, the name of the voter is associated with the unique number assigned by the EAS 60. This number is internal to the computer and is never viewed by a human. The issue number is incorporated into the bar code 192 and is printed on the ballot with the other information mentioned above. When the ballot is returned and the issue number read, it is matched in the EAS data with the previously stored number representing that the ballot was produced and sent out. After matching the numbers, the association with the voter is severed and the name or voter registration number of the voter is randomly stored (234) in a memory location. At this point, the voter's name and/or voter registration number is stored by the EAS 60 with precinct information and a ballot image is stored randomly in a separate memory location. The data indicates that the voter has voted and this information, coupled with the ballot image, are both stored randomly, with no capability to match the voter to their vote.

Absentee Data in the Precinct Polling Place

In one embodiment, where the MMU 58 is stored in the TNC 50 and the MMU 58 is downloaded with precinct data prior to the election, the downloaded information can include all absentee data. The absentee data is made up of two separate data elements—the ballot images and the voters who have cast absentee ballots. Each of these elements have information which associates it with a specific precinct 48. When the precinct polling place equipment is set up in the precinct polling place and the ballot installed, the bar code on the GBO 65 on the voting tablet 56 indicates which precinct 48 it is and enables the TNC 50 to read the absentee information from the MMU 58. The TNC 50 then downloads only ballot style data for that particular precinct. The absentee ballot images are randomly stored with the ballot images recorded at the precinct polling place. This provides for the absentee ballots 180 to be tallied in the precinct polling place, a requirement for many jurisdictions. The absentee data also provides information on the voters that have voted in the precinct polling place by absentee so if that voter attempts to vote again they will be prohibited from doing so. When the precinct official enters the voter registration number in the TNC 50, the TNC 50 searches the absentee information to find out whether the voter has cast an absentee ballot. If so, the voter will not be approved for voting in the precinct polling place. Some jurisdiction do not use voter registration numbers and, in this instance, the names of voters who have voted by absentee are printed out by the TNC printer 90. Precinct polling place officials then reference the list to prevent a voter from voting twice.

The absentee ballot system of the present invention provides several features and improvements over existing systems. The present system provides absentee ballots that have a similar appearance to the ballot as presented in the precinct polling place on election day and provides a level of anonymity not found in many other systems. By removing the top sheet 182, voting selections can only be determined if someone keeps the returned bottom sheet 184 of the ballot and corresponding return envelope, decodes the bar code, prints a corresponding top sheet 182 of the ballot style, and overlays that top sheet 182 on the returned bottom sheet. This clearly would require a conspiracy to accomplish and would be traceable by the EAS 60 and scanning software.

The present absentee voting system thus provides a seamless method for managing voter eligibility to prevent a voter from voting more than once. By providing all absentee data to the precinct polling places through the MMU 58, a voter is prevented from voting twice. This is an automated process not previously available or proposed. This also allows a jurisdiction to comply with their applicable state laws which may require absentee votes be counted in the precinct polling place. Again, there is no system proposed or available which offers this level of automation and provides the level of accuracy, security, and cost effectiveness.

Early Voting

An increasing number of votes are being cast prior to the actual election day through the use of absentee ballots and early voting. Jurisdictions across the country have different rules, laws, and practices that preclude any one method from being uniformly accepted. The system provides different options and is flexible enough to fit within these various preferences and legal constraints. The EAS 60 interfaces directly to a means for converting absentee ballots into an electronic format. This converting means can include an optical scanner, card, or bar code reader for absentee ballots. It also has software functions for receiving and compiling this information for inclusion in the proper precinct for election day tallies. The system can also be used for early voting should the requirements of the jurisdiction mandate it. Early voting can also be accomplished through the use of precinct equipment that has been configured for early voting using the EAS "Early Voting" function. This differs from election-day precinct configuration as the ballot is optimized to handle a greater range of eligibility to minimize the number of tablets required. Again, the EAS 60 has a specific software module that handles early voting information and maintains this data for inclusion into the proper precinct for election day tallies.

Internet Voting

Figure 31:
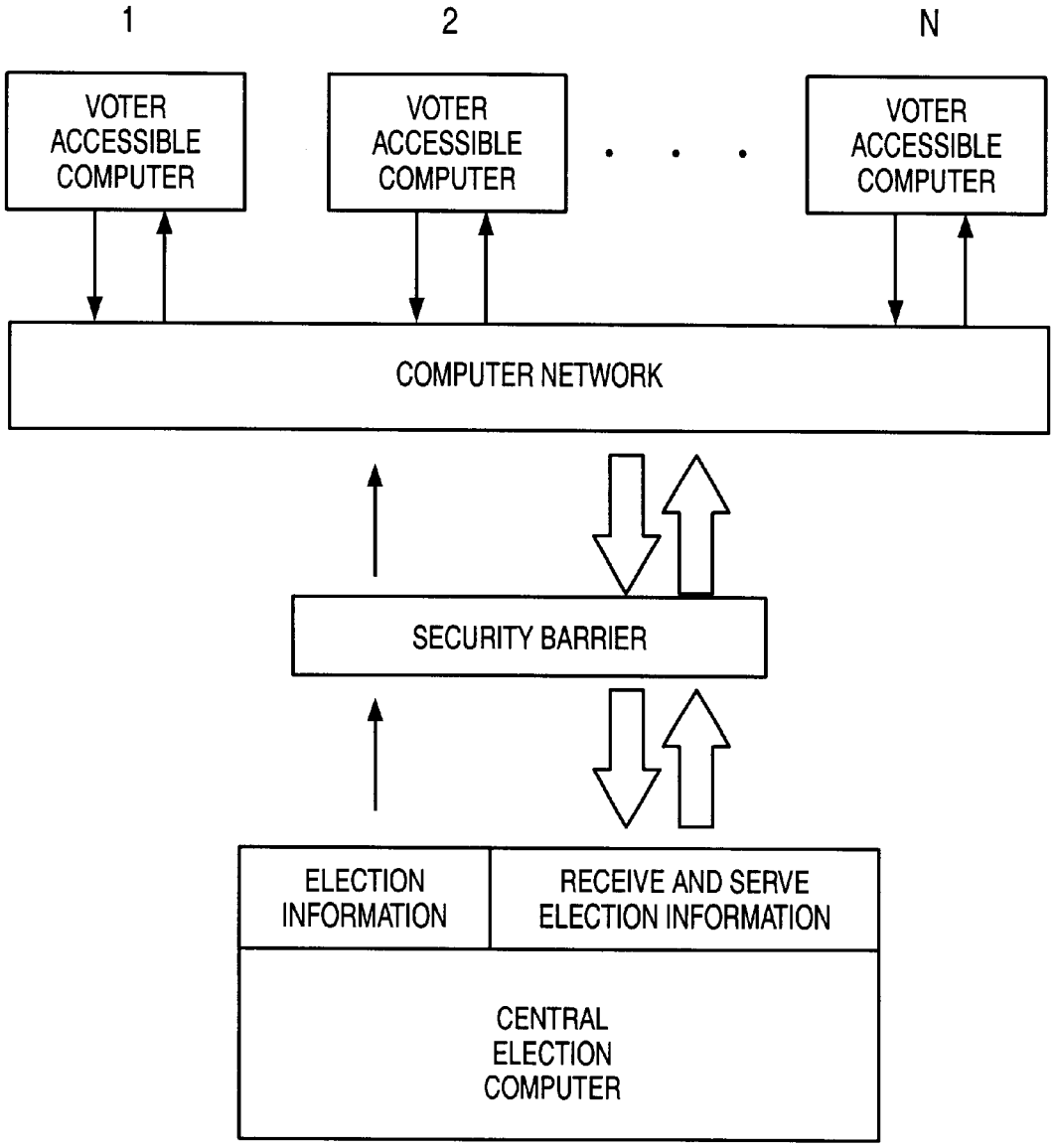
FIG. 31 is a functional block diagram of an Internet portion of the election system of the present invention.

There exists a segment of the population for which the methods of casting ballots described above remains impractical. These are primarily registered voters who are out of town during an election and are unable to be present for election day. Absentee voting procedures, while designed for persons unable to be present for the election, requires the use of mail service and can be unreliable in some foreign locations. The present invention supports this segment of the population by providing means for a registered voter to cast their vote using the Internet, as shown in FIG. 31.

The Internet is a collection of computer networks that allow individual computers connected to it to communicate with each other using a common communication protocol. Access to the Internet is provided through "servers" that are both public and private. Public servers are abundant and provide commercially available access around the world. Private servers are used for a designated population who are granted access. These aspects make the Internet well suited for voting, both domestically and international. The present invention currently utilizes the Internet function to support foreign based voters, but also supports domestic use. Internet use continues to expand nationally and the present invention offers a jurisdiction the option to provide Internet voting on any level, from local to national.

The Internet voting system of the present invention includes a personal computer (PC) with the capability to read the MMU 58, the Internet host software and commercially available security and communication software. The PC is either the central computer 42 used for the EAS 60, or a separate one that is networked to the EAS 60 or, a separate stand alone PC. The preferred embodiment is a stand alone separate computer that is identical to the central computer 42 except has a single, integrated MMU bay and a modem. The Internet software is a custom developed software program that runs on the PC. The Internet software provides the interface between the EAS output and commercial Internet communication software. Access to the Internet is either through a public, private or semi-private server. The public server is the least desirable as there are typically a larger number of users and could limit access. Further, a public server may be subject to intentional group attempts to jam or clog the communication channel to prevent voting. The private server is applicable for larger jurisdictions that would therefore, experience a greater amount of voters using the Internet. The private sever would not be susceptible to attempts at jamming or clogging. This is a preferred method but is less cost effective than the semi-private server.

The semi-private server is a dedicated server that is set up for multiple jurisdictions using the Internet system of the present invention. The semi-private server is maintained by a trusted third party who manages the hardware and interface software for connection to the Internet. A jurisdiction would be connected to the semi-private server by a dedicated, secure digital line, such as a T1 or ISDN line. This reduces the cost for a jurisdiction to utilizes the Internet function of the present invention by simply requiring an annual fee for the service. The semi-private server is dedicated to the Internet voting function so that the hardware and software is optimized for its operation.

In any server scenario, the basic hardware arrangements are nearly the same. The jurisdiction has a host PC that runs the Internet software developed as part of the present invention. Additional commercially available software is also required such as an operating systems (Windows NT) and a secure Web browser. The server for the present invention also includes commercial hardware and software necessary for secure communications over the Internet. A hardware device is used to generate encryption keys, store and manage the keys and, perform bulk encryption/decryption operations. The software provides a "firewall" function, encryption/decryption, digital signing, and support of secure communication protocols. The firewall is typically established in software and setup between the Internet and the host server. The firewall creates a single conduit which all data must pass through, protecting data behind it. The encryption/decryption and digital signature capability is used to encrypt data prior to transmission and decrypt received data. This software operates in conjunction with the hardware device mentioned above. The digital signature capability is used to authenticate data that is both transmitted and received. The standard communication protocols employed provide further protection and include Secure.Socket Layer (SSL) and Secure Multipurpose Internet Mail (S/MINE)

Vote collection over the Internet begins with initializing the Internet host software with the election specifics. In the preferred embodiment, an MMU 58 with the ballot styles stored on it delivered to the host PC and its contents downloaded. The Internet software is able to format the various types of ballot styles from the electronic configuration data stored on the MMU 58. After verifying a successful download, sample ballots are viewed by an official to verify correct ballot translation and configuration. Other pre-election tasks include clearing the ballot image and audit storage areas and a systems and communication check of the host PC. The election is now prepared to go on-line by launching the Web page declaring the election open.

To begin the process of casting a ballot using the Internet, a voter must be registered to vote. Depending on a jurisdiction's requirements the voter may be required to re-register to provide additional information. This may include sworn statements, driver's license or birth certificate. The jurisdiction may want to tender a Personal Identification Number (PIN) to the voter. The voter PIN would be required to access the voting option of the Web page. Once registered, the voter accesses the jurisdiction's Internet site, typically referred to as a "home page" or Web site", and submits a request to vote. The voter's computer must support the SSL protocol, a common feature in popular Internet access software (browsers). The voter then supplies information necessary to identify themselves according to the jurisdiction's requirements. This can include passwords given at the time of registration, digitized signature, or any form of biometrics identification (i.e. fingerprints, retinal scan, voice print, etc.). The voter completes the.Internet vote request and the jurisdiction is notified, through their home page, that the request has been made. Information supplied includes the requesting voter's electronic mail (e-mail) address. Prior to completing the request, the Internet software writes an identification file to the hard disk of the voter's computer. The file is created with data supplied by the Internet software and random information about the voter's computer (amount of memory, autoexec.bat check sum, version of boot code, etc.). The file is saved in a random directory and the Internet software makes a record of the location. The file can be locked to prevent access, encrypted or fragmented which requires a proprietary algorithm to re-construct. The existence of the identification file requires the voter to register and cast their vote from the same computer. Should the file(s) become corrupted or the voter change computers, they have to start over with the request to vote. The identification file serves to fix the communication channel for the duration of the Internet voting process.

Election officials verify the information supplied by the voter and approve the assignment of an issue number for the voter. The issue number is electronically sent to the voter via the Internet to the address supplied by the voter and defines the proper ballot style for the voter. The e-mail is sent using Secure Multipurpose Internet Mail (S/MIME) which is an industry standard used for transmitting secure e-mail messages. Once the voter receives the issue number, the voter is able to cast one and only one ballot. The time required to complete the Internet voting process to this point can vary from real time to weeks. The actual time is dependent on the jurisdiction's requirements.

The voter returns to the jurisdiction's home page and selects the cast ballot option. A valid issue number is required to gain access to the cast ballot option. The issue number contains similar information as the bar code used on the absentee ballot of the present invention, including the correct ballot style for the voter. Additional information is included to identify the voter, such as e-mail address, Internet access provider, caller-ID phone number and data contained in the identification file created when the voter made their request to vote. Given a valid issue number, the identification file is verified as legitimate and the voter gains access to the cast ballot selection. The Internet software loads an executable code file and is written on the voter's computer's hard disk. The ballot style information supplied by the issue number allows the Internet voting software to retrieve the ballot style data from the database and display it on the screen for the voter. The ballot, as viewed from the voter's computer monitor, has a similar appearance as the absentee ballot 180 and, hence, the GBO 65. The voter makes their selections by either scrolling or paging through the ballot. The voter is able to write-in and/or change their selections up until the cast ballot button is activated, just like the voting tablet. Once the voter activates the cast ballot button, the executable code stored previously encrypts the resulting data using information from the identification file and transmits the data packet to the Internet software host. The Internet software, secure behind the firewall, decrypts the transmission and converts the responses of the voter into equivalent switch positions for the voting tablet. After verifying valid switch positions, as indicated for the voter's ballot style, the Internet software randomly saves the ballot image in a secure database and flags the issue number as no longer valid. The Internet software transmits a confirmation, then removes the executable code and identification file. The voter has now cast their vote and is free to log off.

The interface with the voter during the voting process can occur in any language. The jurisdiction can provide different languages simply by the voter selecting their language of choice at the beginning of the voting process. The format of the process and ballot remain the same, it is just displayed in a different language.

All information related to the communication between the Internet software host and the voter, including time, duration, issue number and identification file, are also saved randomly as a file and disassociated with the cast ballot. This data become part of the audit trail that chronicles each Internet voting sequence.

Periodically, the election official can download the ballot images stored on the Internet host to the EAS 60 for inclusion with the other pre-election cast ballots (absentee and/or early). The Internet voting site for a particular election can stay active up to and including election day with the site being disabled coincident with the closing of the polls. However, a jurisdiction may choose to disable the site in advance of election day so that the ballot images from the Internet can be combined with the absentee ballot images and delivered to the precinct in the MMU 58. This allows these ballot images to be counted at the precinct, a requirement for many jurisdictions.

Warehouse/Equipment Management

When the voting equipment is not in use it is typically stored in a warehouse type location. The warehousing of voting equipment is as much a part of the election function as collecting votes at a polling place. The equipment must be reliably stored, inventories maintained, periodically tested to ensure its functionality, and deployed in mass prior to election day and returned. For a jurisdiction of 200 precincts, this can require the movement of 1000 pieces of equipment typically using volunteers that work the elections only once a year. The deployment and subsequent return of the equipment must go smoothly or run the risk of delaying the opening of the polls, or tallying of results. These are potential occurrences that an election administrator cannot tolerate. Furthermore, the equipment must be deployed with a high degree of confidence as to its functionality so that when delivered to the polling place it operates correctly.

Given these requirements, the present invention incorporates methods that provide for efficient management of equipment at the warehouse. Preventive maintenance, accurate inventory monitoring and tracking of equipment flow are the key attributes of the warehousing system.

Preventative Maintenance

Election officials will, at a minimum, perform a pre-election test of the voting systems 40 before they are deployed to the polling place. Previous voting systems required the officials to set up and test the various components and functions of the system. With such systems, precinct officials would again have to test the systems prior to opening the polls to verify that the equipment was not damaged when it was moved to the precinct. While each type of voting equipment (lever, punch card, optical scan, and "direct recording electronics" or DRE) has their own particular test requirements, DREs have the greatest need for visual verification. Since lever-based systems and punch cards systems are purely mechanical, testing their functionality requires physically operating the machine. Optical scan systems require calibration of the ballot reader and a series of test runs to statistically verify repeatability. The tests for these systems are time consuming and, given the mechanical nature of the equipment, yield little information on the future performance of the system.

Direct recording electronics (DRE) are typically microprocessor-based and have internal diagnostics that test the electronics of the system. The tests are performed very fast and are common to most computing devices in other industries. Previous DRE voting systems can perform their diagnostics without completely setting up the machine, but at a minimum must be plugged into a wall outlet for power. With these systems, the diagnostics fall short of providing adequate test coverage and prevent election officials from placing a high degree of confidence in the system's functionality. To gain the level of confidence required, the official must set up the system in its fully-deployed position and manually test each machine by running a test routine to visually verify proper operation. The reason for this is that DREs provide visual feedback to the voter in response to a selection when voting. Internal diagnostics do not test this feedback mechanism in previous systems. The critical nature of the LED to operation is found in the fact that it is the primary communication means to the voter indicating how they have voted.

To eliminate the need to set up the voting system to perform a functional test, the present invention provides design innovations which precludes the need for set up. The Visual Vote Verification, $V^3$™, teamed with implementation of the CAN communication protocol, allows election officials to test in situ. The $V^3$ system, as described above, is an electronic circuit that determines whether or not an LED 102 is illuminated. The present invention incorporates the use of the $V^3$ system into the voting tablet self diagnostics so that the visual feedback mechanism is fully tested. The diagnostics for the LED 102 can be performed while the voting tablet 56 is folded up and stored in the warehouse without removing it from its storage location or as a test prior to opening the polls on election day.

Warehouse Storage

An important innovation in the present invention that supports this increased level of warehouse testing is the use of the Controller Area Network (CAN). Use of CAN enables the voting tablets 56 and TNCs 50 of the present system to be connected together electronically in a network fashion. This allows a desktop computer or other computing means to be connected to the network and control each device on the network. Since the CAN interconnect cable has power and data lines integrated together only one connection is required for each device.

The voting tablets 56 and TNCs 50 are stored in the warehouse on portable racks 160, similar to those used to store pizzas. Each shelf of the "pizza racks" 160 is slightly larger than a voting tablet 56 in the transportation configuration. The folded voting tablet 56 slides flat into a shelf 162 of the rack 160 on guide rails 164 in the rack 160. The guide rails 164 are spaced such that there is a couple of inches of clearance between voting tablets 56. The rack 160 can hold from eight to twelve voting tablets 56 each with the final number dependent on a jurisdiction's requirements. The rack 160 is mounted on caster type wheels 166 suitable for industrial mobility and have incorporated therein locking means so that the rack 160 may be secured in a specific location. Material used in the construction of the rack 160 is typically aluminum or thin gauge steel with a rust prevention coating. The rack 160 has four vertical tubes 168 with a wheel 166 attached at the bottom of each and an end cap on the top to close off the tube from environmental elements. Horizontal "L" shaped guide rails 164 are provided on the sides of the rack 160 to define the shelves 162. The guide rails 164 are typically welded or riveted to the vertical tubes 168 and mounted such that there is a lip that faces toward the interior of the rack 160. The number of guide rails 164 per side is equal to the storage capacity of the rack 160. There are three other "L" shaped members that are used at the back of the pizza rack 160 to connect the two sides of the rack 160. Each of the other "L" shaped members is inverted relative to the side members with one located near the bottom, one in the middle, and one near the top of the rack. Exact position of these members is such that they do not interfere with sliding the voting tablets 56 or TNCs 50 into the rack 160.

The pizza racks 160 have electronic cabling 170, integrated as part of the construction.

The cabling 170 is either routed through the interior of the vertical tubes 168 or is permanently attached on the exterior of the tube 168. In both cases, the rack cable 170 has interface connectors 172 branching off with the spacing matching the center point between the horizontal "L" shaped guide rails 164 on the sides. The connectors 172 at each position are the mating half of the CAN connectors on the voting tablet 56 and TNC 50. When each component is inserted into the rack 160, the rack cable connector 172 can be mated with the device. The schematic of the cable has the power lines breaking away from the data lines at the base and are split into two separate cables. The power line cable is connected to a transformer/regulator device that converts 110 VAC to 12 VDC. The transformer/regulator is a commonly available device and is mounted at the base of the rack 160. The transformer/regulator has a power cord that is plugged into a wall outlet and provides "rack power". The data cable coming off the rack 160 is six to ten feet in length and is plugged into another rack 160 of voting tablets 56 or TNCs 50. The power is separated to prevent having to use a power cable with high current carrying capacity. The data lines are connected to the next rack 160 to continue the formation of a daisy-chained network of up to five hundred devices.

Once all of the voting tablets 56 and TNCs 50 are stored in the racks 160 and connected to the network and power, a computer can be connected to the end of the network data lines. The communication protocol of CAN architecture allows each device to be individually addressed on the network. The controlling device (the aforementioned computer) needs to have communication software and security information about each device before is it able to communicate with the devices. Given this information, the controlling device can initiate the voting tablet 56 and TNC 50 self-diagnostic routines. The voting tablet 56 and TNC 50 self-diagnostic routines have designed-in reporting schemes that, given the proper authorization, will report back to the controlling device the results of the diagnostics. The present invention offers fully automated testing and results reporting without moving a single piece of equipment.

A further advantage to the networked warehousing is found in programming the MMU 58. Most DREs use some form of a memory cartridge that must be individually programmed prior to the election. This is a time consuming process that requires each memory cartridge to be plugged into a programming device and the information downloaded. Prior systems further complicate this task as each memory cartridge is assigned to a specific precinct. The present invention has made the memory cartridges generic which improves over the complicated precinct assignment and further simplifies the pre-programming of the MMUs 58.

With the TNCs 50 networked in the warehouse, the MMU 58 can be installed in the TNC 50 long before election day and information can be downloaded literally minutes before the equipment is deployed. This is a tremendous savings in time and effort and accommodates last minute ballot changes. With the MMUs 58 installed in the networked TNCs 50, the MMU 58 can be updated virtually in real time. This is an advantage prior to the election but there are also benefits following the election.

Each TNC 50 stores an exact record of information contained in the MMU 58 after the election. The MMU 58 is used to transport ballots images back to headquarters after the polls are closed for the votes to be tallied. The TNC 50 maintains an exact record of the MMU 58 information as a back up. Once the TNC 50 is return from the polling place to the warehouse and connected to the network, the jurisdiction has instant access to the back-up information. Given the portability of the present invention, it is conceivable that the equipment would all be returned and connected on election night thereby providing verification of vote totals before the election is even closed. This is a tremendous asset to a election official by giving them a redundant total to verify election results.

Equipment Deployment

Figure 28:
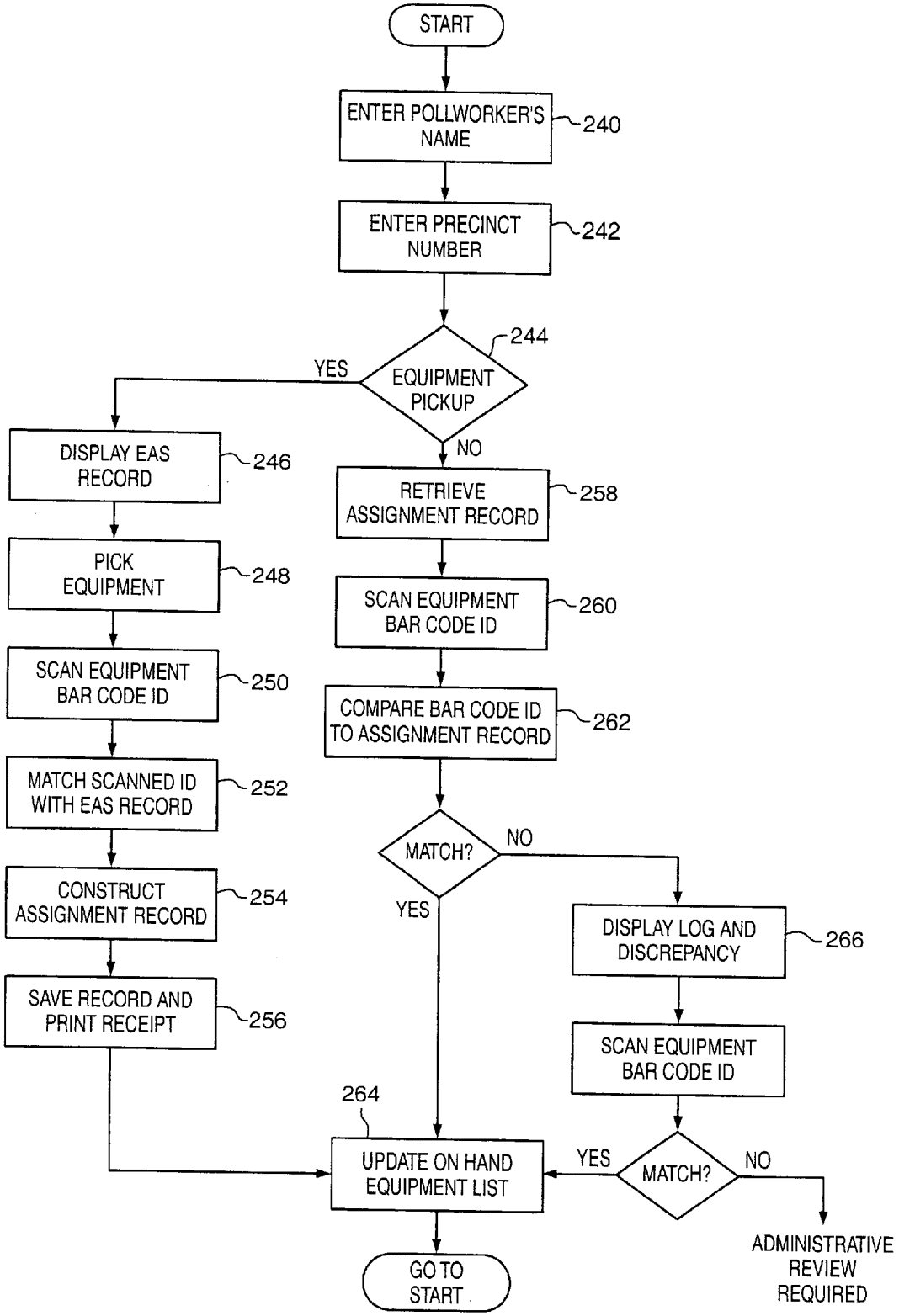
FIG. 28 is a flow chart of the process flow of a warehouse checkout process of the system of FIG. 1.
Figure 29:
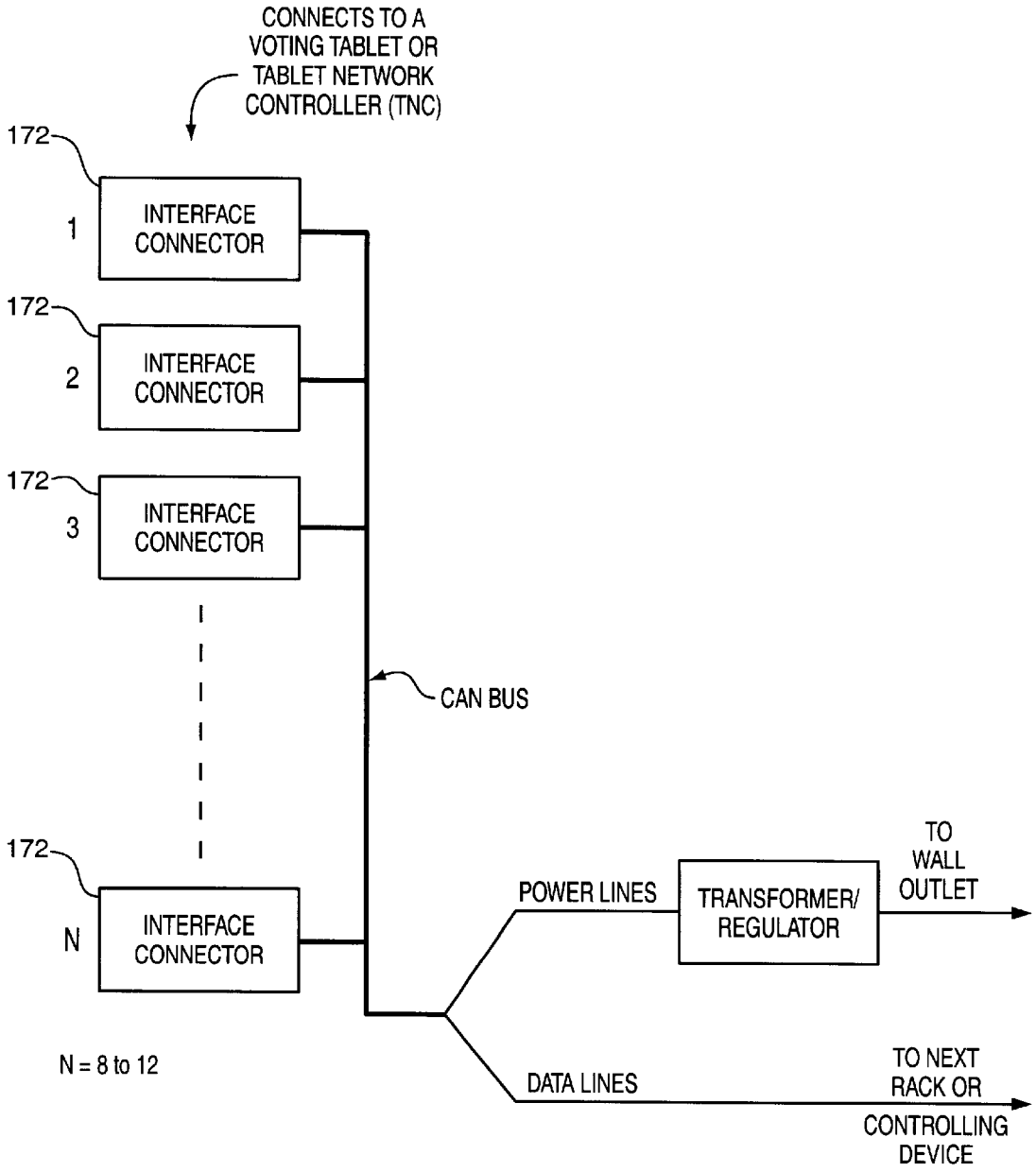
FIG. 29 is a block diagram of the data and power interconnection of the voting tablets of FIG. 21 when stored together in a warehouse.

Equipment deployment is managed by a part of the warehouse management system that utilizes bar code scanning and inventory management software. A flow chart of this process is illustrated in FIG. 28 with reference numbers to the process steps in parentheses. Each voting tablet 56 and TNC 50 has an etched aluminum nameplate secured to the exterior of its enclosure. The nameplate has a unique bar code etched into it that uniquely identifies the voting tablet 56 or TNC 50. When the equipment is to be deployed to the polling places, the poll workers can either come to the warehouse and pick up the equipment or, depending on a jurisdiction's requirements, the equipment can be delivered.

In the instance where the poll worker comes to the warehouse and picks up the equipment, they provide their name and precinct number to a warehouse official. The warehouse authority enters (240 and 242) the information in the warehouse computer. The warehouse computer runs the warehouse software and contains information supplied-by the EAS 60. The computer contains a list of on-hand equipment, as well as information about each polling place and the assigned poll workers. The information from the EAS 60 also includes the number of voting tablets 56 and TNCs 50 required for that particular polling location (246). The poll worker selects (248) the proper quantity of each component and the warehouse official scans (250) the bar code on the nameplates. The warehouse software then compares (252) the scanned bar codes against the equipment list supplied by the EAS 60. After a match is made, the warehouse computer constructs an assignment record for that transaction. The assignment record (254) contains all necessary information about the transaction, such as: time of transaction; name of the poll worker; equipment assigned; and the precinct number. The warehouse computer then prints a receipt and internally saves the data (256). The poll worker is then free to depart. The warehouse computer updates the equipment-on-hand data to signify that those pieces are no longer available for assignment. The warehouse official is not required to be present, the poll worker can perform this task unsupervised should the jurisdiction choose this method.

Upon returning (244), the poll worker name and precinct number are entered into the warehouse computer or the equipment bar code is scanned (260). Each method will retrieve (258) the assignment record created when the equipment was checked out. The equipment is verified against the assignment record (262) and, if verified, the equipment is received back into the warehouse. The warehouse computer updates (264) the on-hand equipment list, otherwise the discrepancy is recorded (266). This provides for efficient and accurate tracking of voting equipment assets for a jurisdiction.

The warehouse software will catch any discrepancies in this process and provide proper notification through the use of the computer screen and printer.

Operation (Election Day)

The TNC 50, MMU 58, voting tablets 56, and privacy enclosures 54 are either delivered or are brought to the precinct 48 by the election officials and in all cases, the election officials bring the ballot(s) in the form of GBOs 65 and an MMU 58 in their possession. The election officials, or their employees assigned to the precinct, set up the equipment, install the assigned ballot in the voting tablet 56, and power up the equipment. During power up several events occur that prepare the equipment for the election. When in the power up state, the TNC 50 performs a self test and then performs a survey of tablets 56 connected to it. The TNC 50 is the host for a serial connected network, such as a CAN, or a secure UHF spread spectrum wireless LAN, so that the voting tablets 56 are either daisy chained to one another or free standing with no communication cables attached. Each voting tablet 56 has an electronic serial number that is read by the TNC 50 and the ballot code is also read at this time. After all of the voting tablets 56 have been inventoried, the ballots styles have been verified and no errors have occurred (e.g., a voting tablet 56 did not have a ballot installed) the TNC 50 signals the operator that it is now ready to configure the MMU 58 as the electronic ballot box. The election data is read from the MMUs FLASH memory and transferred to the TNC's FLASH memory array. Once downloaded, the TNC 50 verifies that the serial numbers of the connected voting tablets 56 are valid and that the ballot codes are legitimate. This method of transferring election specific information to the precinct offers election officials the greatest flexibility in deploying equipment while maintaining required levels of security. The only item produced for an election that is specific to a particular precinct 48 is the graphical ballot overlay 65. All other data and equipment necessary for conducting an election is non-precinct specific which greatly reduces the opportunity for errors in deployment and correction of failed components.

The election officials now perform a pre-election test to verify that all components are operating properly and that they have the proper election definition and configuration. The equipment is designed for very simple operation since a large number of the poll workers may not be computer literate. This requires that the equipment be able to check itself with very little supervision by the poll workers. The voting tablet 56, TNC 50, and MMU 58 have designed-in capability to perform pre-election tests to verify all information prior to opening the polls. The officials are required to perform visual checks on the alignment of the GBO 65 and available election choices. As part of the official verification, each voting tablet is enabled with all choices activated so that officials verify alignment and that the TNC 50 correctly identifies the ballot style in each voting tablet. Once all configurations have been verified, the remaining task is to produce a "zero count" printout from the MMU 58, the primary ballot storage device. When the zero Count is requested, the TNC 50 erases the entire contents of the FLASH memory in the MMU 58 and re-configures it to become the repository for cast ballots during the election. The polls are now ready to be open at the designated time, either automatically by the TNC 50 or manually by the election officials and voting begins.

Voting

To begin the voting sequence, a voter presents the necessary identification to the election official. The validation of the voter eligibility can be accomplished in several ways, depending on the requirements of the jurisdiction. The preferred method is for the voter to present identification to the official who then locates the voter in the voter registration log produced by the EAS 60. The log contains the name of the voter with an accompanying bar code designation. Using the bar code scanner that is connected to the TNC 50, the official scans the code for that voter. At this point, the voter has been verified to be in the proper precinct, it has been verified that he/she has not already voted, and an open voting station has been armed with the proper ballot style for that voter. Of particular importance is that the contests that he/she is not eligible to vote on have been disabled by the TNC 50 through selection of the proper ballot style. The official directs him/her to their assigned booth and the voter enters the privacy enclosure. The authorization of the voter can also occur electronically as the TNC 50 has stored an electronic list in its memory. The election official looks up the name of the voter using the function keys of the TNC 50, and when the name is located and selected, the TNC 50 automatically assigns a ballot style.

When the voter steps into the booth, the contest lights (i.e. presidential, senatorial, etc.) highlighting the eligible contest and measures on the voting tablet are illuminated and the display on the VTCB 98 of the voting tablet 56 flashes the message "Begin voting, make your selections". The voter is then free to make his/her selections. When the voter selects a candidate for governor, the race light for governor goes out and the display shows the contest in a language that was determined by either the bar code registration, or manually by the official as requested by the voter. Even after the voter selects a candidate, he/she is not bound by that selection until later when he/she presses the "Cast Ballot" button 84. Until the "Cast Ballot" button 84 is pressed, the voter is free to change any and all selections simply by pressing another switch 100 involving that same contest. As the voter makes his selections, the current state of the activated selections is updated in the memory of the voting tablet 56 and the TNC 50. The memory of the voting tablet 56 stores a copy of what the voter saw when he cast his ballot. This redundant ballot image produced by the voting tablet 56 is generated by a means other than switch activation, such as the $V^3$ system described above. The primary ballot image is generated by a record of which switches 100 were selected by the voter, then recorded, and then stored by the TNC 50.

Once the voter has made his/her final selection, he/she presses the "Cast Ballot" button 84 and his/her vote is cast and stored in permanent memory in each of the voting tablet 56, the TNC 50, and the MMU 58. The LEDs 102 go blank and an audible tone is heard by the voter indicating that his/her vote has been recorded. The voter then exits the voting station 52.

Until the voter presses the "Cast Ballot" button 84, his/her vote is not recorded. The TNC 50 and the voting tablet 56 maintain the voter's selections in temporary memory until he/she activates the "Cast Ballot" button 84. At that point, the TNC 50 moves his/her selections, or cast ballot image, into FLASH memory, both internal to the TNC 50 and in the voting tablet 56 while at the same time stripping any link between the cast ballot image and the voter's identification. An exact copy of the cast ballot image is moved into the MMU 58 and a copy is read back and sent back to the voting tablet 56. The MMU 58 is the primary storage location while the TNC 50 and voting tablet 56 are back-up copies. The voting tablet 56 has two copies of the ballot. One version comes directly from the voting tablet $V^3$ electronics and the other version is the one that has been stored by the TNC 50. These two versions are always the same except in the event of a communication error or malfunction when storing the ballot. The voting tablet 56 is essentially auditing the TNC 50 and provides for a third copy of the cast ballots.

The TNC 50 maintains the fact that a voter has cast his/her vote but not which vote it was, which is an important aspect in assuring voter secrecy. The voter's ballot image has the voter specific data stripped away when the image is stored. The cast vote (in the form of a ballot image) is further stored randomly in memory to add to the voter's anonymity. When the vote is stored, it is kept intact so that an exact replica of the cast vote could be reproduced should it be necessary. This is called a ballot "image", a term common to computer storage of data, and is part of the audit trail that can be used in the event that some aspect of the election comes into question.

Closing Polls

When it is time for the election officials to close the polls they do so by activating the TNC 50, whereupon several events occur to protect the integrity of the election information. First, the statistics on the day's voting activity that is stored in the voting tablet are downloaded to the TNC 50 and MMU 58 memory locations. Then using public encryption methods, a digital signature of the data stored in the MMU 58, the TNC 50, and the voting tablet is created and written into the memory of each component; The EAS 60 manages the encryption keys, their assignment to equipment and calculation of their validity upon return from the precincts. The MMU 58 is transported back to the central computer 42 at election headquarters 44 for counting and the digital signature is used by the EAS 60 to verify the contents of the MMU 58. The EAS 60 recalculates the signature using the knowledge of the keys and reads the data from the MMU 58. Once the MMU 58 is removed, an exact copy of the data remains intact in the TNC 50 as a back-up. This data is the sum of all voting tablets 56 and can-immediately provide unofficial results for that precinct 48 by use of a precinct printer. A third copy of the information is fractionally stored in each of the voting tablets 56. Each voting tablet 56 maintains a copy of all votes cast from that tablet 56. This stored data differs from the information stored in the TNC 50 and MMU 58 in that it is not stored in sum with the other voting tablets 56. This is important for two reasons. First, it provides a third, distributed, back-up source of sensitive election data and secondly, it maintains a record of activity of just that voting tablet 56 so that in the event the election is challenged or there is a potential malfunction of the tablet 56, data can be traced to the voting tablet level. This provides greater detail of audit information and offers a high level of security.

In addition to precinct results being printed from the TNC 50, by using a modem connected to the RS-232 port 86 on the TNC 50, the results can be instantaneously transmitted via telephone to any designated location.

Tallying Results

The MMUs 58 from the various precincts 48 are transported back to the central computer 42 where they are read by inserting the MMU 58 into the ballot box bay 68. The EAS 60 reads an MMU 58 into its database and simultaneously shadows the data to the WORM drive 43. Once the MMU 58 is read and the data verified using the digital signature, there now exists an exact copy of the MMU data on the WORM disk 43, creating a fourth copy of the data set. The EAS 60 proceeds to read all the MMUs 58 from the precincts 48, updating the election tally in real time, until all the MMUs 58 are read. The EAS 60 is now ready to produce official election results.

Producing Reports

The format of the election reports is set prior to the election. Again, given the various requirements across the country, the EAS 60 provides user-configurable reports to meet a jurisdiction's needs. Once the reports are produced, the election is validated, closed, and stamped official.

The WORM disk 43, with its complete record of the election, is archived in a manner decided by the jurisdiction as a complete record of the election.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

What is claimed is:

1. A method of absentee voting, comprising:

receiving at least one absentee ballot from a voter, said absentee ballot containing identifying information;

scanning said absentee ballot;

detecting said identifying information on said absentee ballot;

verifying that said absentee ballot is legitimate;

producing an image of said absentee ballot; and storing said image of said absentee ballot in at least one storage location.

2. The method of claim 1, wherein the identifying information includes bar code information.

3. The method of claim 1, including detecting ballot selections made by the voter on the absentee ballot.

4. The method of claim 1, including creating ballot information for a plurality of ballots.

5. The method of claim 4, wherein the identifying information includes information associated with one of the plurality of ballots.

6. The method of claim 1, wherein the absentee ballot includes a portion of paper.

7. The method of claim 8, including storing the image of the absentee ballot in a plurality of distinct storage locations.

8. The method of claim 1, including the steps of producing an image of the absentee ballot, and storing the image of the absentee ballot in at least one storage location.

9. A method of enabling absentee voting by at least one voter, comprising:

producing an absentee ballot on demand according to a voter profile corresponding to a selected ballot style;

receiving said absentee ballot from a voter, said absentee ballot containing the identifying information; and processing information from said ballot.

10. The method of claim 9, wherein the identifying information includes information regarding a specific ballot style allocated to the voter profile.

* * * * *